US012203368B2

(12) United States Patent
Williams et al.

(10) Patent No.: US 12,203,368 B2
(45) **Date of Patent: *Jan. 21, 2025**

(54) ROTARY STEERABLE DRILLING ASSEMBLY AND METHOD

(71) Applicant: National Oilwell Varco, L.P., Houston, TX (US)

(72) Inventors: Clay Williams, Houston, TX (US); Russ Gilleylen, Houston, TX (US); Paul Neil, Houston, TX (US); Aaron Schen, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/541,264

(22) Filed: Dec. 15, 2023

(65) Prior Publication Data

US 2024/0110444 A1 Apr. 4, 2024

Related U.S. Application Data

(63) Continuation of application No. 17/293,359, filed as application No. PCT/US2019/061128 on Nov. 13, 2019, now Pat. No. 11,879,333.

(60) Provisional application No. 62/760,115, filed on Nov. 13, 2018.

(51) Int. Cl.

| | |
|---|---|
| ***E21B 7/06*** | (2006.01) |
| ***E21B 21/08*** | (2006.01) |
| ***E21B 44/06*** | (2006.01) |

(52) U.S. Cl.
CPC ..... *E21B 7/06* (2013.01); *E21B 21/08* (2013.01); *E21B 44/06* (2013.01)

(58) Field of Classification Search
CPC ..... E21B 7/06; E21B 21/08; E21B 44/06
See application file for complete search history.

(56) References Cited

U.S. PATENT DOCUMENTS

2002/0175003 A1* 11/2002 Pisoni ..... E21B 7/067 175/74
2014/0190750 A1* 7/2014 Samuel ..... E21B 44/00 700/275

* cited by examiner

*Primary Examiner* — Dany E Akakpo
(74) *Attorney, Agent, or Firm* — Conley Rose, P.C.

(57) ABSTRACT

A rotary steerable drilling assembly includes a driveshaft rotatably disposed in a driveshaft housing, a bend adjustment assembly coupled to the driveshaft housing, a bearing mandrel coupled to the bend adjustment assembly, and a torque control assembly including a rotor configured to couple with a drill string; a stator assembly coupled to a downhole motor; and a torque control actuator assembly configured to control the amount of torque transmitted between the rotor and the stator assembly, wherein the torque control actuator assembly includes a spool valve including a cylinder including a port and a hydraulically actuatable piston slidably disposed in the cylinder.

25 Claims, 26 Drawing Sheets

ROTARY STEERABLE DRILLING ASSEMBLY AND METHOD

CROSS-REFERENCE TO RELATED APPLICATIONS

The present application is a continuation of U.S. non-provisional patent application Ser. No. 17/293,359 filed May 12, 2021, entitled "Rotary Steerable Drilling Assembly and Method", which is a 35 U.S.C. § 371 national stage application of PCT/US2019/061128 filed Nov. 13, 2019 and entitled "Rotary Steerable Drilling Assembly and Method", which claims benefit of U.S. provisional patent application No. 62/760,115 filed Nov. 13, 2018, and entitled "Rotary Steerable Drilling Assembly and Method" both of which are incorporated herein by reference in their entirety.

STATEMENT REGARDING FEDERALLY SPONSORED RESEARCH OR DEVELOPMENT

Not applicable.

BACKGROUND

In drilling a borehole into an earthen formation, such as for the recovery of hydrocarbons or minerals from a subsurface formation, it is typical practice to connect a drill bit onto the lower end of a drill string formed from a plurality of pipe joints connected together end-to-end, and then rotate the drill string so that the drill bit progresses downward into the earth to create a borehole along a predetermined trajectory. In addition to pipe joints, the drill string typically includes heavier tubular members known as drill collars positioned between the pipe joints and the drill bit. The drill collars increase the weight applied to the drill bit to enhance its operational effectiveness. Other accessories commonly incorporated into drill strings include stabilizers to assist in maintaining the desired direction of the drilled borehole, and reamers to ensure that the drilled borehole is maintained at a desired gauge (i.e., diameter). In vertical drilling operations, the drill string and drill bit are typically rotated from the surface with a top dive or rotary table. Drilling fluid or "mud" is typically pumped under pressure down the drill string, out the face of the drill bit into the borehole, and then up the annulus between the drill string and the borehole sidewall to the surface. The drilling fluid, which may be water-based or oil-based, is typically viscous to enhance its ability to carry borehole cuttings to the surface. The drilling fluid can perform various other valuable functions, including enhancement of drill bit performance (e.g., by ejection of fluid under pressure through ports in the drill bit, creating mud jets that blast into and weaken the underlying formation in advance of the drill bit), drill bit cooling, and formation of a protective cake on the borehole wall (to stabilize and seal the borehole wall).

In some applications, horizontal and other non-vertical or deviated boreholes are drilled (i.e., "directional drilling") to facilitate greater exposure to and production from larger regions of subsurface hydrocarbon-bearing formations than would be possible using only vertical boreholes. In directional drilling, specialized drill string components and "bottomhole assemblies" (BHAs) may be used to induce, monitor, and control deviations in the path of the drill bit, so as to produce a borehole of the desired deviated configuration. In some applications, directional drilling may be carried out using a downhole or mud motor provided in the BHA at the lower end of the drill string immediately above the drill bit.

Downhole motors may include several components, such as, for example (in order, starting from the top of the motor): (1) a power section including a stator and a rotor rotatably disposed in the stator; (2) a driveshaft assembly including a driveshaft disposed within a housing, with the upper end of the driveshaft being coupled to the lower end of the rotor; and (3) a bearing assembly positioned between the driveshaft assembly and the drill bit for supporting radial and thrust loads. For directional drilling, the motor may include a bent housing to provide an angle of deflection between the drill bit and the BHA. Conventionally, orientation of the BHA in the borehole is typically controlled by manipulating the drill string at a surface drilling rig. Given that the drill string is typically held stationary (e.g., nonrotating relative to the borehole) as the downhole motor is operated during directional drilling, longitudinal friction resulting from sliding contact between the stationary drill string and a wall of the borehole may hinder the performance of the downhole motor in extended reach drilling applications.

In some applications, directional drilling may be carried out using a rotary steerable system (RSS) comprising tools that operate above the drill bit as completely independent tools controlled from the surface for manipulating the orientation of the BHA in situ within the borehole. The tools of the RSS are used to steer the drill string in a desired direction away from a vertical or other desired wellbore orientation, such as by means of steering pads or reaction members that exert lateral forces against the wellbore wall to deflect the drill bit relative to wellbore centerline. RSS tools may often include a hydraulic bias unit for controlling the orientation of the BHA, the hydraulic bias unit being driven by a downhole hydraulic pump that is powered by a downhole mud turbine or electric motor. RSS tools are often complex and expensive, and have limited run times due to battery and electronic limitations. These tools also may require the entire tool to be transported from the well site to a repair and maintenance facility when parts of the tool break down. Further, many currently-used designs require large pressure drops across the tool for the tools to work well. Currently there is no easily separable interface between RSS control systems and formation-interfacing reaction members that would allow directional control directly at the bit

BRIEF SUMMARY OF THE DISCLOSURE

An embodiment of a rotary steerable drilling assembly for directional drilling comprises a driveshaft rotatably disposed in a driveshaft housing, a bend adjustment assembly coupled to the driveshaft housing, a bearing mandrel coupled to the bend adjustment assembly, and a torque control assembly comprising a rotor configured to couple with a drill string, a stator assembly coupled to a downhole motor, and a torque control actuator assembly configured to control the amount of torque transmitted between the rotor and the stator assembly, wherein the torque control actuator assembly comprises a spool valve comprising a cylinder including a port and a hydraulically actuatable piston slidably disposed in the cylinder, wherein the bend adjustment assembly includes a first position configured to provide a first deflection angle between a longitudinal axis of the driveshaft housing and a longitudinal axis of the bearing mandrel, and wherein the bend adjustment assembly includes a second position configured to provide a second deflection angle between the longitudinal axis of the driveshaft housing and the longitudinal axis of the bearing mandrel, the second deflection angle being different from the first deflection angle. In some embodiments, the torque control actuator assembly is configured to selectably adjust a restriction to a fluid flow along a circulation flowpath extending between the rotor and the stator assembly. In some embodiments, the circulation flowpath extends through the port of the cylinder. In certain embodiments, the torque control actuator assembly comprises a rotary pilot valve rotatably disposed in a valve body, and an actuator coupled with the rotary pilot valve, wherein the actuator is configured to selectably rotate the rotary pilot valve relative to the valve body, and wherein the rotary pilot valve is configured to adjust an axial position of the piston of the spool valve in response to relative rotation between the rotary pilot valve and the valve body. In certain embodiments, the stator assembly comprises an outer housing and an inner stator, and wherein the circulation flowpath extends between the outer housing and the inner stator. In some embodiments, the drilling assembly comprises a bend adjustment actuator assembly configured to move the bend adjustment assembly between the first position and the second position in response to a change in flowrate of a drilling fluid received by the downhole motor. In some embodiments, the bend adjustment actuator assembly comprises a locker piston coupled to an actuator housing of the bend adjustment assembly, the locker piston comprising a first set of teeth, and a teeth ring coupled to the bearing mandrel, the teeth ring comprising a second set of teeth configured to matingly engage the first set of teeth and to transmit torque between the bearing mandrel and the actuator housing. In certain embodiments, the locker piston has a first end configured to receive fluid pressure equal to fluid pressure in the surrounding environment and a second end configured to receive fluid pressure equal to fluid pressure of the drilling fluid flowing through the bend adjustment assembly. In certain embodiments, the bend adjustment assembly further comprises a locking piston that includes a locked position preventing actuation of the bend adjustment assembly between the first and second positions, and an unlocked position permitting actuation of the bend adjustment assembly between the first and second positions. In some embodiments, the bend adjustment assembly includes a third position that provides a third deflection angle between the longitudinal axis of the driveshaft housing and the longitudinal axis of the bearing mandrel, the third deflection angle being different from both the first deflection angle and the second deflection angle. In some embodiments, the torque control assembly comprises: a first mode configured to adjust an angular orientation of the drilling assembly within a wellbore, and a second mode configured to hold the angular orientation of the drilling assembly within the wellbore, wherein the torque control assembly is actuated between the first mode and the second mode in response to altering a rotational rate of the drill string. In certain embodiments, the torque control assembly comprises a third mode configured to restrict relative rotation between the rotor and the stator assembly, and wherein the torque control assembly is actuated into the third mode in response to altering the rotational rate of the drill string. In certain embodiments, the torque control assembly is configured to actuate from the first mode to the second mode in response to the rotational rate of the drill string being increased from a first rotational rate to a second rotational rate that is greater than the first rotational rate, and actuate into the third mode in response to the rotational rate of the drill string being increased from to a third rotational rate that is greater than both the first rotational rate and the second rotational rate.

An embodiment of a drilling system for drilling a borehole that extends through a subterranean earthen formation comprises a drilling rig, a drill string extending from the drilling rig into the borehole, a drilling assembly coupled to an end of the drill string and comprising a driveshaft rotatably disposed in a driveshaft housing, a bend adjustment assembly coupled to the driveshaft housing, a bearing mandrel coupled to the bend adjustment assembly, a torque control assembly comprising a rotor configured to couple with the drill string, a stator assembly coupled to a downhole motor, and a torque control actuator assembly configured to control the amount of torque transmitted between rotor and the stator assembly, wherein the torque control actuator assembly comprises a spool valve comprising a cylinder including a port and a piston slidably disposed in the cylinder, wherein the bend adjustment assembly includes a first position configured to provide a first deflection angle between a longitudinal axis of the driveshaft housing and a longitudinal axis of the bearing mandrel, and wherein the bend adjustment assembly includes a second position configured to provide a second deflection angle between the longitudinal axis of the driveshaft housing and the longitudinal axis of the bearing mandrel, the second deflection angle being different from the first deflection angle. In some embodiments, the torque control actuator assembly is configured to selectably adjust a restriction to a fluid flow along a circulation flowpath extending between the rotor and the stator assembly and through the port of the cylinder. In some embodiments, the torque control actuator assembly comprises a rotary pilot valve rotatably disposed in a valve body, and an actuator coupled with the rotary pilot valve, wherein the actuator is configured to selectably rotate the rotary pilot valve relative to the valve body, wherein the rotary pilot valve is configured to adjust an axial position of the piston of the spool valve in response to relative rotation between the rotary pilot valve and the valve body. In certain embodiments, the torque control assembly comprises an electronics package that is in signal communication with the drilling rig via a telemetry system, and wherein the electronics package is configured to transmit a control signal to the actuator to control the rotation of the rotary pilot valve relative to the valve body. In certain embodiments, the stator assembly comprises an outer housing and an inner stator, and wherein the circulation flowpath extends between the outer housing and the inner stator. In some embodiments, the drilling assembly further comprises a bend adjustment actuator assembly configured to move the bend adjustment assembly between the first position and the second position in response to a change in flowrate of a drilling fluid received by the downhole motor. In some embodiments, the bend adjustment actuator assembly comprises a locker piston coupled to an actuator housing of the bend adjustment assembly, the locker piston comprising a first set of teeth, and a teeth ring coupled to the bearing mandrel, the teeth ring comprising a second set of teeth configured to matingly engage the first set of teeth and to transmit torque between the bearing mandrel and the actuator housing. In certain embodiments, the bend adjustment assembly further comprises a locking piston that includes a locked position preventing actuation of the bend adjustment assembly between the first and second positions, and an unlocked position permitting actuation of the bend adjustment assembly between the first and second positions. In certain embodiments, the torque control assembly comprises a first mode configured to adjust an angular orientation of the drilling assembly within the wellbore, a second mode configured to hold the angular orientation of the drilling assembly, and a third mode configured to restrict relative rotation between the rotor and the stator assembly, wherein the torque control assembly is actuated between the first mode, the second mode, and the third mode in response to altering a rotational rate of the drill string. In some embodiments, the torque control assembly is configured to actuate from the first mode to the second mode in response to the rotational rate of the drill string being increased from a first rotational rate to a second rotational rate that is greater than the first rotational rate, and actuate into the third mode in response to the rotational rate of the drill string being increased from to a third rotational rate that is greater than both the first rotational rate and the second rotational rate.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of disclosed embodiments, reference will now be made to the accompanying drawings in which.

DETAILED DESCRIPTION OF DISCLOSED EXEMPLARY EMBODIMENTS

Figure 1:
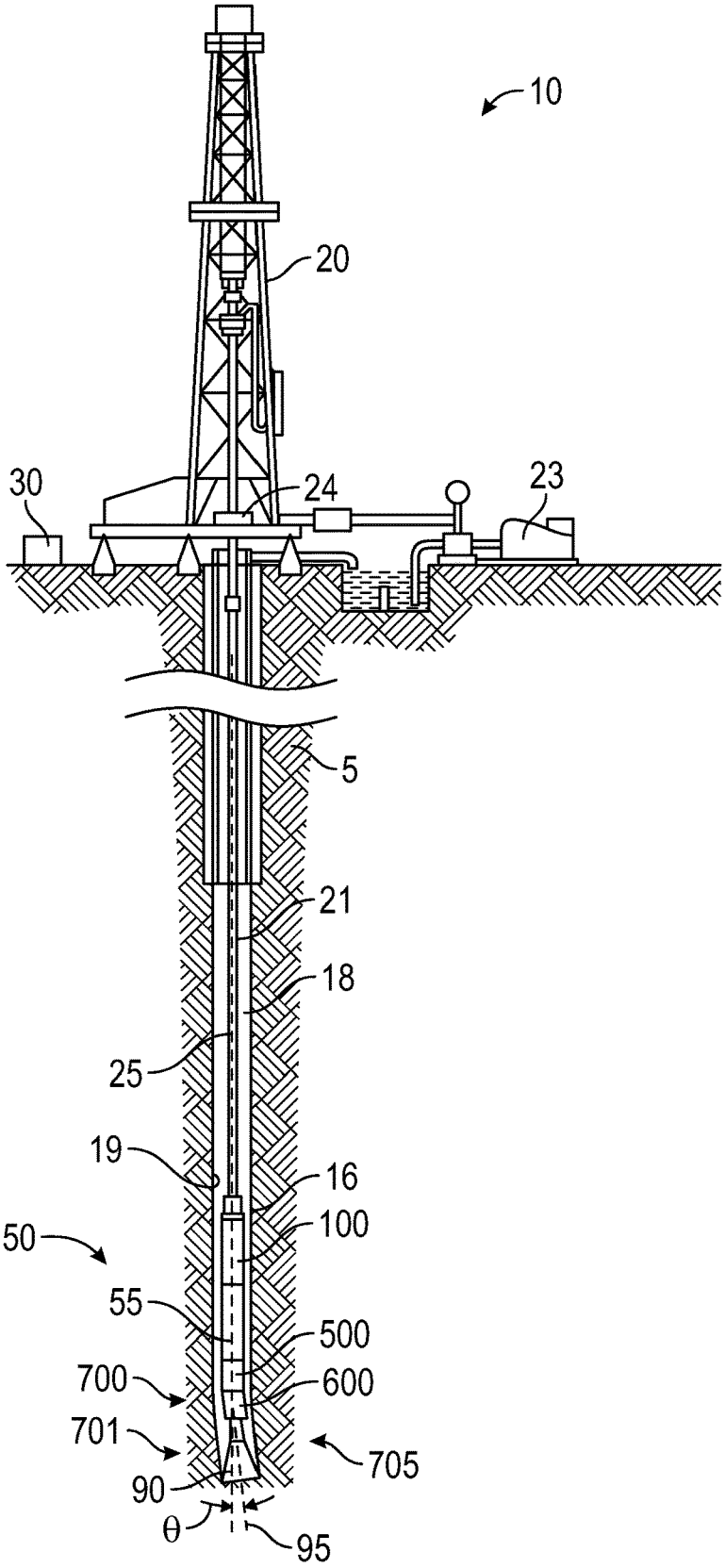
FIG. 1 is a schematic partial cross-sectional view of a well system including an embodiment of a downhole mud motor in accordance with principles disclosed herein.

The following discussion is directed to various embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection as accomplished via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

Referring to FIG. 1, an embodiment of a well or drilling system 10 is shown. Drilling system 10 is generally configured for drilling a borehole 16 in an earthen formation 5. In the embodiment of FIG. 1, drilling system 10 includes a drilling rig 20 disposed at the surface, a drill string 21 extending downhole from rig 20, a rotary steerable drilling assembly 50 coupled to the lower end of drill string 21, and a drill bit 90 attached to the lower end of drilling assembly 50. A surface or mud pump 23 is positioned at the surface and pumps drilling fluid or mud through drill string 21. Additionally, rig 20 includes a rotary system 24 for imparting torque to an upper end of drill string 21 to thereby rotate drill string 21 in borehole 16. In this embodiment, rotary system 24 comprises a rotary table located at a rig floor of rig 20; however, in other embodiments, rotary system 24 may comprise other systems for imparting rotary motion to drill string 21, such as a top drive.

In this embodiment, drilling assembly 50 comprises a torque control assembly 100 coupled to a lower end of drill string 21 and generally configured to control the orientation of drilling assembly 50. Particularly, as will be discussed further herein, torque control assembly 100 permits drilling assembly 50 to hold a desired orientation or "tool face" within borehole 16 as drill string 21 is rotated at the surface by rotary system 24, thereby reducing longitudinal friction between drill string 21 and a wall 19 of borehole 16 during directional drilling. In this embodiment, drilling assembly 50 also includes a downhole mud motor 55 coupled to a lower end of torque control assembly 100 for facilitating the drilling of deviated portions of borehole 16. Moving downward along drilling assembly 50, motor 55 includes a hydraulic drive or power section 60, a driveshaft assembly 500, and a bearing assembly 600. In some embodiments, the portion of drilling assembly 50 disposed between drill string 21 and motor 55 can include other components, such as drill collars, measurement-while-drilling (MWD) tools, reamers, stabilizers and the like. In this embodiment, drilling system 10 includes a telemetry system 30 configured for transmitting signals and data between drilling assembly 50 disposed in borehole 16 and the surface. In some embodiments, telemetry system 30 may communicate with components of drilling assembly 50 electrically via wired drill pipe (WDP) joints of drill string 21; however, in other embodiments, telemetry system may communicate with components of drilling assembly 50 via pressure pulses transmitted through borehole 16.

Power section 60 of drilling assembly 50 converts the fluid pressure of the drilling fluid pumped downward through drill string 21 into rotational torque for driving the rotation of drill bit 90. Driveshaft assembly 500 and bearing assembly 600 transfer the torque generated in power section 60 to bit 90. With force or weight applied to the drill bit 90, also referred to as weight-on-bit ("WOB"), the rotating drill bit 90 engages the earthen formation and proceeds to form borehole 16 along a predetermined path toward a target zone. The drilling fluid or mud pumped down the drill string 21 and through drilling assembly 50 passes out of the face of drill bit 90 and back up the annulus 18 formed between drill string 21 and the wall 19 of borehole 16. The drilling fluid cools the bit 90, and flushes the cuttings away from the face of bit 90 and carries the cuttings to the surface.

Figure 2:
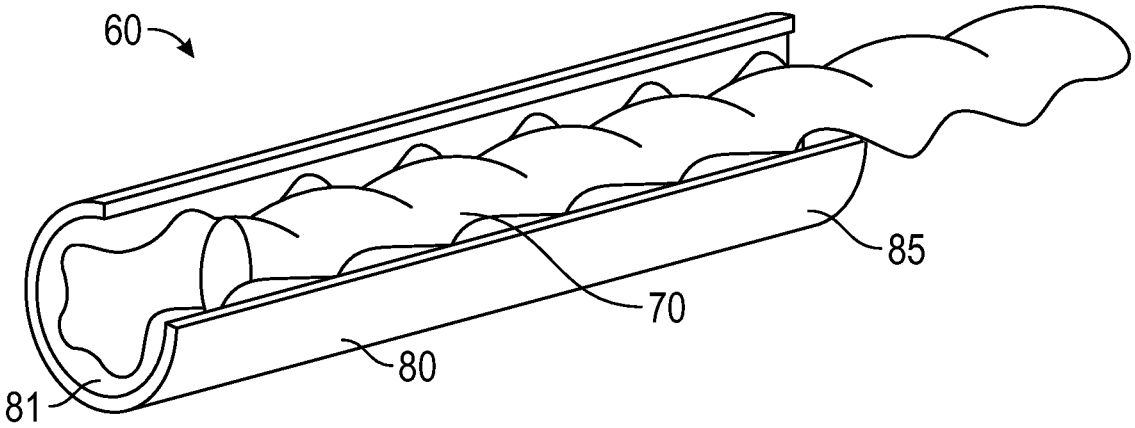
FIG. 2 is a perspective, partial cut-away view of the power section of FIG. 1.
Figure 3:
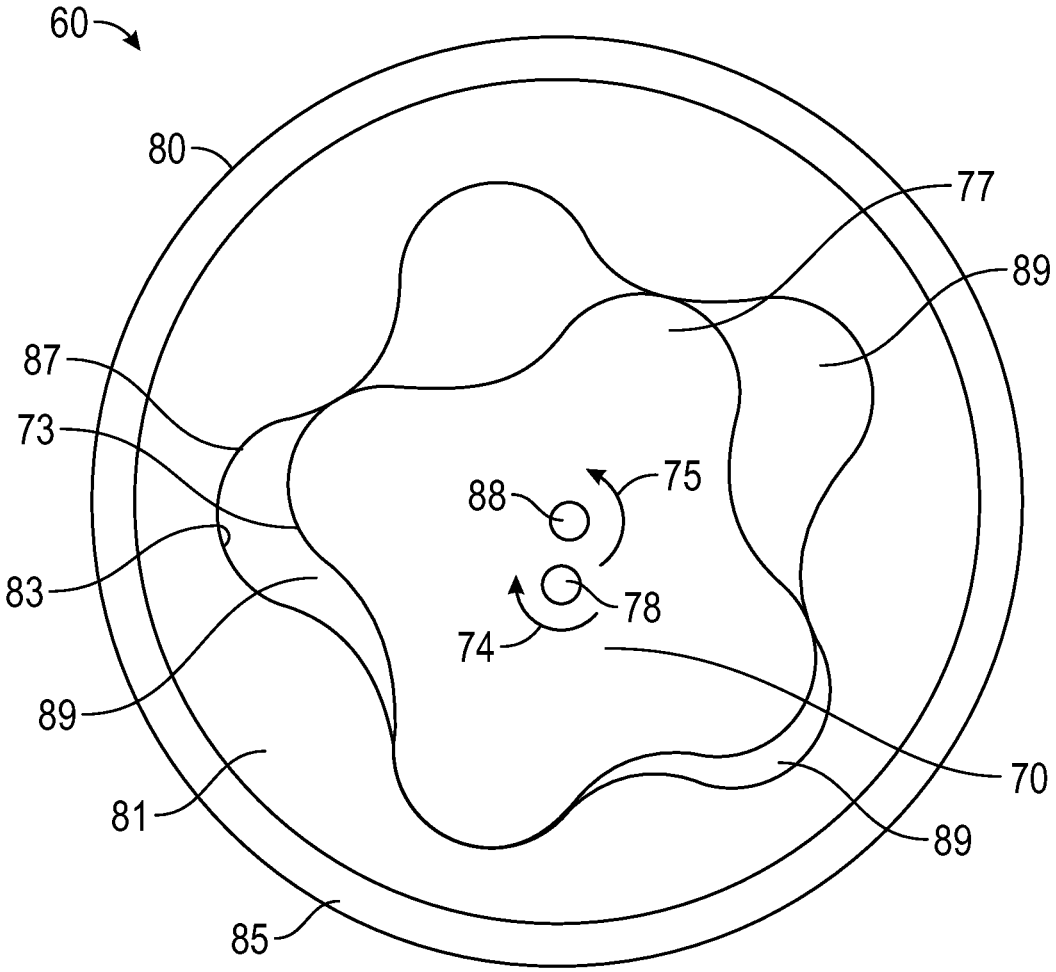
FIG. 3 is a cross-sectional end view of the power section of FIG. 1.
Figure 4:
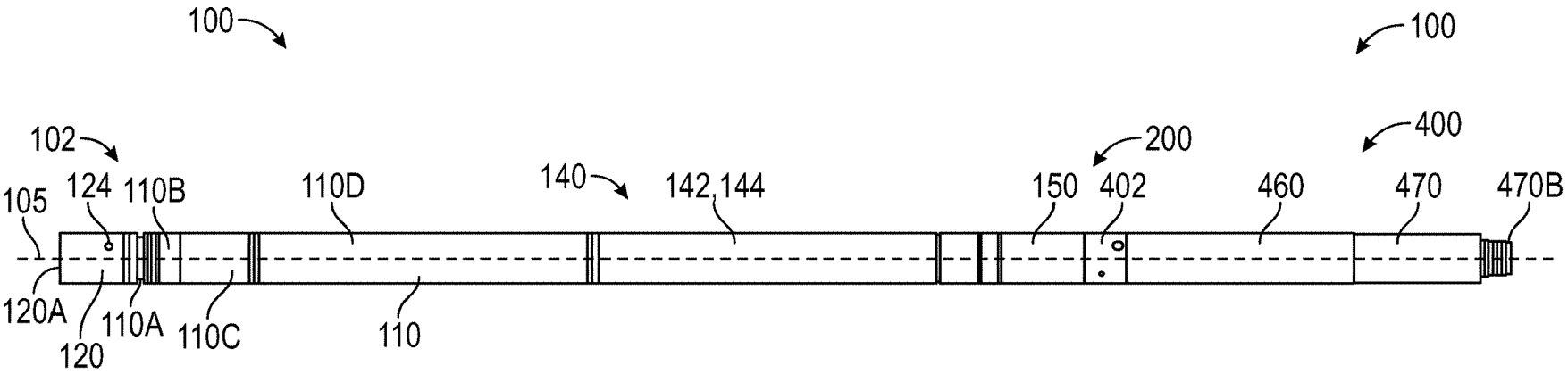
FIG. 4 is a side view of an embodiment of a torque control assembly of the drilling system of FIG. 1 in accordance with principles disclosed herein.
Figure 5:
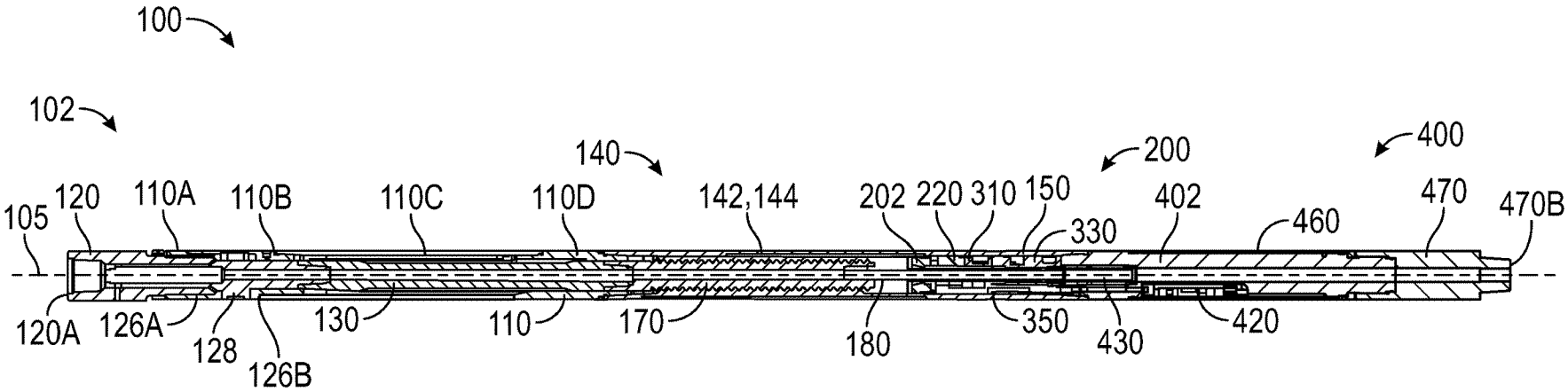
FIG. 5 is a side cross-sectional view of the torque control assembly of FIG. 4.

Referring to FIGS. 1-3, an embodiment of the power section 60 of drilling assembly 50 is shown schematically in FIGS. 2 and 3. In the embodiment of FIGS. 2 and 3, power section 60 comprises a helical-shaped rotor 70 disposed within a stator 80 comprising a cylindrical stator housing 85 lined with a helical-shaped elastomeric insert 81. Helical-shaped rotor 70 defines a set of rotor lobes 77 that intermesh with a set of stator lobes 87 defined by the helical-shaped insert 81. As best shown in FIG. 3, the rotor 70 has one fewer lobe 77 than the stator 80. When the rotor 70 and the stator 80 are assembled, a series of cavities 89 are formed between the outer surface 73 of the rotor 70 and the inner surface 83 of the stator 80. Each cavity 89 is sealed from adjacent cavities 89 by seals formed along the contact lines between the rotor 70 and the stator 80. The central axis 78 of the rotor 70 is radially offset from the central axis 88 of the stator 80 by a fixed value known as the "eccentricity" of the rotor-stator assembly. Consequently, rotor 70 may be described as rotating eccentrically within stator 80.

During operation of the power section 60, fluid is pumped under pressure into one end of the power section 60 where it fills a first set of open cavities 89. A pressure differential across the adjacent cavities 89 forces the rotor 70 to rotate relative to the stator 80. As the rotor 70 rotates inside the stator 80, adjacent cavities 89 are opened and filled with fluid. As this rotation and filling process repeats in a continuous manner, the fluid flows progressively down the length of hydraulic drive section 80 and continues to drive the rotation of the rotor 70. Driveshaft assembly 500 shown in FIG. 1 includes a driveshaft discussed in more detail below that has an upper end coupled to the lower end of rotor 70. In this arrangement, the rotational motion and torque of rotor 70 is transferred to drill bit 90 via driveshaft assembly 500 and bearing assembly 600.

Referring to FIGS. 1 and 4-17, an embodiment of torque control assembly 100 of the well system of FIG. 1 is shown in FIGS. 4-17. In the embodiment of FIGS. 4-17, torque control assembly 100 has a central or longitudinal axis 105 and generally includes (moving from an uphole end of torque control assembly 100 to a downhole end of assembly 100) a slipping joint 102, a positive displacement pump 140, an actuator assembly 200, and an electronics sub 400. As described above, torque control assembly 100 is generally configured to control an angular orientation of drilling assembly 50 in borehole 16. In other words, torque control assembly is configured to control the angular orientation of drilling assembly 50 respective the central axis 105 of torque control assembly 100. As will be described further herein, torque control assembly 100 is configured to selectably control the amount of torque transmitted between slipping joint 102, which is positioned at an upper end of torque control assembly 100 and coupled to a lower end of drill string 21, and the electronics sub 400 positioned at a lower end of torque control assembly 100.

Figure 6:
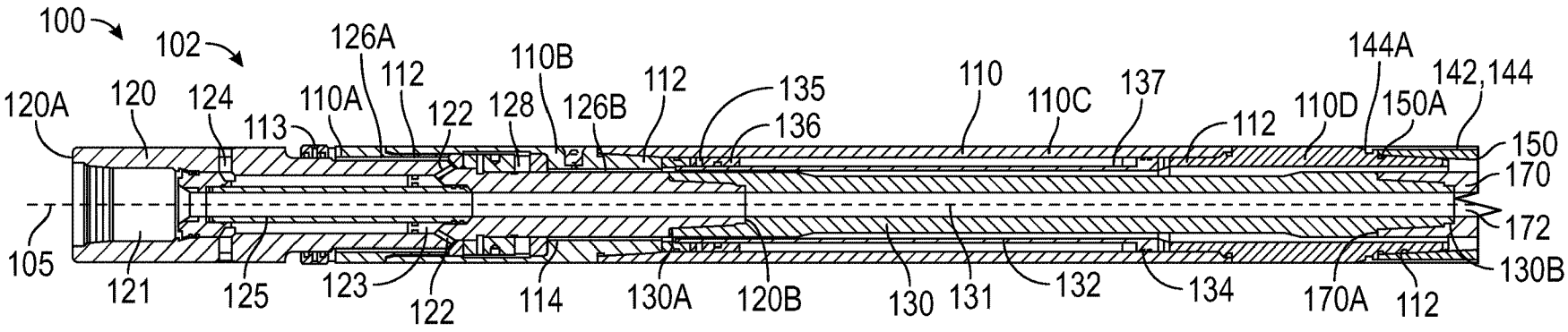
FIG. 6 is a side cross-sectional view of an embodiment of a slipping joint of the torque control assembly of FIG. 4 in accordance with principles disclosed herein.

As shown particularly in FIG. 6, in this embodiment, slipping joint 102 of the torque control assembly 100 generally includes an outer housing 110, a mandrel 120 rotatably disposed in housing 110, and a first or upper flex shaft 130 coupled to mandrel 120 and rotatably disposed in housing 110. Housing 110 has a linear central or longitudinal axis disposed coaxial with the central axis 105 of torque control assembly 100. In this embodiment, outer housing 110 comprises an upper housing joint 110A, a pair of intermediate housing joints 1108 and 110C, and a lower housing joint 110D, where a central throughbore or passage extends through each of housing joints 110A-110D. Housing joints 110A-110D are coupled together at releasable or threaded connections 112 formed therebetween, where threaded connections 112 each comprise a sealed connection restricting fluid communication thereacross. Although in this embodiment housing 110 comprises a plurality of releasably coupled housing joints 110A-110D, in other embodiments, housing 110 may comprise a single, monolithically formed housing.

In this embodiment, bearing mandrel 120 of slipping joint 102 has a first or upper end 120A, a second or lower end 120B, and a central through passage 121 extending axially from lower end 120B and terminating axially below upper end 120A. The upper end 120A of bearing mandrel 120 is coupled to the lower end of drill string 21 while the lower end 120B is directly coupled to upper flex shaft 130. Upper flex shaft 130 of slipping joint 102 comprises a first or upper end 130A, a second or lower end 130B opposite upper end 130A, and a central passage 131 extending between ends 130A and 1308. The upper end 130A of upper flex shaft 130 is threadably coupled to the lower end 120B of mandrel 120. In this embodiment, bearing mandrel 120 includes a plurality of circumferentially spaced lubrication ports 122 extending radially to the outer surface of mandrel 120. In this arrangement, lubrication ports 122 are separated or sealed from central passage 121 of mandrel 120 by an annular first or upper floating piston 123 that is pressure balanced with the surrounding environment via a radial port 124 formed in mandrel 120 proximal upper end 120A. Particularly, upper floating piston includes an outer annular seal that sealingly engages an inner surface of central passage 121 and an inner annular seal that sealingly engages a first or upper sleeve 125 positioned in central passage 121 of mandrel 120. During drilling operations, mandrel 120 is rotated about central axis 105 relative to housing 110 and drilling fluid flows through central passage 121 of mandrel 120. Thus, mandrel 120 is permitted to rotate freely about central axis 105 relative to housing 110.

Housing 110 has a central bore or passage defined by a generally cylindrical inner surface 111 that extends between ends 110A and 1108. An annular seal 113 is positioned on the inner surface 111 of housing 110 proximal upper end 110A in sealing engagement with an outer surface of mandrel 120. In this arrangement, an annular sealed chamber 114 is formed radially between inner surface 111 and the outer surface of bearing mandrel 120, the sealed chamber 114 extending into the annular space (via lubrication ports 122) formed between the inner surface of mandrel 120 and the outer surface of central sleeve 124 that is sealed from the flow of drilling fluid through passage 121 via the annular seals of upper floating piston 123.

In this embodiment, slipping joint 102 includes a first or upper radial bearing 126A, a thrust bearing assembly 128, and a second or lower radial bearing 126B, each of which are disposed in sealed chamber 114. Upper radial bearing 126A is disposed about mandrel 120 and axially positioned above thrust bearing assembly 128, and lower radial bearing 126B is disposed about mandrel 120 and axially positioned below thrust bearing assembly 128. In general, radial bearings 126A and 126B permit rotation of mandrel 120 relative to housing 110 while simultaneously supporting radial forces therebetween. In this embodiment, radial bearings 126A and 126B each comprise sleeve type bearings that slidingly engage the outer surface of mandrel 120. However, in general, any suitable type of radial bearing(s) may be employed including, without limitation, needle-type roller bearings, radial ball bearings, or combinations thereof.

The thrust bearing assembly 128 of slipping joint 102 is disposed about mandrel 120 and permits rotation of mandrel 120 relative to housing 110 while simultaneously supporting axial loads in both directions (e.g., off-bottom and on-bottom axial loads). In this embodiment, thrust bearing assembly 128 generally comprises a pair of caged roller bearings and corresponding races, with the central race threadedly engaged to bearing mandrel 120. In other embodiments, one or more other types of thrust bearings may be included in slipping joint 102, including ball bearings, planar bearings, etc. In still other embodiments, the thrust bearing assemblies of slipping joint 102 may be disposed in the same or different thrust bearing chambers (e.g., two-shoulder or four-shoulder thrust bearing chambers).

In this embodiment, radial bearings 126A, 162B, and thrust bearing assembly 128 are oil-sealed bearings. Particularly, sealed chamber 114 comprises an oil or lubricant filled chamber that is pressure compensated via upper floating piston 123. Additionally, slipping joint 102 comprises a second or lower sleeve 132 disposed about upper flex shaft 130 and coupled to the inner surface 111 of housing 110. Lower sleeve 132 includes an annular seal 134 that sealingly engages the inner surface 111 of housing 110 and a radial port 135 in fluid communication with sealed chamber 114. An annular second or lower floating piston 136 is positioned radially between the inner surface 111 of housing 110 and an outer surface of lower sleeve 132, where lower floating piston 136 includes a radially outer seal that sealingly engages the inner surface 111 of housing 110 and a radially inner seal that sealingly engages the outer surface of lower sleeve 132.

In the configuration described above, an annular expansion chamber 137 is formed between the inner surface 11 of housing 110 and the outer surface of lower sleeve 132, the expansion chamber 137 extending axially between lower floating piston 136 and the seal 134 of lower sleeve 132. Expansion chamber 137 is configured to allow for the thermal expansion of oil disposed within sealed chamber 114, and in some embodiments, may be filled with a compressible fluid. Thus, in response to thermal expansion of oil disposed in sealed chamber 114, a portion of the oil in sealed chamber 114 may flow into the annulus disposed between housing 110 and lower sleeve 132 via port 135 of lower sleeve 132. As previously described, in this embodiment, bearings 126A, 126B, and 128 are each oil-sealed. However, in other embodiments, the bearings of slipping joint 102 may be mud lubricated.

Figure 7:
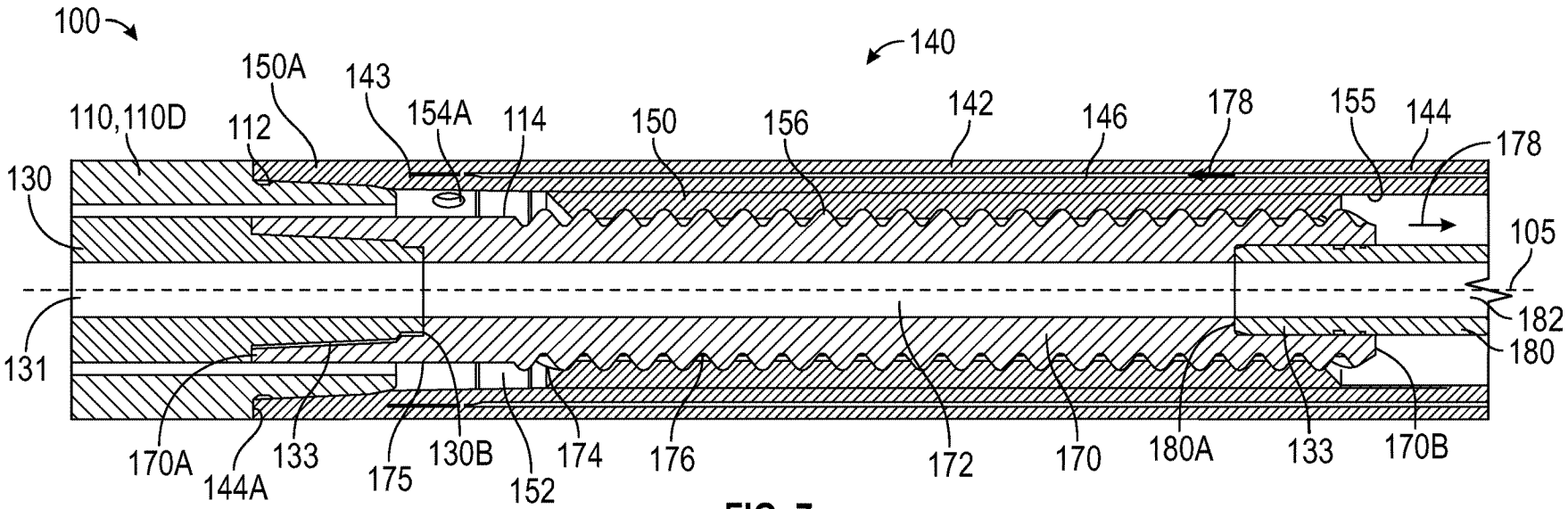
FIG. 7 is a side cross-sectional view of an embodiment of a positive displacement pump of the torque control assembly of FIG. 4 in accordance with principles disclosed herein.
Figure 8:
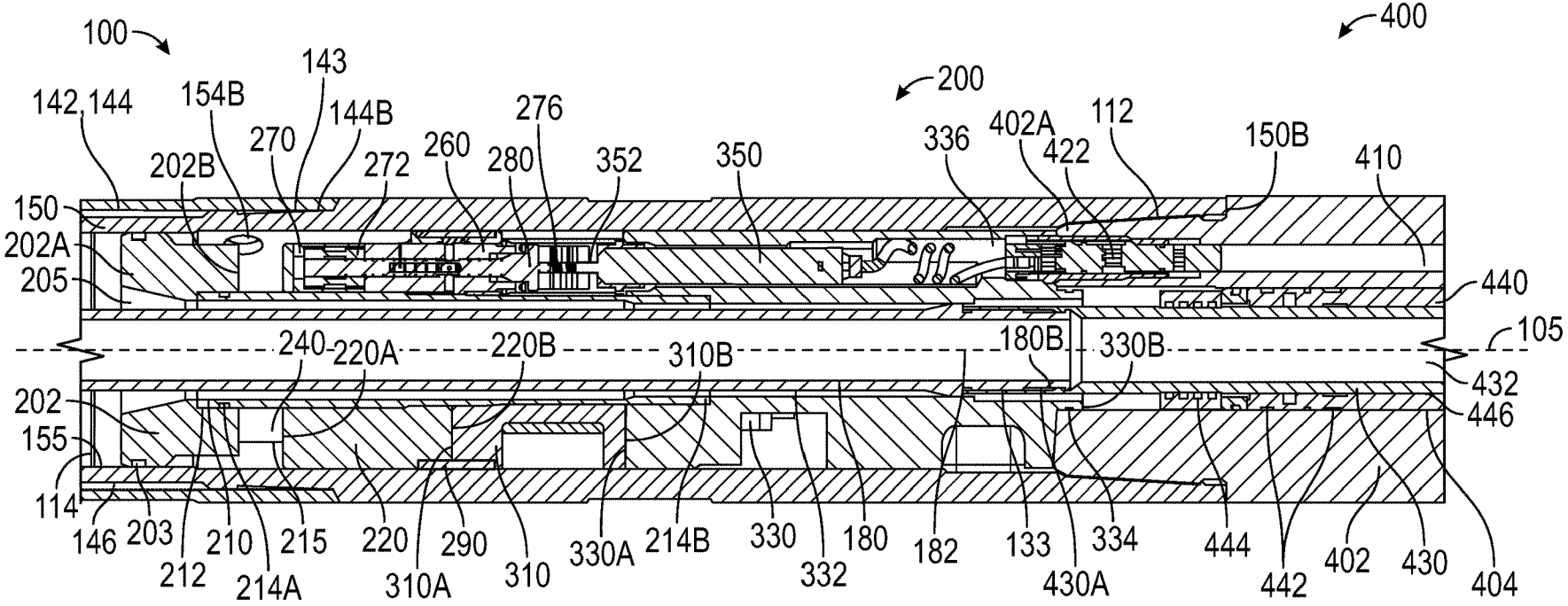
FIG. 8 is a side cross-sectional view of an embodiment of an actuator assembly of the torque control assembly of FIG. 4 in accordance with principles disclosed herein.

As shown particularly in FIGS. 6-8, the positive displacement pump 140 of torque control assembly 100 generally includes a stator assembly 142, a helical-shaped rotor 170 rotatably disposed in stator assembly 142, and a second or lower flex shaft 180 coupled with rotor 170 and rotatably disposed in stator assembly 142. Stator assembly 142 and rotor 170 each include a central or longitudinal axis disposed coaxially with central axis 105 of torque control assembly 100. In this embodiment, stator assembly 142 comprises a double-wall stator including an outer housing 144 and an inner stator 150 disposed within outer housing 144. The ends 144A and 144B of outer housing 144 are each sealingly coupled to stator 150 at sealed connections 143. An annulus 146 is formed radially between outer housing 144 and stator 150, annulus 146 extending between the ends 144A and 144B of outer housing 144.

The stator 150 of stator assembly 142 has a first or upper end 150A, a second or lower end 150B opposite upper end 150A, and a central bore or passage 152 extending between ends 150A and 150B. The upper end 150A of stator 150 is coupled to a lower end to the lower housing joint 110D of slipping joint 102 at a sealed, threaded connection 112. In this embodiment, stator 150 includes a first or upper radial port 154A located proximal the upper end 150A of stator 150 and a second or lower radial port 1546 axially spaced from upper radial port 150A. Ports 154A and 154B provide for fluid communication between annulus 146 and the central passage 152 of stator 150, where central passage 152 comprises a portion of the sealed chamber 114. Stator 150 of stator assembly 142 includes an inner surface 155 that defines a set of stator lobes 156 positioned between radial ports 154A and 154B.

Rotor 170 of the positive displacement pump 140 has a first or upper end 170A, a second or lower end 1706 opposite upper end 170A, and a central bore or passage 172 extending between ends 170A and 170B. The upper end 170A of rotor 170 is coupled to the lower end 130B of upper flex shaft 130 at a sealed, threaded connection 133, the central passage 172 of rotor 170 being in fluid communication with the central passage 131 of upper flex shaft 130. An outer surface 175 of rotor 170 defines a set of rotor lobes 174 that intermesh with the stator lobes 156 of stator 150. In this embodiment, rotor 170 has one fewer lobe 174 than stator 150. When the rotor 170 and the stator 150 are assembled, a series of cavities 176 are formed between the outer surface 175 of the rotor 170 and the inner surface 155 of the stator 150. Each cavity 176 is sealed from adjacent cavities 176 by seals formed along the contact lines between the rotor 170 and the stator 150.

Lower flex shaft 180 of the positive displacement pump 140 has a has a first or upper end 180A, a second or lower end 180B opposite upper end 180A, and a central bore or passage 182 extending between ends 180A and 180B. The upper end 180A of lower flex shaft 180 is coupled to the lower end 170B of rotor 170 at a sealed, threaded connection 133, the central passage 182 of lower flex shaft 180 being in fluid communication with the central passage 172 of rotor 170. During operation of the positive displacement pump 140, rotor 170 may be rotated relative stator 150 about central axis 105 by drill string 21 (drill string 21 rotated at the surface by rotary system 24), rotor 170 being coupled to drill string 21 via mandrel 120 and flex shaft 130 of slipping joint 102. The rotation of rotor 170 within stator 150 creates a pressure differential across rotor 170, forcing fluid disposed in positive displacement pump 140 along a pumping or circulation flowpath (indicated by arrows 178 in FIG. 7) through the central passage 154 and radial ports 154A, 154B of stator 150, and the annulus 146 formed between outer housing 144 and stator 150.

Additionally, a flow restriction along circulation flowpath 178 results in torque applied to rotor 170 from drill string 21 being transferred to stator assembly 142, where the amount of torque transfer between rotor 170 and stator assembly 142 is proportionate to the degree of flow restriction along circulation flowpath 178. Actuator assembly 200 of torque control assembly 100 is configured to selectably control the degree of restriction to fluid flow along circulation flowpath 178, controlling in-turn the amount of torque transferred between the rotor 170 and stator assembly 142 of the positive displacement pump 140. As shown particularly in FIGS. 8-15, in this embodiment, actuator assembly 200, received in stator 150 axially below rotor 170, generally includes an annular hub 202, a mandrel 210, a valve housing or block 220, a plurality of circumferentially spaced spool valves 240, a pilot valve body 260, a rotary control or pilot valve 280, a connector body 310, a motor housing 330, and an electric motor or actuator 350.

In this embodiment, hub 202 of actuator assembly 200 has a first or upper end 202A, a second or lower end 202B opposite upper end 202A, and a generally cylindrical outer surface extending between ends 202A, 202B that receives an annular seal 203 in sealing engagement with the inner surface 155 of stator 150. The sealing engagement between seal 203 and the inner surface 155 of stator 150 forms an annular actuation chamber 215 extending between seal 203 and the lower end 150B of stator 150. Particularly, fluid flowing along circulation flowpath 178 in sealed chamber 114 may not directly enter lower radial port 154B of stator 150, and instead, must flow though actuator assembly 200 (as will be described further herein) to enter actuation chamber 215, where the fluid may then flow through lower radial port 154B, continuing along circulation flowpath 178 in annulus 146.

Hub 202 also includes a central bore or passage 205 through which lower flex shaft 180 extends. Hub 202 further includes a plurality of circumferentially spaced valve ports 206, a sensor port 207, and a pressure relief port 208 (shown in FIGS. 9 and 10). Each of ports 206, 207, and 208 extend axially between upper end 202A and lower end 202B of hub 202. In this embodiment, each of the valve ports 206 of hub 202 receive a screen 209 for filtering out materials entrained in the fluid flowing along circulation flowpath 178 and into actuator assembly 200. Mandrel 210 of actuator assembly 200 is generally cylindrical comprising a central bore or passage 211 through which lower flex shaft 180 extends, and a generally cylindrical outer surface 212 extending between opposing ends of mandrel 210. The outer surface 212 of mandrel 210 receives a first or upper annular seal 214A that sealingly engages an inner surface of hub 202, and a second or lower annular seal 214B that sealingly engages an inner surface of the motor housing 330.

Figure 11:
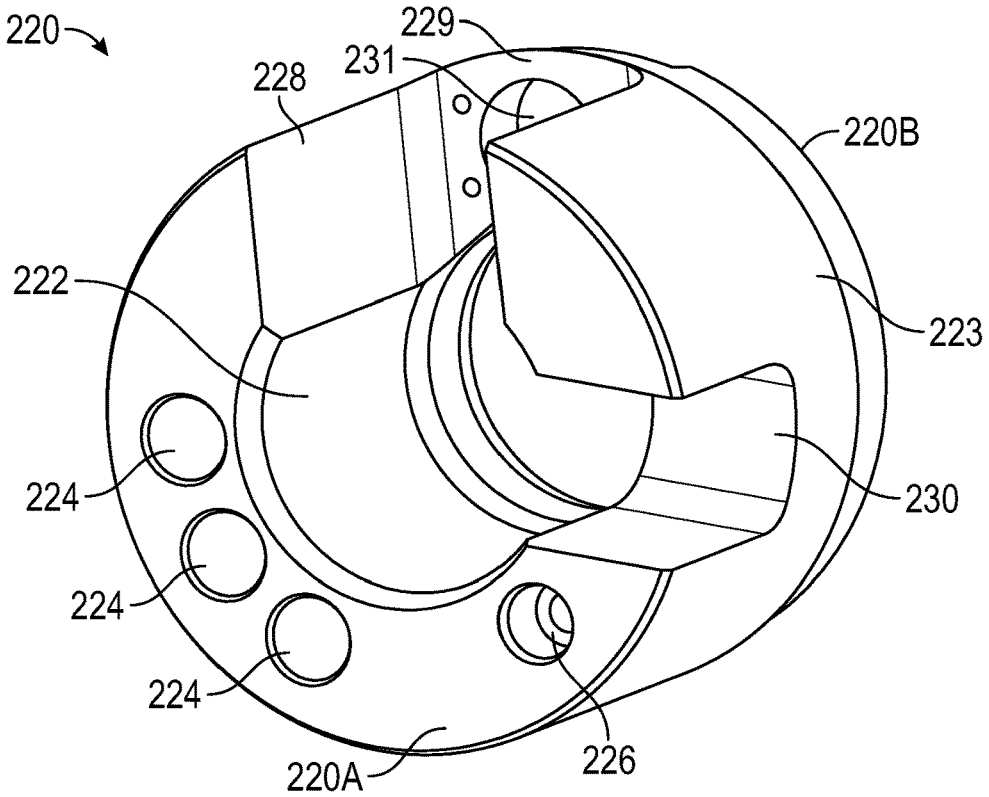
FIGS. 11 and 12 are perspective views of an embodiment of a valve block of the actuator assembly of FIG. 8 in accordance with principles disclosed herein.
Figure 12:
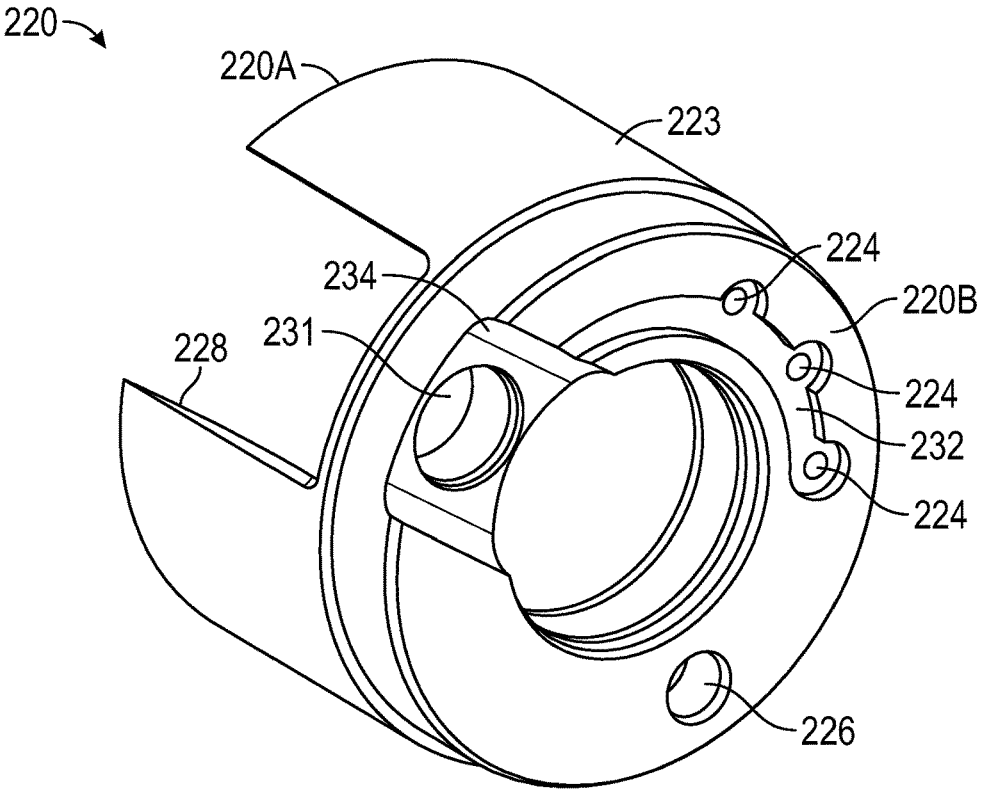

As shown particularly in FIGS. 11 and 12, the valve block 220 of actuator assembly 200 has a first or upper end 220A, a second or lower end 220B, a central bore or passage 222 extending between ends 220A and 220B, and a generally cylindrical outer surface 223 extending between ends 220A and 220B. Valve block 220 additionally includes a plurality of circumferentially spaced valve ports 224 and a sensor port 226, each of which extend between ends 220A and 220B of valve block 220. Valve block 220 further includes a first slot 228 extending axially into valve block 220 from upper end 220A, and a circumferentially spaced second slot 230 also extending into valve block 220 from upper end 220A. Valve body 260 of actuator assembly 200 is received in first slot 228. A passage 231 aligned with the first slot 228 extends axially through a shoulder 229 defining a terminal end of the first slot 228. In this embodiment, valve block 220 includes an arcuate groove 232 formed on the lower end 220B of valve block 220, the arcuate groove 232 intersecting each of the valve ports 224 and terminating at a third slot 234 that is circumferentially aligned with first slot 228 and extends axially into valve block 220 from the lower end 220B. Valve body 260 extends through the third slot 234 and passage 231 formed in valve block 220.

Figure 13:
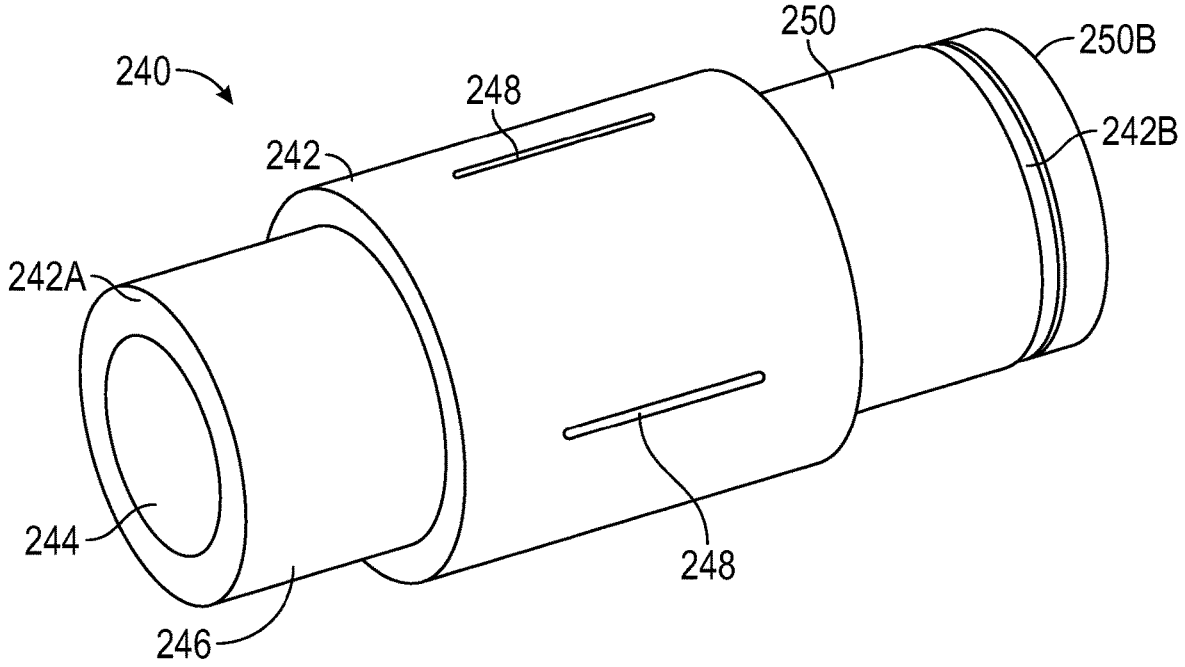
FIGS. 13 and 14 are perspective views of an embodiment of a spool valve of the actuator assembly of FIG. 8 in accordance with principles disclosed herein.
Figure 14:
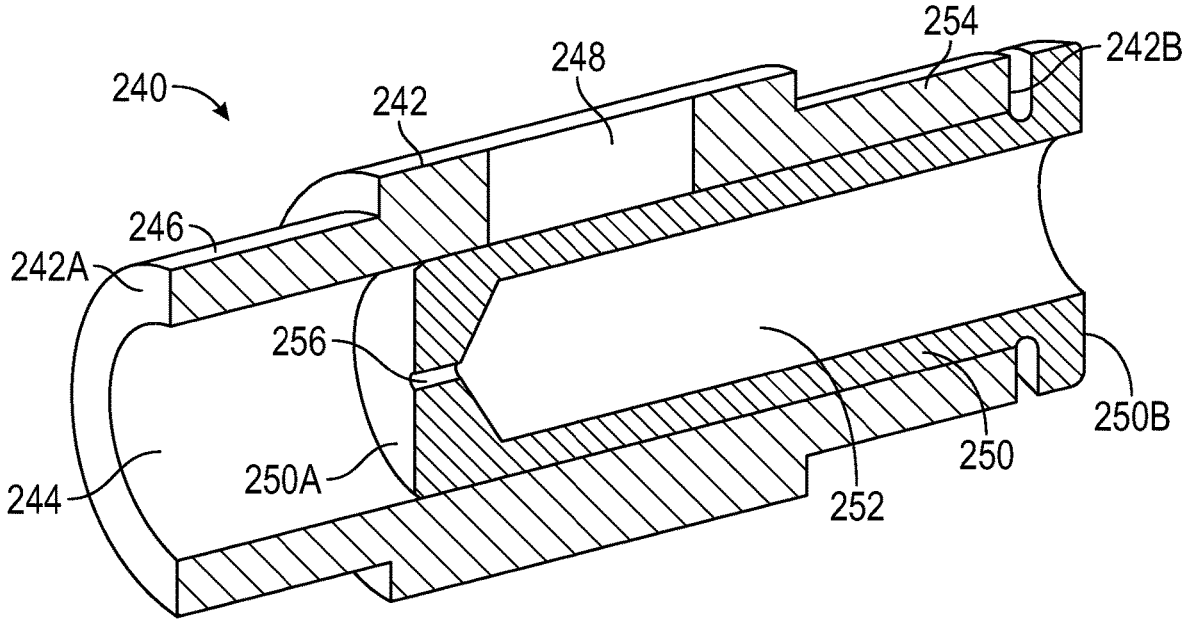

As shown particularly in FIGS. 13 and 14, each spool valve 240 of actuator assembly 200 includes an outer cylinder 242 and an inner piston 250 slidably received in the cylinder 242. Cylinder 242 includes a first or upper end 242A, a second or lower end 242B opposite upper end 242A, a central passage 244 extending between ends 242A, 242B, and a generally cylindrical outer surface 246 extending between ends 242A, 242B. Additionally, cylinder 242 includes a plurality of circumferentially spaced elongate slots or ports 248 each extending radially between outer surface 246 and central passage 244. Each port 248 of cylinder 242 includes a substantially rectangular cross-section having a length extending between ends 242A, 242B of cylinder 242 that is greater than an arcuate width (extending about a central axis of cylinder 242) of the port 248.

Piston 250 includes a first or upper end 250A slidably received in the central passage 244 of cylinder 242, a second or lower end 250B opposite upper end 250A and spaced from central passage 244, a central passage 252 extending between ends 250A, 250B, and a generally cylindrical outer surface 254 extending between ends 250A, 250B that is in sealing engagement with an inner surface of cylinder 242. The central passage 252 of piston 250 includes an orifice or flow restrictor 256 that provides a flow restriction for fluid flowing through central passage 244 of cylinder 242 and into central passage 252 of piston 250 via orifice 256. Piston 250 is configured to adjust and/or restrict fluid flow between central passage 244 of cylinder 242 and the ports 248. Particularly, fluid flow between central passage 244 and ports 248 is restricted when the outer surface 254 of piston 250 covers the entirety of ports 248, as shown in FIGS. 13 and 14. However, as will be described further herein, by displacing piston 250 axially relative cylinder 242, a portion or the entirety of ports 248 may be uncovered to permit fluid flow between central passage 244 and ports 248. Particularly, by displacing the lower end 250B of piston 250 axially away from the lower end 242B of cylinder 242, the fluid cross-sectional flow area provided by ports 248 may be increased as more of the longitudinal length of each port 248 is uncovered from piston 250, thereby reducing the restriction to fluid flow between central passage 244 and ports 248.

When actuator assembly 200 is assembled, the upper end 242A of cylinder 242 is received in one of the valve ports 206 of hub 202 with the outer surface 246 of cylinder 242 in sealing engagement with an inner surface of the valve port 206 in which the cylinder 242 is received. Additionally, the lower end 242B of cylinder 242 is received in one of the valve ports 224 of valve block 220 with the outer surface 246 of cylinder 242 in sealing engagement with an inner surface of the valve port 224 in which the cylinder 242 is received. The ports 248 of each cylinder 242 is positioned axially between the lower end 202B of hub 202 and the upper end 220A of valve block 220 in fluid communication with actuation chamber 215.

As described above, the axial position of the piston 250 of each spool valve 240 may be manipulated relative to its corresponding cylinder 242 to increase or reduce a restriction to fluid flow between the central passage 244 and ports 248 of the cylinder 242. In this manner, a flow restriction for fluid flowing between sealed chamber 114 and actuation chamber 214 via central passage 244 and ports 248 of each spool valve 240 may be increased or decreased. Moreover, fluid flow between sealed chamber 114 and actuation chamber 214 may be substantially eliminated by disposing each spool valve 240 in a fully closed position as shown in FIGS. 13 and 14. Thus, the axial position of the piston 250 of each spool valve 240 relative to its corresponding cylinder 242 may be adjusted to thereby adjust the restriction to fluid flowing along circulation flowpath 178. Thus, by increasing the portion of ports 248 of cylinder 242 covered by the piston 250 of each spool valve 240, the amount of torque transferred between rotor 170 and stator assembly 142 may be increased. By covering the entirety of each port 248 of the cylinder 242 with the corresponding piston 250, the substantial entirety of torque applied to rotor 170 by drill string 21 may be transferred to stator assembly 142. Alternatively, by increasing the portion of ports 248 of cylinder 242 covered by the piston 250 of each spool valve 240, the amount of torque transferred between rotor 170 and stator assembly 142 may be decreased. By exposing the entirety of each port 248 to the central passage 244 of the cylinder 242 (i.e., disposing the spool valve 240 in a fully open position), substantially zero torque applied to rotor 170 by drill string 21 may be transferred to stator assembly 142.

Figure 15:
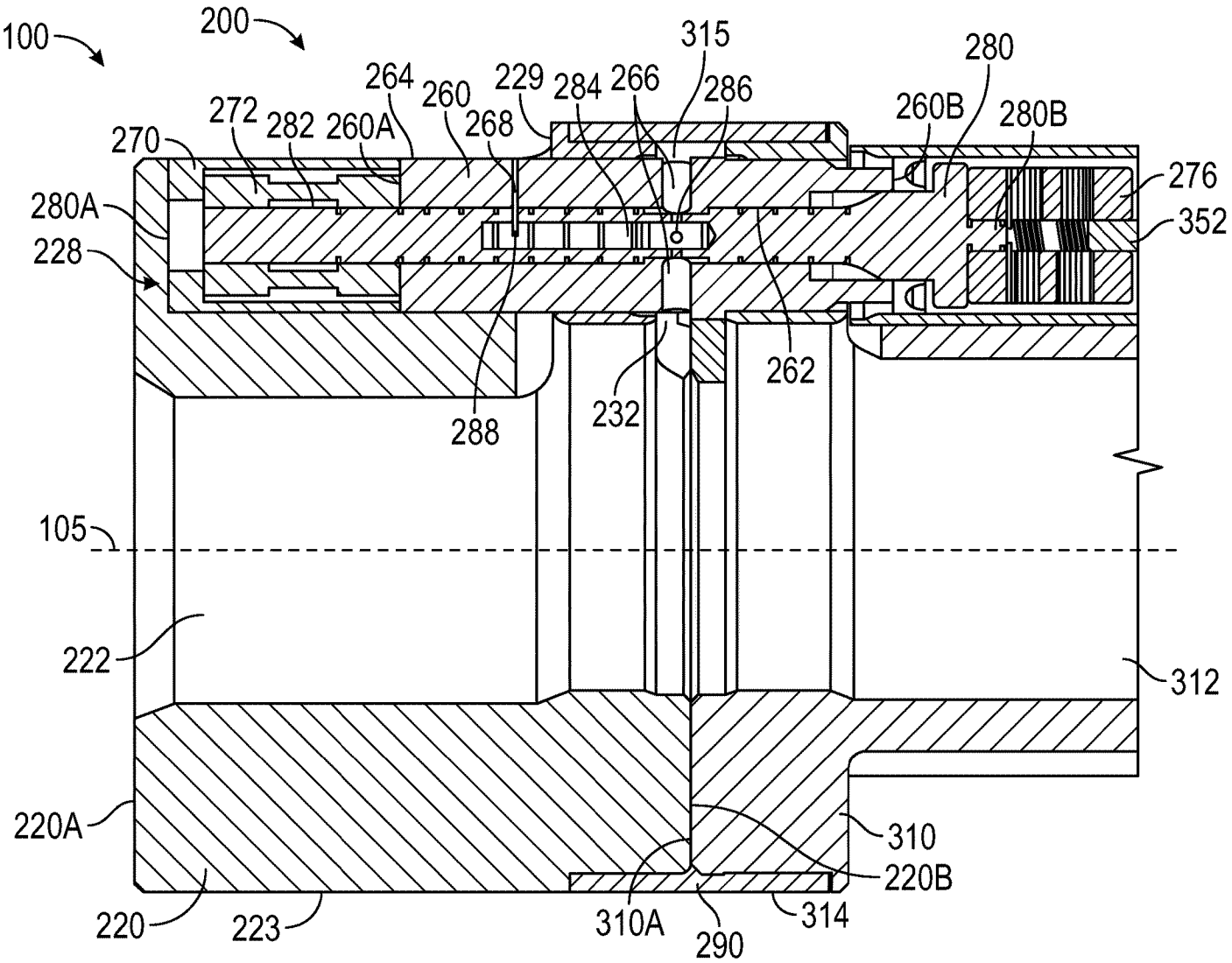
FIG. 15 is a zoomed-in, side cross-sectional view of the actuator assembly of FIG. 8.

As shown particularly in FIG. 15, the valve body 260 of actuator assembly 200 has a first or upper end 260A, a second or lower end 260B opposite upper end 260A, and a central passage 262 extending between ends 260A, 260B that receives rotary pilot valve 280, and an outer surface 264 extending between ends 260A, 260B. Valve body 260 is coupled to connector body 310 to secure or affix its axial position relative to valve block 220. In this embodiment, valve body 260 includes a plurality of circumferentially spaced inlet ports 266 each extending radially between central passage 262 and outer surface 264. Additionally, valve body 260 includes an arcuate outlet slot or port 268 also extending radially between central passage 262 and outer surface 264, where outlet port 268 is in fluid communication with actuation chamber 215. Particularly, outlet port 268 is axially spaced from inlet ports 266 and extends across a portion of the circumference of the outer surface 264 of valve body 260. In this embodiment, outlet port 268 extends approximately 180 degrees about a central axis of valve body 260; however, in other embodiments, the arcuate length of outlet port 268 may vary. As shown particularly in FIGS. 9 and 15, in this embodiment, actuator assembly 200 comprises a retainer housing 270 that is disposed directly adjacent the upper end 260A of valve body 260 and is coupled to the shoulder 229 of valve block 220.

As shown particularly in FIG. 15, the rotary pilot valve 280 of actuator assembly 200 is rotatably disposed in valve body 260 and has a first or upper end 280A, a second or lower end 280B opposite upper end 280A, and a generally cylindrical outer surface 282 extending between ends 280A and 280B. Additionally, rotary pilot valve 280 includes a central passage 284 extending partially between ends 280A and 280B. A plurality of circumferentially spaced inlet ports 286 are positioned at a lower end of central passage 284, each inlet port 286 extending radially between central passage 284 and the outer surface 282 of rotary pilot valve 280. Additionally, rotary pilot valve 280 includes an arcuate outlet slot or port 288 also extending radially between central passage 284 and outer surface 282. Particularly, outlet port 288 is positioned at an upper end of central passage 284 and extends across a portion of the circumference of the outer surface 282 of rotary pilot valve 280. In this embodiment, outlet port 288 extends approximately 180 degrees about a central axis of rotary pilot valve 280; however, in other embodiments, the arcuate length of outlet port 288 may vary. In this embodiment, the upper end 280A of rotary pilot valve 280 is coupled to a retainer 272 received in retainer housing 270. Retainer 272 is configured to act as an adjustable spacer to provide for the axial alignment of inlet ports 286 of rotary pilot valve 280 with the inlet ports 266 of valve body 260, and for the axial alignment of outlet port 288 of rotary pilot valve 280 with the outlet port 268 of valve body 260. Additionally, in this embodiment, retainer 272 comprises a thrust bearing assisting the relative rotation between rotary pilot valve 280 and valve body 260.

The outer surface 282 of rotary pilot valve 280 is in sealing engagement with the inner surface 262 of valve body 260, thereby restricting fluid flow between inlet ports 266 of valve body 260 and outlet port 268 via the annular interface formed between the outer surface 282 of rotary pilot valve 280 and the inner surface 262 of valve body 260. Fluid flow is permitted between inlet ports 268 of valve body 260 and the central passage 284 of rotary pilot valve 280 via inlet ports 286 of rotary pilot valve 280. Rotary pilot valve 280 may be rotated in valve body 260 between a fully open position (shown in FIG. 15) where outlet port 288 is angularly or circumferentially aligned with outlet port 268 of valve body 260, and a fully closed position where outlet port 288 is entirely angularly or circumferentially spaced from outlet port 268 of valve body 260.

Fluid flow between inlet ports 266 and outlet port 268 of valve body 260 is restricted when rotary pilot valve 280 is in the fully closed position. However, fluid flow between inlet ports 266 and outlet port 268 of valve body 260 when rotary pilot valve 280 is in a partially or fully open position via angular overlap between the outlet port 288 of rotary pilot valve 280 and outlet port 268 of valve body 260. Additionally, as rotary pilot valve 280 is rotated from the fully closed position to the fully open position, the degree of circumferential overlap between outlet port 288 of rotary pilot valve 280 and the outlet port 268 of valve body 260 increases, thereby increasing the cross-sectional flow area between central passage 284 of rotary pilot valve 280 and the outlet port 268 of valve body 260. Further, the restriction to fluid flow between inlet ports 266 and outlet port 268 of valve body 260 decreases as the cross-sectional flow area between central passage 284 and outlet ports 268 increases. Thus, the restriction to fluid flow between inlet ports 266 and outlet port 268 of valve body 260 continually decreases as rotary pilot valve 280 is rotated from the fully closed position to the fully open position.

As shown particularly in FIGS. 8 and 15, connector body 310 of actuator assembly 200 has a first or upper end 310A, a second end 310B opposite upper end 310A, a central passage 312 extending between ends 310A and 310B, and a generally cylindrical outer surface 314 extending between ends 310A and 310B. Central passage 312 of connector body 310 is in fluid communication with the central passage 222 of valve block 220, and the upper end 310A of connector body 310 is in sealing engagement with the lower end 220B of valve block 220. In this embodiment, an annular shroud 290 is disposed about the lower end 220B of valve block 220 and the upper end 310A of connector body 310, shroud 290 having an annular inner surface in sealing engagement with the outer surface 223 of valve block 220 and the outer surface 314 of connector body 310. The sealing engagement between shroud 290, valve bock 220 and connector body 310 forms an arcuate passage 315 that is partially defined by the arcuate groove 232 of valve block 220, where arcuate passage 315 is sealed from actuation chamber 215. Thus, fluid flowing into arcuate passage 315 from the valve ports 224 of valve block 220 may not flow directly into actuation chamber 215, and instead is directed into the central passage 284 of rotary pilot valve 280 via the inlet ports 266 of valve body 260, which are in fluid communication with arcuate passage 315, and the inlet ports 286 of rotary pilot valve 280.

Figure 9:
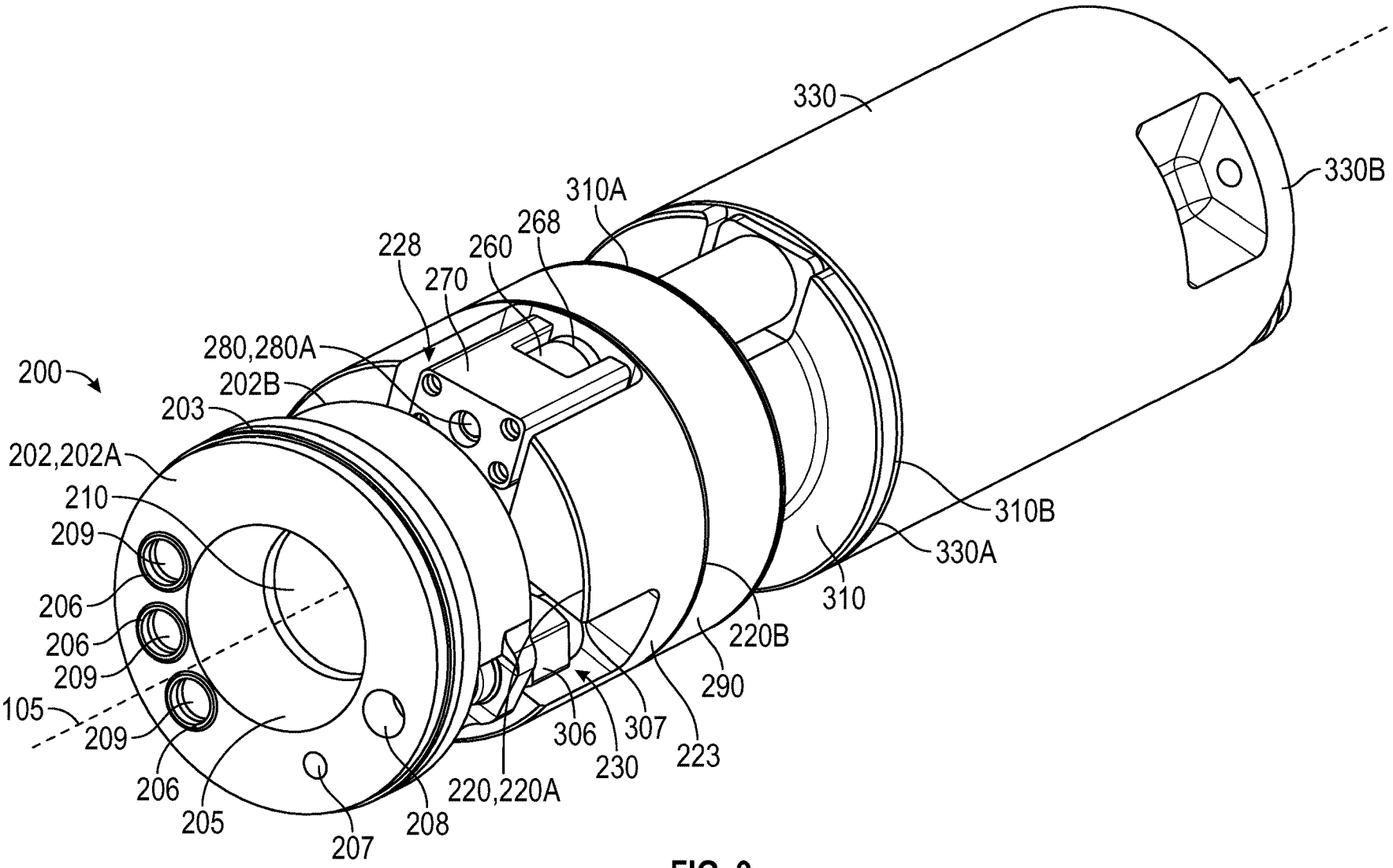
FIGS. 9 and 10 are perspective views of the actuator assembly of FIG. 8.
Figure 10:
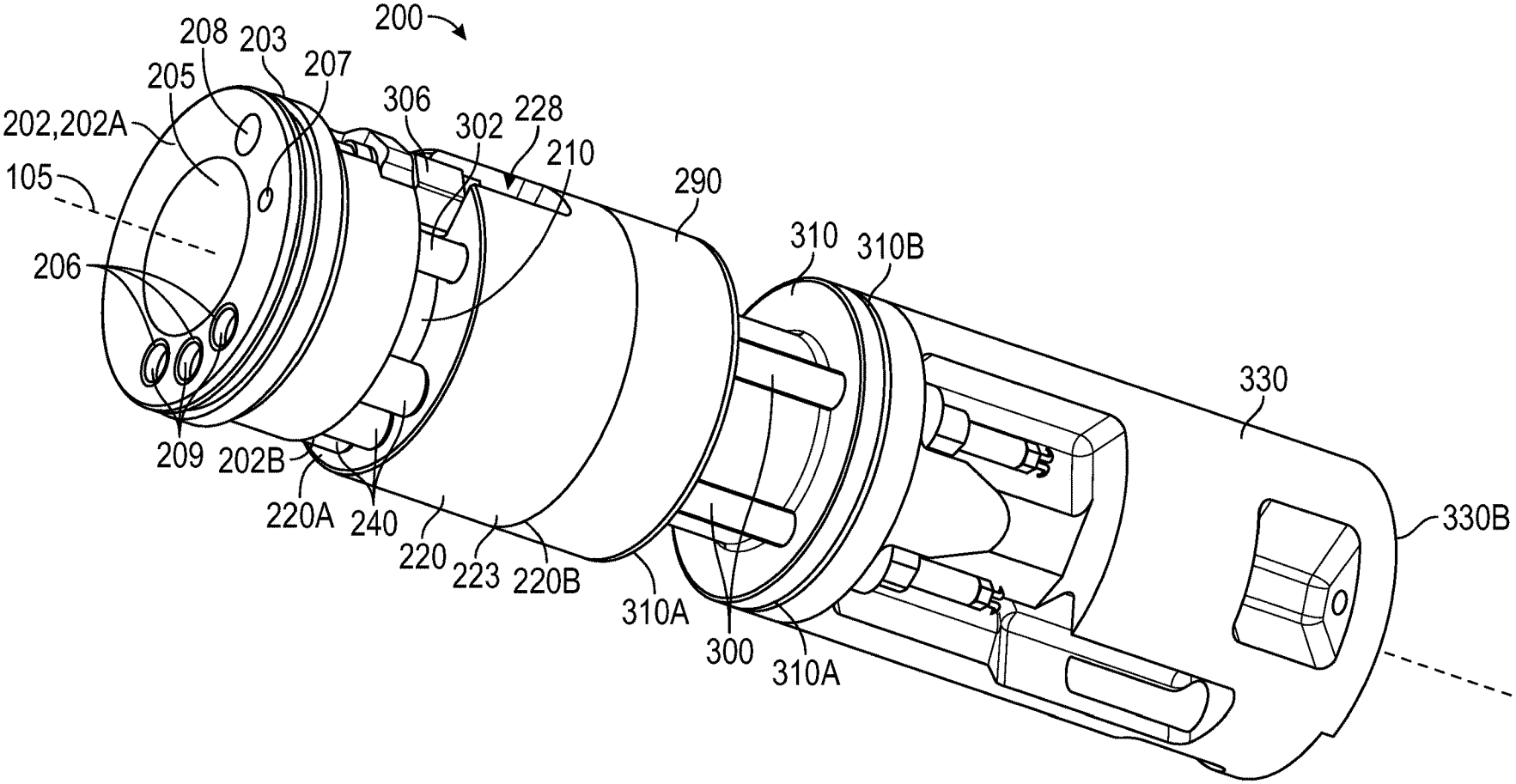

As shown particularly in FIGS. 8-10, motor housing 330 has a first or upper end 330A disposed directly adjacent the lower end 3106 of connector body 310, a second or lower end 330B opposite upper end 330A, and a central passage 332 extending between ends 330A and 330B. A lower end of mandrel 210 extends into central passage 332 of motor housing 330 with lower annular seal 214B of mandrel 210 in sealing engagement with an inner surface of motor housing 330. Additionally, an outer surface of motor housing 330 receives an annular seal 334 positioned at lower end 330B. In this embodiment, motor housing 330 includes an offset passage 336 that extends axially between ends 330A and 330B. Offset passage 336 is radially offset from the central axis 105 of torque control assembly 100 and receives actuator 350. Actuator 350 comprises an output shaft 352 that extends from the upper end 330A of motor housing 330. As will be described further herein, actuator 350 is configured to provide a torque to output shaft 352 in response to receiving an electrical input or power from electronics sub 400. In this embodiment, actuator 350 comprises a brushless DC electric motor; however, in other embodiments, actuator 350 may comprise other actuators known in the art configured for providing an output torque. In this embodiment, a coupler 276 is coupled between the lower end 280B of rotary pilot valve 280 and output shaft 352, thereby rotatably coupling the output shaft 352 of actuator 350 with rotary pilot valve 280.

As shown particularly in FIGS. 8-10, in this embodiment, actuator assembly 200 also includes a plurality of circumferentially spaced pressure sensor assemblies 300 coupled to connector body 310 and motor housing 330, each of which are configured to measure the pressure of fluid flowing along circulation flowpath 178 as the fluid enters actuator assembly 200 via the ports 206 and 207 of hub 202. Particularly, actuator assembly 200 includes a sensor conduit 302 that extends between the sensor port 207 of hub 202 and the sensor port 226 of valve block 220, where each of pressure sensor assemblies 300 are in fluid communication with sensor port 226. Pressure sensor assemblies 300 are in signal communication with components of electronics sub 400, allowing for the recording and/or transmission of measurements made by pressure sensor assemblies of the pressure of fluid flowing into actuator assembly 200 via ports 206 and 207 of hub 202. In this embodiment, actuator assembly 200 further includes a pressure relief valve 306 coupled to hub 202. Particularly, pressure relief valve 306 (shown in FIG. 9) is in fluid communication with the pressure relief port 208 of hub 202 which is in fluid communication with fluid disposed in sealed chamber 114 and flowing along the circulation flowpath 178 into actuator assembly 200. Pressure relief valve 306 includes a relief port 307 positioned in the second slot 230 of valve block 220 and in fluid communication with actuation chamber 215. Pressure relief valve 306 is configured to relieve fluid pressure in sealed chamber 114 directly to actuation chamber 215 in response to fluid pressure downstream of rotor 170 reaching a predetermined threshold or maximum pressure, beyond which the performance of torque control assembly 100 may be jeopardized. Thus, opening of the pressure relief valve 306, fluid exiting positive displacement pump 140 may enter actuation chamber 215 via the relief port 307 of pressure relief valve 306, thereby allowing fluid to enter actuation chamber 215 while bypassing spool valves 240.

Figure 16:
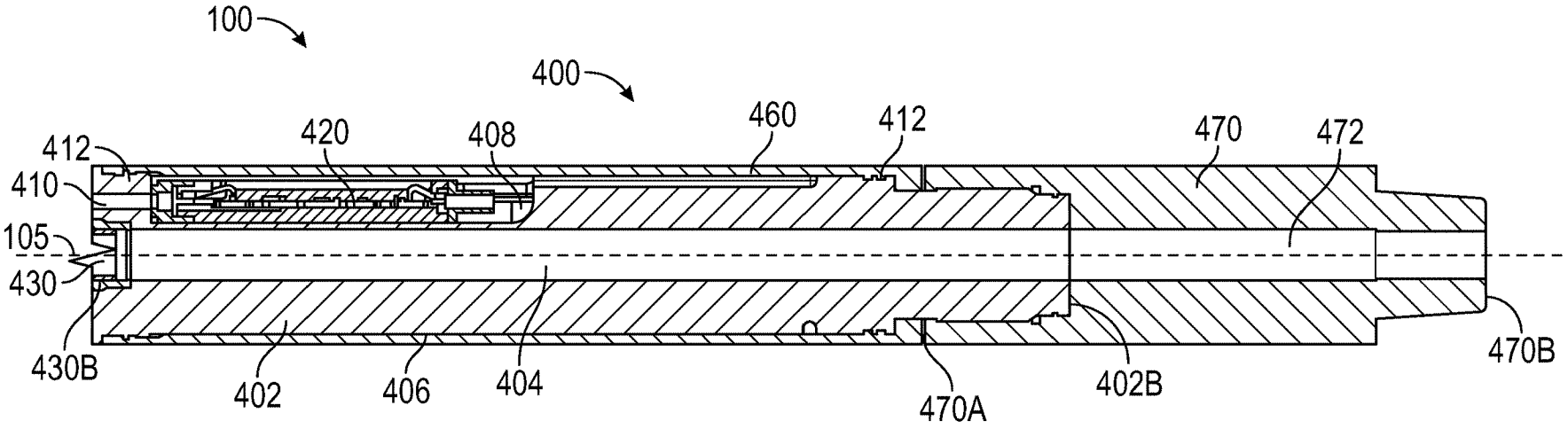
FIG. 16 is a side cross-sectional view of an embodiment of an electronics sub of the torque control assembly of FIG. 4 in accordance with principles disclosed herein.
Figure 17:
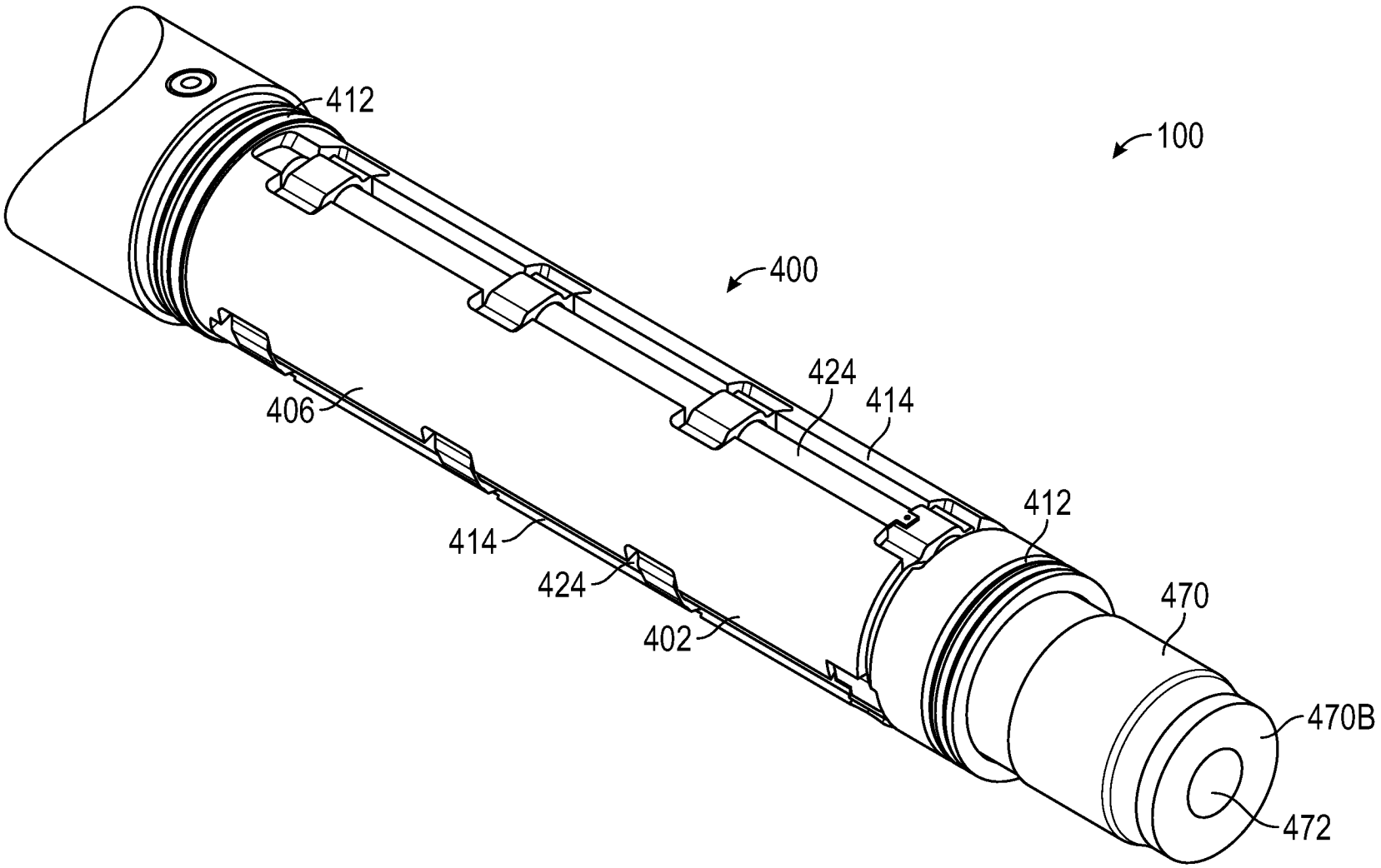
FIG. 17 is a perspective view of the electronics sub of FIG. 16.

As shown particularly in FIGS. 8, 16, and 17, in this embodiment, the electronics sub 400 of torque control assembly 100 generally includes a housing 402, a controller or electronics package 420, a extension mandrel 430, an outer sleeve 460, and a lower sub 470. Housing 402 of electronics sub 400 has a first or upper end 402A, a second or lower end 402B, a central passage 404 extending between ends 402A and 402B, and a generally cylindrical outer surface 406 extending between ends 402A and 402B. The upper end 402A of housing 402 is coupled to the lower end 150B of stator 150 at a sealed, thread connection 112. In this embodiment, housing 402 includes an electronics receptacle 408 formed in outer surface 406 which receives the electronics package 420. In this embodiment, electronics package 420 includes a processor and a memory in signal communication with the processor.

A cable passage 410 extends from electronics receptacle 408 to the upper end 402A of housing 402. An electrical connector 422 for electrically connecting electronics package 420 with actuator 350 is received in passage 410 at the upper end 402A of housing 402. In this embodiment, the outer surface 406 of housing 402 receives a pair of annular seals 412, where electronics receptacle 408 is disposed axially between the pair of annular seals 412. Sleeve 460 of electronic sub 400 is positioned about housing 402, with an inner surface of sleeve 460 in sealing engagement with annular seals 412 of housing 402 to restrict fluid communication between electronics receptacle 408 of housing 402 and the surrounding environment.

As shown particularly in FIG. 17 (sleeve 460 being hidden in FIG. 17 for clarity), housing 402 also includes a plurality of circumferentially spaced sensor receptacles 414, each sensor receptacle 414 receiving a sensor package 424 in signal communication with electronics package 420. Sensor packages 424 are configured to provide input signals to electronics package 420 corresponding to measurements of conditions in the environment surrounding torque control assembly and/or parameters of the torque control assembly 100 (e.g., inclination, rotational speed of housing 402, etc.). In some embodiments, each sensor package 424 comprises one or more of a magnetometer, an accelerometer, and/or a gyro tool or sensor.

Extension mandrel 430 of electronics sub 400 has a first or upper end 430A, a second or lower end 430B opposite upper end 430A, and a central passage 432 extending between upper end 430A and lower end 430B. The upper end of extension mandrel 430 is coupled to the lower end 1806 of lower flex shaft 180 at a sealed, threaded connection 133. The central passage 432 of extension mandrel 430 is in fluid communication with the central passage 182 of lower flex shaft 180. Electronic sub 400 additionally includes an annular support assembly 440 disposed radially between extension mandrel 430 and housing 402. Support assembly 440 is generally configured to support extension mandrel 430 while sealing central passage 432 of extension mandrel 430 from the sealed chamber 114. In this embodiment, support assembly 440 includes a plurality of outer annular seals 442 that sealingly engage an inner surface of housing 402 and a plurality of inner annular seals 444 that sealingly engage an outer surface of extension mandrel 430. In this arrangement, drilling fluid flowing through lower flex shaft 180 and extension mandrel 430 may not enter sealed chamber 114 and the actuator assembly 200. Additionally, a radial bearing 446 is positioned radially between the outer surface of extension mandrel 430 and an inner surface of support assembly 440 to permit relative rotation between extension mandrel 430 and support assembly 440. Lower sub 470 of electronics sub 400 has a first or upper end 470A coupled to the lower end 402B of housing 402 at a sealed, threaded connection 112, a second or lower end 470B opposite upper end 470A that is coupled to power section 60 of drilling assembly 50, and a central passage 472 extending between ends 470A, 470B that is in fluid communication with the central passage 404 of housing 402.

Electronics package 420 of electronics sub 400 is configured to control the actuation of actuator 350 and thereby the amount of torque transmitted between rotor 170 and stator assembly 142 of the positive displacement pump 140. Particularly, in response to receiving a control signal transmitted from electronics package 420, actuator 350 is configured to rotate the rotary pilot valve 280 relative to valve body 260 and thereby adjust the restriction to fluid flow between inlet ports 266 and outlet port 268 of valve body 260. By increasing the restriction to fluid flow between inlet ports 266 and outlet port 268 of valve body 260, a pressure differential between inlet ports 266 and outlet port 268 of valve body 260 is increased. The increased pressure differential results in an increase in fluid pressure acting against the lower end 250B of the piston 250 of each spool valve 240, thereby forcing piston 250 towards the first end 242A of the corresponding cylinder 242 and increasing the restriction to fluid flow between central passage 244 and ports 248 of each spool valve 240. Thus, by adjusting the rotational position of rotary spool valve 240 via actuator 350, electronics package 420 is configured to adjust the restriction to fluid flowing along circulation flowpath 178, and thereby the amount of torque transmitted between rotor 170 and stator assembly 142 of the positive displacement pump 140. Although in this embodiment rotary pilot valve 280 is utilized for creating an adjustable fluid flow restriction, in other embodiments, an adjustable fluid flow restriction may be created through the use of a force motor pilot valve, a direct acting (i.e., does not include or work in conjunction with a spool valve) rotary valve, and/or a direct acting force motor valve.

In some embodiments, electronics package 420 may control the actuation of actuator 350 in response to receiving control signals from the surface via telemetry system 30. In other embodiments, the memory of electronics package 420 may store an algorithm for controlling the actuation of actuator 350, and in-turn the amount of torque transmitted between rotor 170 and stator assembly 142 of the positive displacement pump 140. In some embodiments, the algorithm stored on the memory of electronics package 420 may be configured to provide damping against stick-slip oscillations of drill string 21 and/or holding a constant angular orientation of drilling assembly 50 in borehole 16. As will be described further herein, torque control assembly 100 may operate in one of several modes as controlled by electronics package 420.

In some embodiments, drilling assembly 50 and torque control assembly 100 may operate: in a first or "set tool face" mode that is configured to adjust the angular orientation of drilling assembly 50 by rotating drill string 21 at a first rotational rate; in a second or "hold tool face" mode configured to hold the angular orientation of drilling assembly 50 set during the first mode by rotating drill string 21 at a second rotational rate that is greater than the first rotational rate; and in a third or "drilling ahead" or "straight through" mode configured to restrict relative rotation between the rotor 170 and the stator assembly 142 of torque control assembly 100 by rotating drill string 21 at a third rotational rate that is greater than the first rotational rate and the second rotational rate. In some embodiments, when drilling assembly 50 and torque control assembly 100 are operated in the third mode fluid flow along circulation flowpath 178 is ceased or reduced to substantially zero whereby rotor 170 is rotationally locked to stator assembly 142. In this embodiment, drilling assembly 50 and torque control assembly 100 may operate in the first by rotating drill string 21 at a downhole speed (i.e., the rotational rate of the end of drill string 21 connected to drilling assembly 50) of between approximately 0-10 revolutions per minute (RPM), in the second mode by rotating drill string 21 at a downhole speed of drill string 21 between approximately 10-30 RPM, and the third mode by rotating drill string 21 at a downhole speed that is greater than approximately 30 RPM.

Referring to FIGS. 1, 3, and 18-32, an embodiment of the driveshaft assembly 500 and bearing assembly 600 of the drilling assembly 50 of FIG. 1 are shown in FIGS. 18-32. In the embodiment of FIGS. 18-32, driveshaft assembly 500 is coupled to bearing assembly 600 via a bend adjustment assembly 700 of drilling assembly 50 that selectably provides an adjustable bend 701 (shown in FIG. 1) along drilling assembly 50. Due to bend 701, a deflection angle θ is formed between a central or longitudinal axis 95 (shown in FIG. 1) of drill bit 90 and the longitudinal axis 25 of drill string 21. To drill a straight section of borehole 16, drill string 21 is rotated from rig 20 with a rotary table or top drive to rotate drilling assembly 50 and drill bit 90 coupled thereto. Drill string 21 and drilling assembly 50 rotate about the longitudinal axis of drill string 21, and thus, drill bit 90 is also forced to rotate about the longitudinal axis of drill string 21. With bit 90 disposed at deflection angle θ, the lower end of drill bit 90 distal drilling assembly 50 seeks to move in an arc about longitudinal axis 25 of drill string 21 as it rotates, but is restricted by the sidewall 19 of borehole 16, thereby imposing bending moments and associated stress on drilling assembly 50 and mud motor 55. In general, the magnitudes of such bending moments and associated stresses are directly related to the bit-to-bend distance D—the greater the bit-to-bend distance D, the greater the bending moments and stresses experienced by drilling assembly 50 and mud motor 55.

In general, driveshaft assembly 500 functions to transfer torque from the eccentrically-rotating rotor 70 of power section 60 to a concentrically-rotating bearing mandrel 620 of bearing assembly 600 and drill bit 90. As best shown in FIG. 3, rotor 70 rotates about rotor axis 78 in the direction of arrow 74, and rotor axis 78 rotates about stator axis 88 in the direction of arrow 75. However, drill bit 90 and bearing mandrel 620 are coaxially aligned and rotate about a common axis that is offset and/or oriented at an acute angle relative to rotor axis 78. Thus, driveshaft assembly 500 converts the eccentric rotation of rotor 70 to the concentric rotation of bearing mandrel 620 and drill bit 90, which are radially offset and/or angularly skewed relative to rotor axis 78.

In this embodiment, driveshaft assembly 500 includes an outer or driveshaft housing 510 and a one-piece (i.e., unitary) driveshaft 520 rotatably disposed within housing 510. Housing 510 has a linear central or longitudinal axis 515, a first or upper end 510A, a second or lower end 510B coupled to an outer or bearing housing 610 of bearing assembly 600 via bend adjustment assembly 700, and a central bore or passage 512 extending between ends 510A and 510B. Particularly, an externally threaded connector or pin end of driveshaft housing 510 located at upper end 510A threadably engages a mating internally threaded connector or box end disposed at the lower end of stator housing 65, and an internally threaded connector or box end of driveshaft housing 510 located at lower end 510B threadably engages a mating externally threaded connector of bend adjustment assembly 700. Additionally, driveshaft housing includes ports 514 (shown in FIG. 21) that extend radially between the inner and outer surfaces of driveshaft housing 510.

As best shown in FIG. 1, in this embodiment, driveshaft housing 510 is coaxially aligned with stator housing 65. As will be discussed further herein, bend adjustment assembly 700 is configured to actuate between an unbent position 703 (shown in FIG. 18), a first bent position 705 (shown schematically in FIG. 1) providing a first deflection angle $\theta_1$ between the longitudinal axis 95 of drill bit 90 and the longitudinal axis 25 of drill string 21, and a second bent position providing a second deflection angle $\theta_2$ between the longitudinal axis 95 of drill bit 90 and the longitudinal axis 25 of drill string 21 that is greater than the first deflection angle $\theta_1$. The unbent position 703 may also be referred to a first position of bend adjustment assembly 700, first bent position 705 as the second position of bend adjustment assembly 700, and the second bent position as the third position of bend adjustment assembly 700.

In this embodiment, when bend adjustment assembly 700 is in the unbent position 703, driveshaft housing 510 is not disposed at an angle relative to bearing assembly 600 and drill bit 90. However, when bend adjustment assembly is disposed in the first bent position 705, bend 701 is formed between driveshaft assembly 500 and bearing assembly 600, orienting driveshaft housing 510 at non-zero deflection angle $\theta_1$ relative to bearing assembly 600 and drill bit 90. Additionally, as will be discussed further herein, bend adjustment assembly 700 is configured to actuate between the unbent position 704, first bent position 705, and the second bent position in-situ with drilling assembly 50 disposed in borehole 16. While in this embodiment driveshaft housing 510 is not disposed at an angle relative to bearing assembly 600 and drill bit 90 when bend adjustment assembly 700 is in the unbent position 703, in other embodiments, bend adjustment assembly 700 may include a bent housing and comprise a "fixed bend" such that driveshaft housing 510 is disposed at an angle relative to bearing assembly 600 and drill bit 90 when bend adjustment assembly 700 is in the first position 703.

Driveshaft 520 of driveshaft assembly 500 has a linear central or longitudinal axis, a first or upper end 520A, and a second or lower end 520B opposite end 520A. Upper end 520A is pivotally coupled to the lower end of rotor 70 with a driveshaft adapter 530 and a first or upper universal joint 540A, and lower end 520B is pivotally coupled to an upper end 620A of bearing mandrel 620 with a second or lower universal joint 540B. In this embodiment, upper end 520A of driveshaft 520 and upper universal joint 540A are disposed within driveshaft adapter 530, whereas lower end 520B of driveshaft 520 comprises an axially extending counterbore or receptacle that receives upper end 620A of bearing mandrel 620 and lower universal joint 540B. In this embodiment, driveshaft 520 includes a radially outwards extending shoulder 522 located proximal lower end 520B.

In this embodiment, driveshaft adapter 530 extends along a central or longitudinal axis 535 between a first or upper end coupled to rotor 70, and a second or lower end coupled to the upper end 520A of driveshaft 520. In this embodiment, the upper end of driveshaft adapter 530 comprises an externally threaded male pin or pin end that threadably engages a mating female box or box end at the lower end of rotor 70. A receptacle or counterbore extends axially (relative to axis 535) from the lower end of adapter 530. The upper end 520A of driveshaft 520 is disposed within the counterbore of driveshaft adapter 530 and pivotally couples to adapter 530 via the upper universal joint 540A disposed within the counterbore of driveshaft adapter 530.

Universal joints 540A and 540B allow ends 520A and 520B of driveshaft 520 to pivot relative to adapter 530 and bearing mandrel 620, respectively, while transmitting rotational torque between rotor 70 and bearing mandrel 620.

Driveshaft adapter 530 is coaxially aligned with rotor 70. Since rotor axis 78 is radially offset and/or oriented at an acute angle relative to the central axis of bearing mandrel 620, the central axis of driveshaft 520 is skewed or oriented at an acute angle relative to axis 515 of housing 510, axis 78 of rotor 70, and a central or longitudinal axis 625 of bearing mandrel 620. However, universal joints 540A and 540B accommodate for the angularly skewed driveshaft 520, while simultaneously permitting rotation of the driveshaft 520 within driveshaft housing 510.

In general, each universal joint (e.g., each universal joint 540A and 540B) may comprise any joint or coupling that allows two parts that are coupled together and not coaxially aligned with each other (e.g., driveshaft 520 and adapter 530 oriented at an acute angle relative to each other) limited freedom of movement in any direction while transmitting rotary motion and torque including, without limitation, universal joints (Cardan joints, Hardy-Spicer joints, Hooke joints, etc.), constant velocity joints, or any other custom designed joint. In other embodiments, driveshaft assembly 500 may include a flexible shaft comprising a flexible material (e.g., Titanium, etc.) that is directly coupled (e.g., threadably coupled) to rotor 70 of power section 60 in lieu of driveshaft 520, where physical deflection of the flexible shaft (the flexible shaft may have a greater length relative driveshaft 520) accommodates axial misalignment between driveshaft assembly 500 and bearing assembly 600 while allowing for the transfer of torque therebetween.

As previously described, adapter 530 couples driveshaft 520 to the lower end of rotor 70. During drilling operations, high pressure drilling fluid or mud is pumped under pressure down drill string 21 and through cavities 89 between rotor 70 and stator 80, causing rotor 70 to rotate relative to stator 80. Rotation of rotor 70 drives the rotation of driveshaft adapter 530, driveshaft 520, bearing assembly mandrel 620, and drill bit 90. The drilling fluid flowing down drill string 21 through power section 60 also flows through driveshaft assembly 500 and bearing assembly 600 to drill bit 90, where the drilling fluid flows through nozzles in the face of bit 90 into annulus 18. Within driveshaft assembly 500 and the upper portion of bearing assembly 600, the drilling fluid flows through an annulus 516 formed between driveshaft housing 510 and driveshaft 520.

Figure 18:
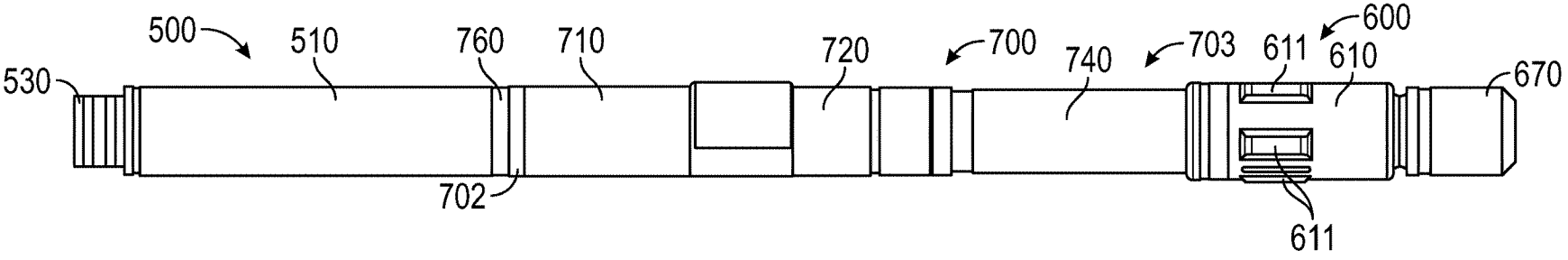
FIG. 18 is a side view of an embodiment of a mud motor of FIG. 1 disposed in a first position, FIG. 18 illustrating a driveshaft assembly, a bearing assembly, and a bend adjustment assembly of the mud motor of FIG. 1 in accordance with principles disclosed herein.
Figure 19:
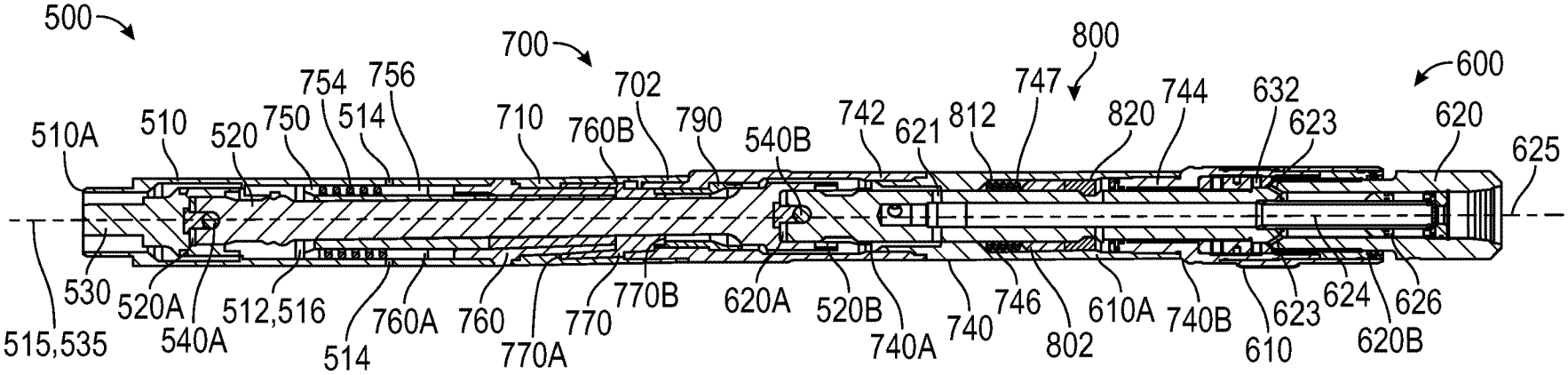
FIG. 19 is a side cross-sectional view of the mud motor of FIG. 18 disposed in the first position.
Figure 20:
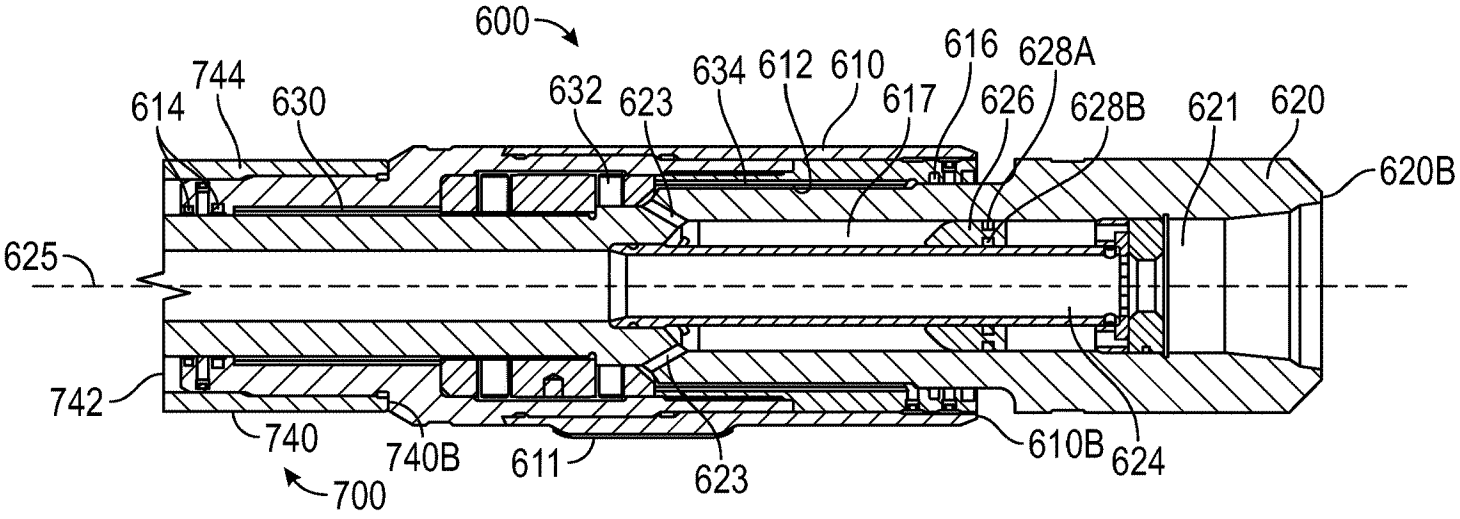
FIG. 20 is a zoomed-in, side cross-sectional view of the bearing assembly of FIG. 18.

As shown particularly in FIGS. 18-20, bearing assembly 600 includes bearing housing 610 and one-piece (i.e., unitary) bearing mandrel 620 rotatably disposed within housing 610. Bearing housing 610 has a linear central or longitudinal axis disposed coaxial with central axis 625 of mandrel 620, a first or upper end 610A coupled to lower end 510B of driveshaft housing 510 via bend adjustment assembly 700, a second or lower end 610B, and a central through bore or passage extending axially between ends 610A and 610B. Particularly, the upper end 610A comprises an externally threaded connector or pin end coupled with bend adjustment assembly 700. Bearing housing 610 is coaxially aligned with bit 90, however, due to bend 701 between driveshaft assembly 500 and bearing assembly 600, bearing housing 610 is oriented at deflection angle θ relative to driveshaft housing 510. Bearing housing 610 includes a plurality of circumferentially spaced stabilizers 611 extending radially outwards therefrom, where stabilizers 611 are generally configured to stabilize or centralize the position of bearing housing 610 in borehole 16

In this embodiment, bearing mandrel 620 of bearing assembly 600 has a first or upper end 620A, a second or lower end 620B, and a central through passage 621 extending axially from lower end 620B and terminating axially below upper end 620A. The upper end 620A of bearing mandrel 620 is directly coupled to the lower end 520B of driveshaft 520 via lower universal joint 540B. In particular, upper end 620A is disposed within a receptacle formed in the lower end 520B of driveshaft 520 and pivotally coupled thereto with lower universal joint 540B. Additionally, the lower end 620B of mandrel 620 is coupled to drill bit 90.

In this embodiment, bearing mandrel 620 includes a plurality of drilling fluid ports 622 extending radially from passage 621 to the outer surface of mandrel 620, and a plurality of lubrication ports 623 also extending radially to the outer surface of mandrel 620, where drilling fluid ports 622 are disposed proximal an upper end of passage 621 and lubrication ports 623 are axially spaced from drilling fluid ports 622. In this arrangement, lubrication ports 623 are separated or sealed from passage 621 of bearing mandrel 620 and the drilling fluid flowing through passage 621. Drilling fluid ports 622 provide fluid communication between annulus 516 and passage 621. During drilling operations, mandrel 620 is rotated about axis 625 relative to housing 610. In particular, high pressure drilling fluid is pumped through power section 60 to drive the rotation of rotor 70, which in turn drives the rotation of driveshaft 520, mandrel 620, and drill bit 90. The drilling mud flowing through power section 60 flows through annulus 516, drilling fluid ports 622 and passage 621 of mandrel 620 in route to drill bit 90.

In this embodiment, the upper end 520A of driveshaft 520 is coupled to rotor 70 with a driveshaft adapter 530 and upper universal joint 540A, and the lower end 520B of driveshaft 520 is coupled to the upper end 620A of bearing mandrel 620 with lower universal joint 540B. Bearing housing 610 has a central bore or passage defined by a radially inner surface 612 that extends between ends 610A and 610B. A pair of first or upper annular seals 614 are disposed in the inner surface 612 of housing 610 proximal upper end 610A while a second or lower annular seal 616 is disposed in the inner surface 612 proximal lower end 610B. In this arrangement, an annular chamber 617 is formed radially between inner surface 612 and an outer surface of bearing mandrel 620, where annular chamber 617 extends axially between upper seals 614 and lower seal 616. Although in this embodiment bearing housing 610 includes upper seals 614, in other embodiments, seals 614 may instead be disposed on a generally cylindrical inner surface 742 of actuator housing 740.

Bearing mandrel 620 of bearing assembly 600 additionally includes a central sleeve 624 disposed in passage 621 and coupled to an inner surface of mandrel 620 defining passage 621. An annular piston 626 is slidably disposed in passage 621 radially between the inner surface of mandrel 620 and an outer surface of sleeve 624, where piston 626 includes a first or outer annular seal 628A that seals against the inner surface of mandrel 620 and a second or inner annular seal 628B that seals against the outer surface of sleeve 624. In this arrangement, chamber 617 extends into the annular space (via lubrication ports 623) formed between the inner surface of mandrel 620 and the outer surface of sleeve 624 that is sealed from the flow of drilling fluid through passage 621 via the annular seals 628A and 628B of piston 626.

In this embodiment, a first or upper radial bearing 630, a thrust bearing assembly 632, and a second or lower radial bearing 634 are each disposed in chamber 617. Upper radial bearing 630 is disposed about mandrel 620 and axially positioned above thrust bearing assembly 632, and lower radial bearing 634 is disposed about mandrel 620 and axially positioned below thrust bearing assembly 632. In general, radial bearings 630, 634 permit rotation of mandrel 620 relative to housing 610 while simultaneously supporting radial forces therebetween. In this embodiment, upper radial bearing 630 and lower radial bearing 634 are both sleeve type bearings that slidingly engage the outer surface of mandrel 620. However, in general, any suitable type of radial bearing(s) may be employed including, without limitation, needle-type roller bearings, radial ball bearings, or combinations thereof.

Annular thrust bearing assembly 632 is disposed about mandrel 620 and permits rotation of mandrel 620 relative to housing 610 while simultaneously supporting axial loads in both directions (e.g., off-bottom and on-bottom axial loads). In this embodiment, thrust bearing assembly 632 generally comprises a pair of caged roller bearings and corresponding races, with the central race threadedly engaged to bearing mandrel 620. In other embodiments, one or more other types of thrust bearings may be included in bearing assembly 600, including ball bearings, planar bearings, etc. In still other embodiments, the thrust bearing assemblies of bearing assembly 600 may be disposed in the same or different thrust bearing chambers (e.g., two-shoulder or four-shoulder thrust bearing chambers). In this embodiment, radial bearings 630, 634 and thrust bearing assembly 632 are oil-sealed bearings. Particularly, chamber 617 comprises an oil or lubricant filled chamber that is pressure compensated via piston 626. In other words, piston 626 equalizes the fluid pressure within chamber 617 with the pressure of drilling fluid flowing through passage 621 of mandrel 620 towards drill bit 90. As previously described, in this embodiment, bearings 630, 632, 634 are oil-sealed. However, in other embodiments, the bearings of the bearing assembly (e.g., bearing assembly 600) are mud lubricated.

Referring still to FIGS. 1, 3, and 18-32, as previously described, bend adjustment assembly 700 couples driveshaft housing 510 to bearing housing 610, and introduces bend 701 and deflection angle θ along drilling assembly 50. Central axis 515 of driveshaft housing 510 is coaxially aligned with axis 25, and central axis 625 of bearing mandrel 620 is coaxially aligned with axis 95, thus, deflection angle θ also represents the angle between axes 515, 625 when mud motor 55 is in an undeflected state (e.g., outside borehole 16). Additionally, bend adjustment assembly 700 is configured to adjust the amount of bend 701 without needing to pull drill string 21 from borehole 16 to adjust bend adjustment assembly 700 at the surface, thereby reducing the amount of time required to drill borehole 16.

In this embodiment, bend adjustment assembly 700 generally includes a first or upper offset housing 702, an upper housing extension 710, a second or lower offset housing 720, a clocker or actuator housing 740, a piston mandrel 750, a first or upper adjustment mandrel 760, a second or lower adjustment mandrel 370, and a locking piston 790. Additionally, in this embodiment, bend adjustment assembly 700 includes a locker or actuator assembly 800 housed in the actuator housing 740, where locker assembly 800 is generally configured to control the actuation of bend adjustment assembly between the unbent position 703, first bent position 705, and the second bent position with drilling assembly 50 disposed in borehole 16.

Figure 21:
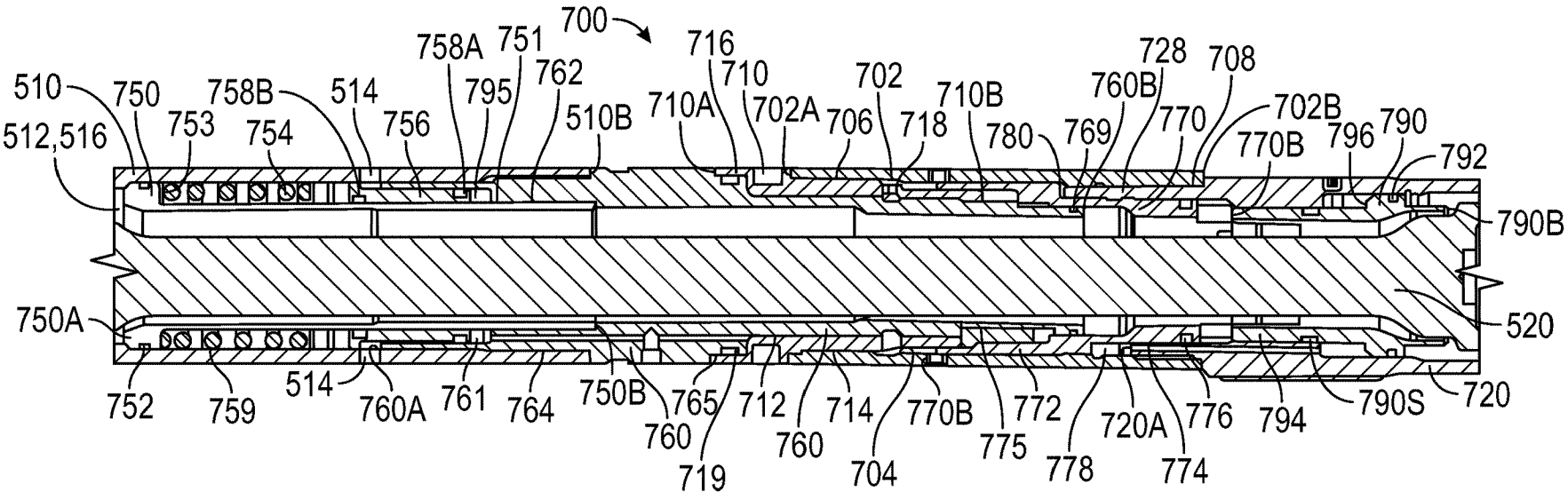
FIG. 21 is a zoomed-in, side cross-sectional view of the bend adjustment assembly of FIG. 18.

As shown particularly in FIGS. 18, 19, and 21, upper offset housing 702 of bend adjustment assembly 700 is generally tubular and has a first or upper end 702A, a second or lower end 702B, and a central bore or passage defined by a generally cylindrical inner surface 704 extending between ends 702A and 702B. The inner surface 704 of upper offset housing 702 includes a first or upper threaded connector 706 extending from upper end 702A, and a second or lower threaded connector 708 extending from lower end 702B and coupled to lower offset housing 720. Upper housing extension 710 is generally tubular and has a first or upper end 710A, a second or lower end 710B, a central bore or passage defined by a generally cylindrical inner surface 712 extending between ends 710A and 710B, and a generally cylindrical outer surface 714 extending between ends 710A and 710B. In this embodiment, the inner surface 712 of upper housing extension 710 includes an engagement surface 716 extending from upper end 710A that matingly engages an offset engagement surface 765 of upper adjustment mandrel 760. Additionally, in this embodiment, the outer surface 714 of upper housing extension 710 includes a threaded connector coupled with the upper threaded connector 706 of upper offset housing 702 and an annular shoulder 718 facing lower adjustment mandrel 770.

Figure 23:
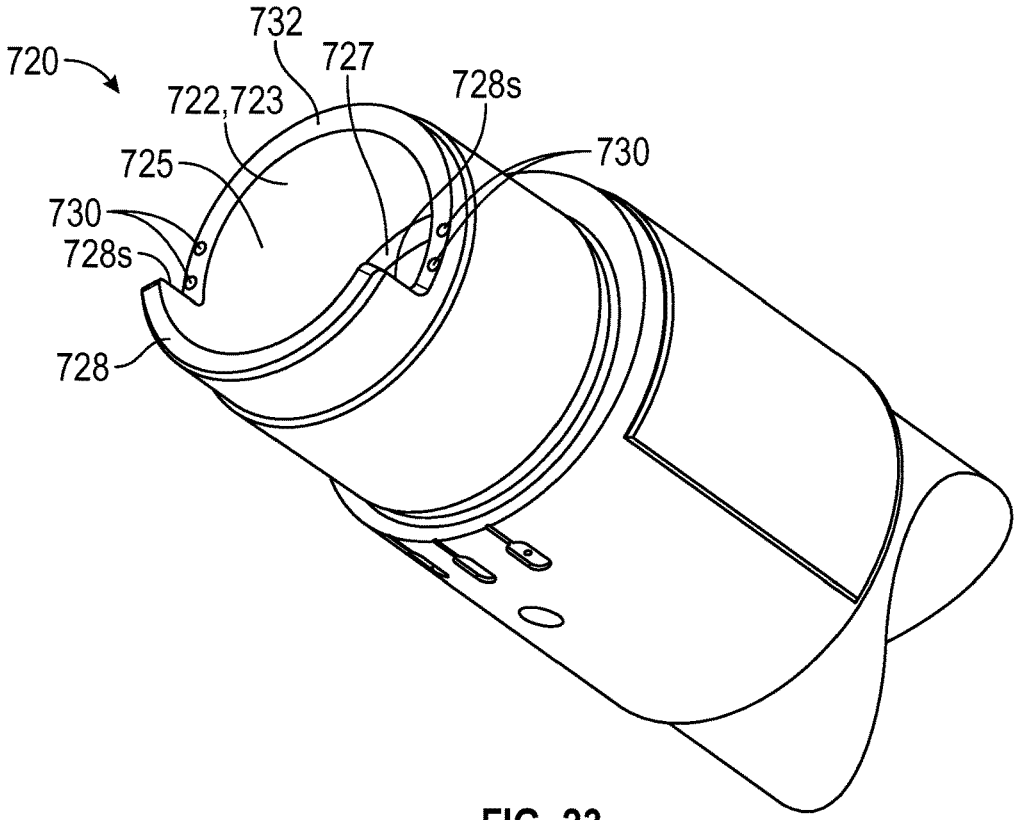
FIG. 23 is a perspective view of an embodiment of a lower offset housing of the bend adjustment assembly of FIG. 18.
Figure 24:
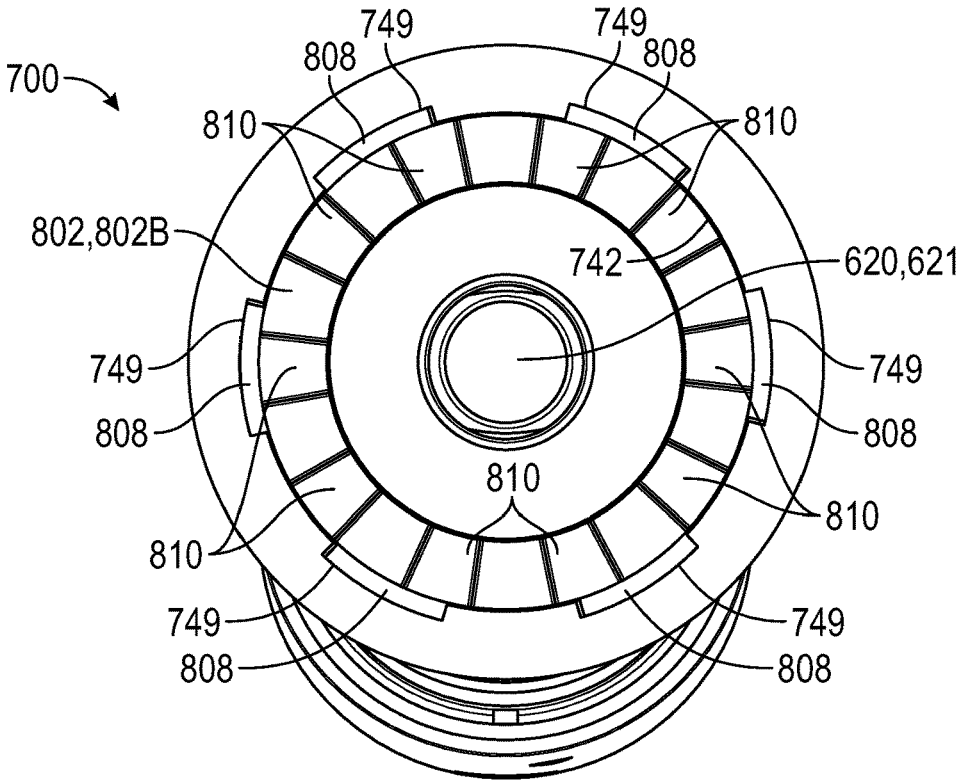
FIG. 24 is a cross-sectional view of the mud motor of FIG. 18 along line 24-24 of FIG. 22.

As shown particularly in FIGS. 21 and 23, the lower offset housing 720 of bend adjustment assembly 700 is generally tubular and has a first or upper end 720A, a second or lower end 720B, and a generally cylindrical inner surface 722 extending between ends 720A and 720B. A generally cylindrical outer surface of lower offset housing 720 includes a threaded connector coupled to the threaded connector 316 of upper offset housing 310. The inner surface 722 of lower offset housing 720 includes an offset engagement surface 723 extending from upper end 720A to an internal shoulder 727S, and a threaded connector 724 extending from lower end 720B. In this embodiment, offset engagement surface 723 defines an offset bore or passage 727 that extends between upper end 720A and internal shoulder 727S of lower offset housing 720.

Additionally, lower offset housing 720 includes a central bore or passage 729 extending between lower end 720B and internal shoulder 727S, where central passage 729 has a central axis disposed at an angle relative to a central axis of offset bore 727. In other words, offset engagement surface 723 has a central or longitudinal axis that is offset or disposed at an angle relative to a central or longitudinal axis of lower offset housing 720. Thus, in this embodiment, the offset or angle formed between central bore 729 and offset bore 727 of lower offset housing 720 facilitates the formation of bend 701 described above. In this embodiment, the inner surface 722 of lower offset housing 720 additionally includes a first or upper annular shoulder 725, a second or lower annular shoulder 726, and an annular seal 720S located between shoulders 725 and 726. Additionally, inner surface 722 of lower offset housing 720 includes a pair of circumferentially spaced slots 731, where slots 731 extend axially into lower offset housing 720 from upper shoulder 725.

In this embodiment, lower offset housing 720 of bend adjustment assembly 700 includes an arcuate, axially extending locking member or shoulder 728 at upper end 720A. Particularly, locking shoulder 728 extends arcuately between a pair of axially extending shoulders 728S. In this embodiment, locking shoulder 728 extends less than 180° about the central axis of lower offset housing 720; however, in other embodiments, the arcuate length or extension of locking shoulder 728 may vary. Additionally, lower offset housing 720 includes a plurality of circumferentially spaced and axially extending ports 730. Particularly, ports 730 extend axially between lower shoulder 726 and an arcuate shoulder 732 from which locking shoulder 728 extends. As will be discussed further herein, ports 730 of lower offset housing 720 provide fluid communication through a generally annular compensation or locking chamber 795 (shown in FIG. 9) of bend adjustment assembly 700.

Figure 22:
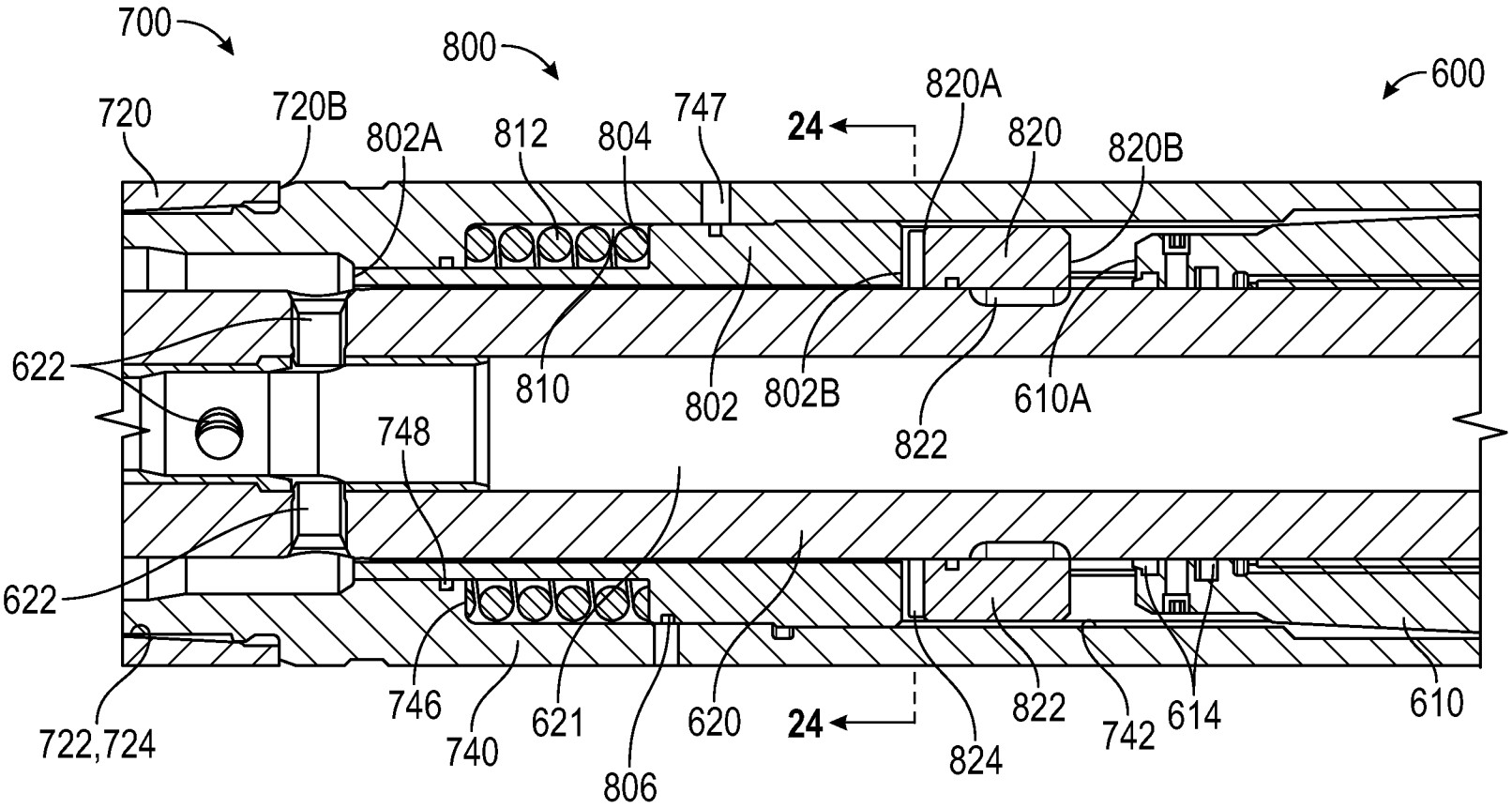
FIG. 22 is a zoomed-in, side cross-sectional view of an embodiment of an actuator assembly of the bearing assembly of FIG. 18 in accordance with principles disclosed herein.

As shown particularly in FIGS. 19 and 22, actuator housing 740 of bend adjustment assembly 700 houses the locker assembly 800 of bend adjustment assembly 700 and threadably couples bend adjustment assembly 700 with bearing assembly 600. Actuator housing 740 is generally tubular and has a first or upper end 740A, a second or lower end 740B, and a central bore or passage defined by the generally cylindrical inner surface 742 extending between ends 740A and 740B. A generally cylindrical outer surface of actuator housing 740 includes a threaded connector at upper end 740A that is coupled with the threaded connector 724 of lower offset housing 720. In this embodiment, the inner surface 742 of actuator housing 740 includes a threaded connector 744 at lower end 740B, an annular shoulder 746, and a port 747 that extends radially between inner surface 742 and the outer surface of actuator housing 740. Threaded connector 744 couples with a corresponding threaded connector disposed on an outer surface of bearing housing 610 at the upper end 610A of bearing housing 610 to thereby couple bend adjustment assembly 700 with bearing assembly 600. In this embodiment, the inner surface 742 of actuator housing 740 additionally includes an annular seal 748 located proximal shoulder 746 and a plurality of circumferentially spaced and axially extending slots or grooves 749. As will be discussed further herein, seal 748 and slots 749 are configured to interface with components of locker assembly 800.

As shown particularly in FIG. 21, piston mandrel 750 of bend adjustment assembly 700 is generally tubular and has a first or upper end 750A, a second or lower end 750B, and a central bore or passage extending between ends 750A and 750B. Additionally, in this embodiment, piston mandrel 750 includes a generally cylindrical outer surface comprising a threaded connector 751 and an annular seal 752. In other embodiments, piston mandrel 750 may not include connector 751. Threaded connector 751 extends from lower end 750B while annular seal 752 is located at upper end 750A that sealingly engages the inner surface of driveshaft housing 510. Further, piston mandrel 750 includes an annular shoulder 753 located proximal upper end 750A that physically engages or contacts an annular biasing member 754 extending about the outer surface of piston mandrel 750. In this embodiment, an annular compensating piston 756 is slidably disposed about the outer surface of piston mandrel 750. Compensating piston 756 includes a first or outer annular seal 758A disposed in an outer cylindrical surface of piston 756, and a second or inner annular seal 758B disposed in an inner cylindrical surface of piston 756, where inner seal 758B sealingly engages the outer surface of piston mandrel 750.

As shown particularly in FIG. 21, upper adjustment mandrel 760 of bend adjustment assembly 700 is generally tubular and has a first or upper end 760A, a second or lower end 760B, and a central bore or passage defined by a generally cylindrical inner surface extending between ends 760A and 760B. In this embodiment, the inner surface of upper adjustment mandrel 760 includes an annular recess 761 extending axially into mandrel 760 from upper end 760A, and an annular seal 762 axially spaced from recess 761 and configured to sealingly engage the outer surface of piston mandrel 750. The inner surface of upper adjustment mandrel 760 additionally includes a threaded connector 763 coupled with a threaded connector on the outer surface of piston mandrel 750 at the lower end 750B thereof. In other embodiments, upper adjustment mandrel 760 may not include connector 763. In this embodiment, outer seal 758A of compensating piston 756 sealingly engages the inner surface of upper adjustment mandrel 760, restricting fluid communication between locking chamber 795 and a generally annular compensating chamber 759 formed about piston mandrel 750 and extending axially between seal 752 of piston mandrel 750 and outer seal 758A of compensating piston 756. In this configuration, compensating chamber 759 is in fluid communication with the surrounding environment (e.g., borehole 16) via ports 514 in driveshaft housing 510.

In this embodiment, upper adjustment mandrel 760 includes a generally cylindrical outer surface comprising a first or upper threaded connector 764, and an offset engagement surface 765. Upper threaded connector extends from upper end 760A and couples to a threaded connector disposed on the inner surface of driveshaft housing 510 at lower end 5106. Offset engagement surface 765 has a central or longitudinal axis that is offset from or disposed at an angle relative to a central or longitudinal axis of upper adjustment mandrel 760. Offset engagement surface 765 matingly engages the engagement surface 716 of upper offset housing 702. In this embodiment, relative rotation is permitted between upper offset housing 702 and upper adjustment mandrel 760 while relative axial movement is restricted between housing 702 and mandrel 760.

Figure 26:
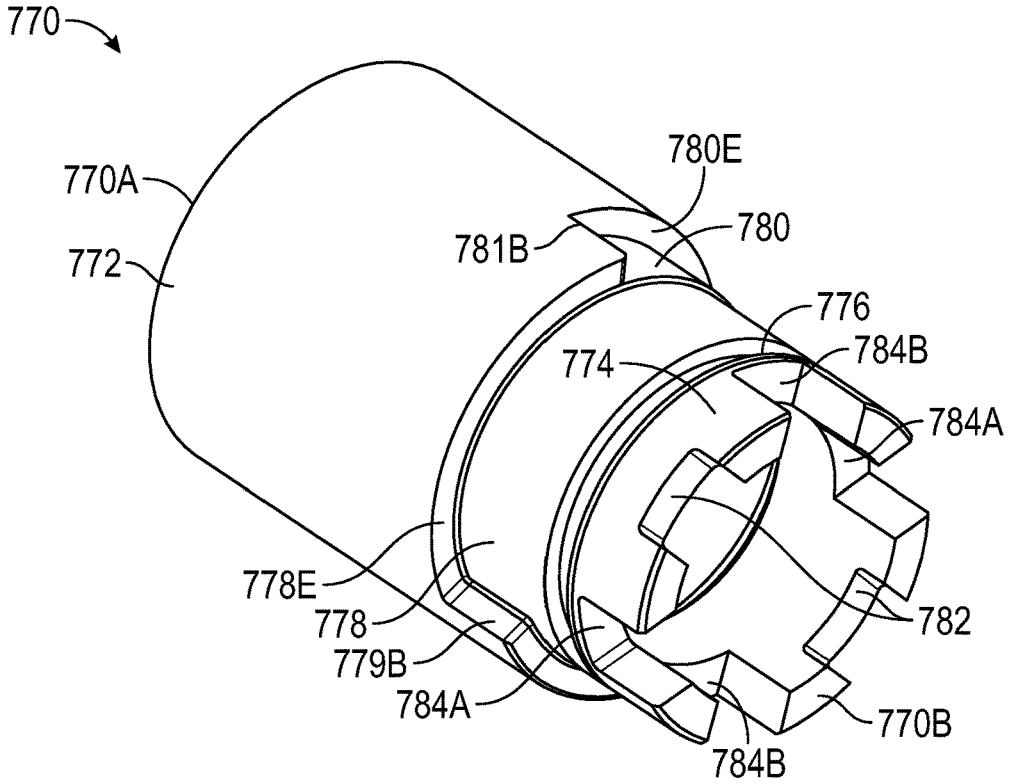
FIGS. 26 and 27 are perspective views of an embodiment of a lower adjustment mandrel of the bend adjustment assembly of FIG. 18 in accordance with principles disclosed herein.
Figure 27:
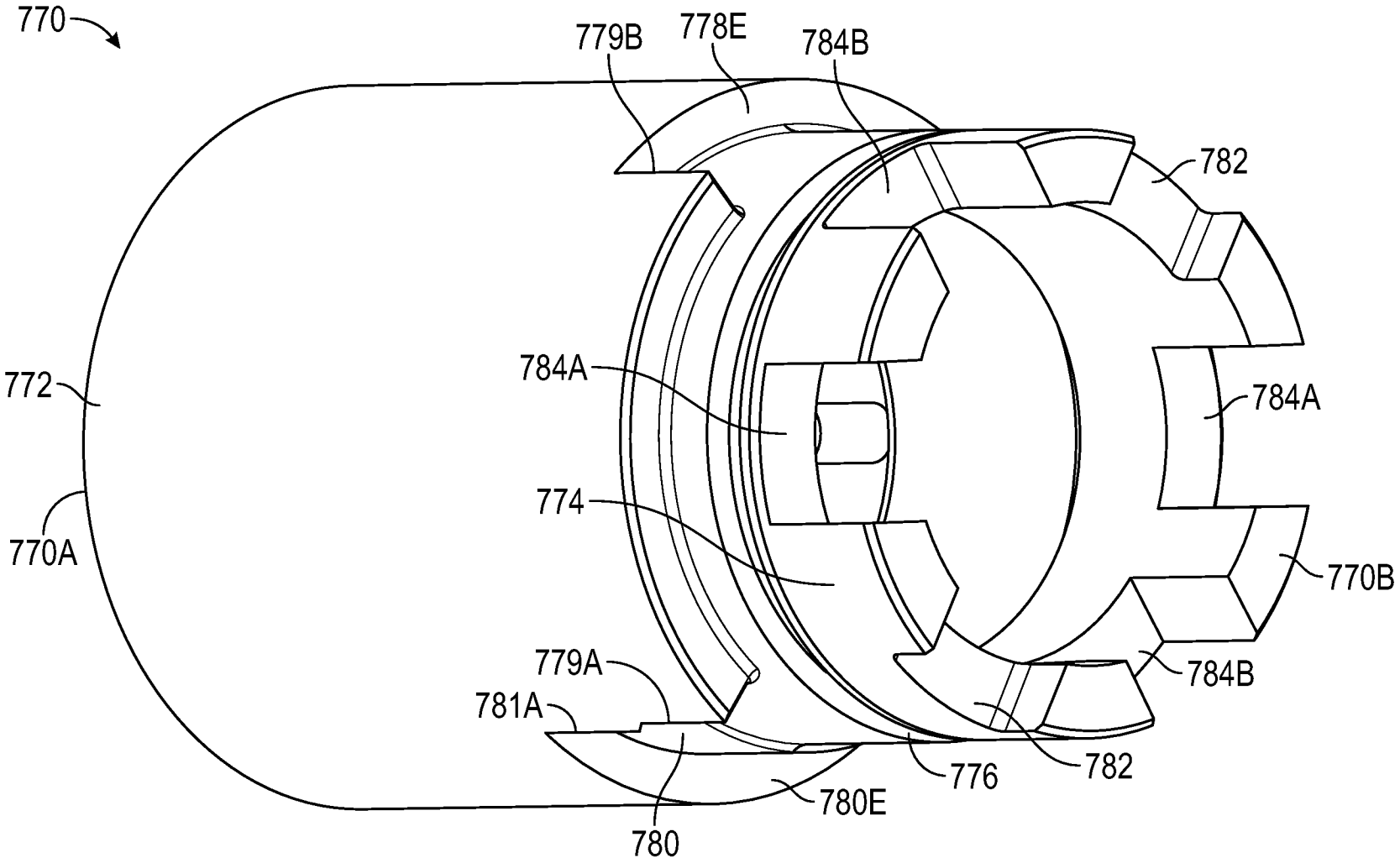
Figure 28:
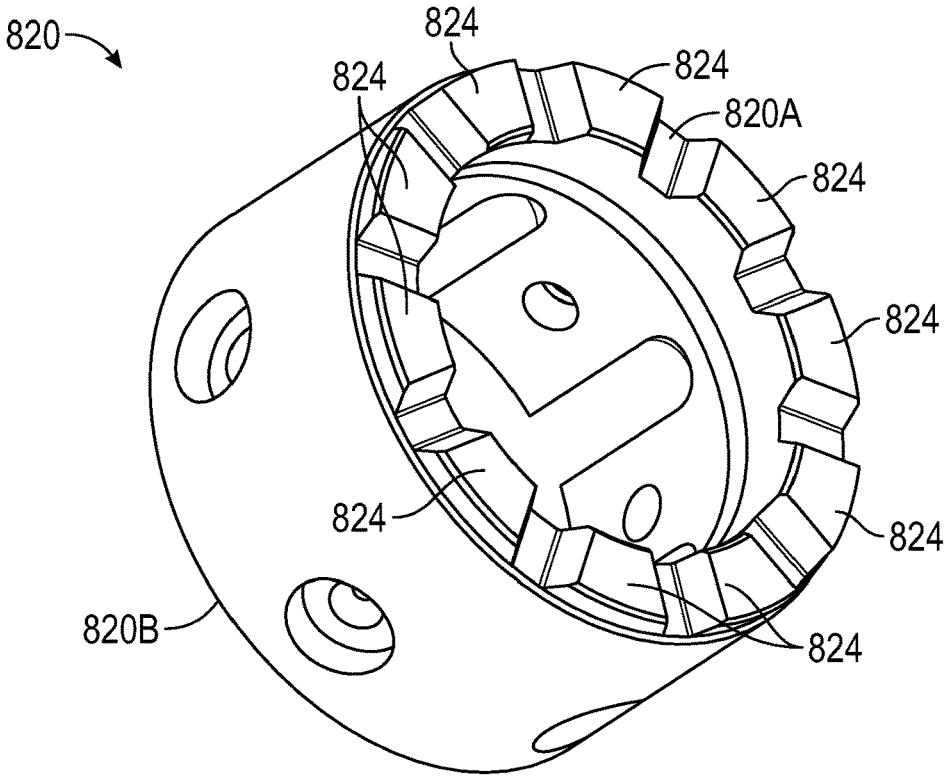
FIG. 28 is a perspective view of an embodiment of an actuator piston of the actuator assembly of FIG. 22 in accordance with principles disclosed herein.
Figure 29:
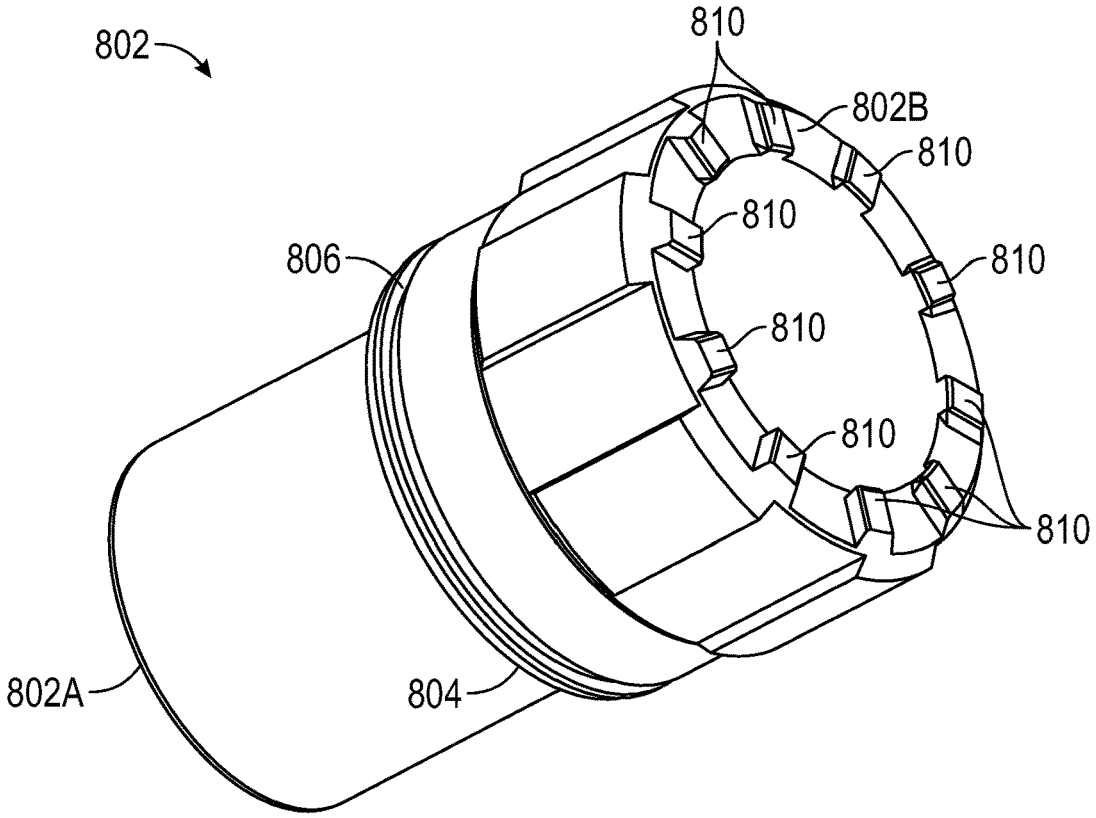
FIG. 29 is a perspective view of an embodiment of a torque transmitter of the actuator assembly of FIG. 22 in accordance with principles disclosed herein.
Figure 30:
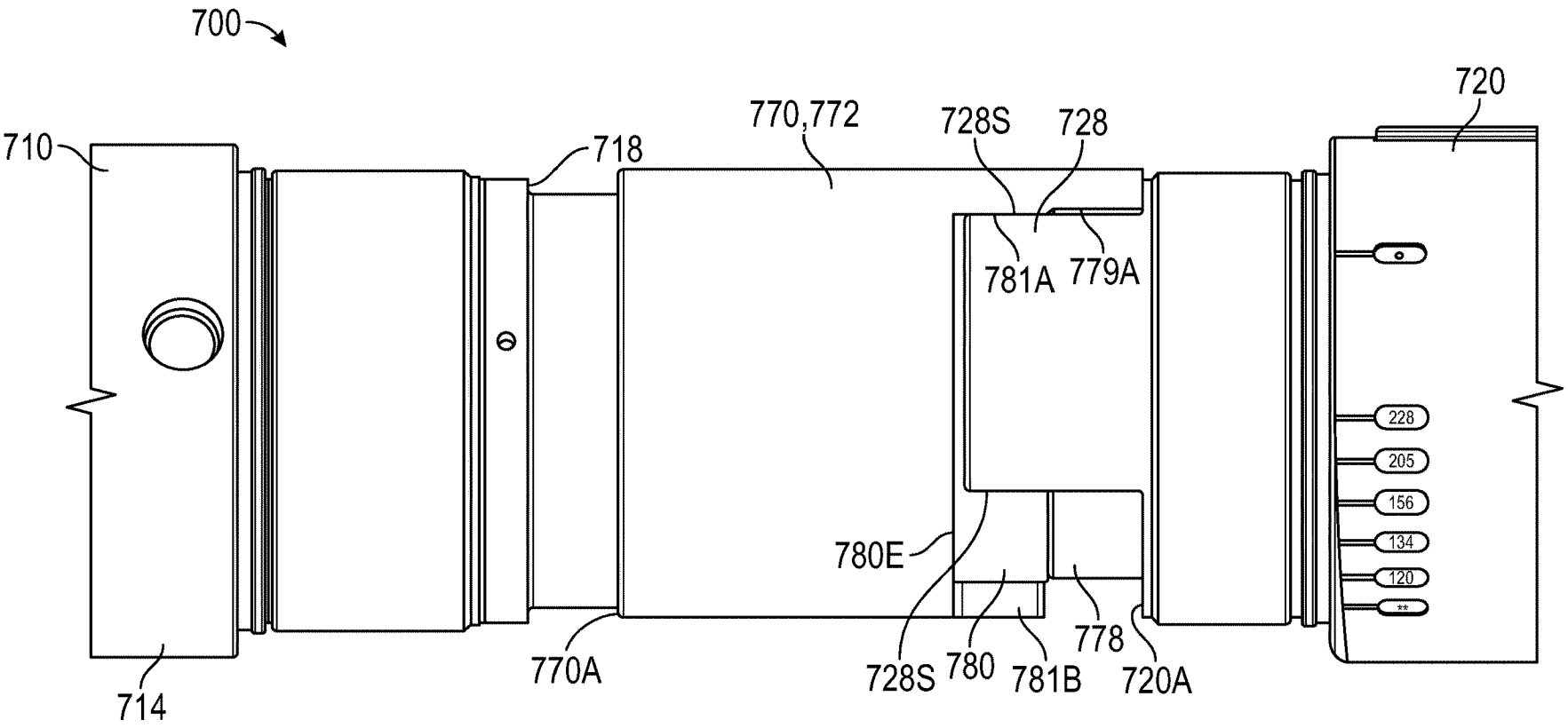
FIGS. 30 and 31 are side views of the bend adjustment assembly of FIG. 18.
Figure 31:
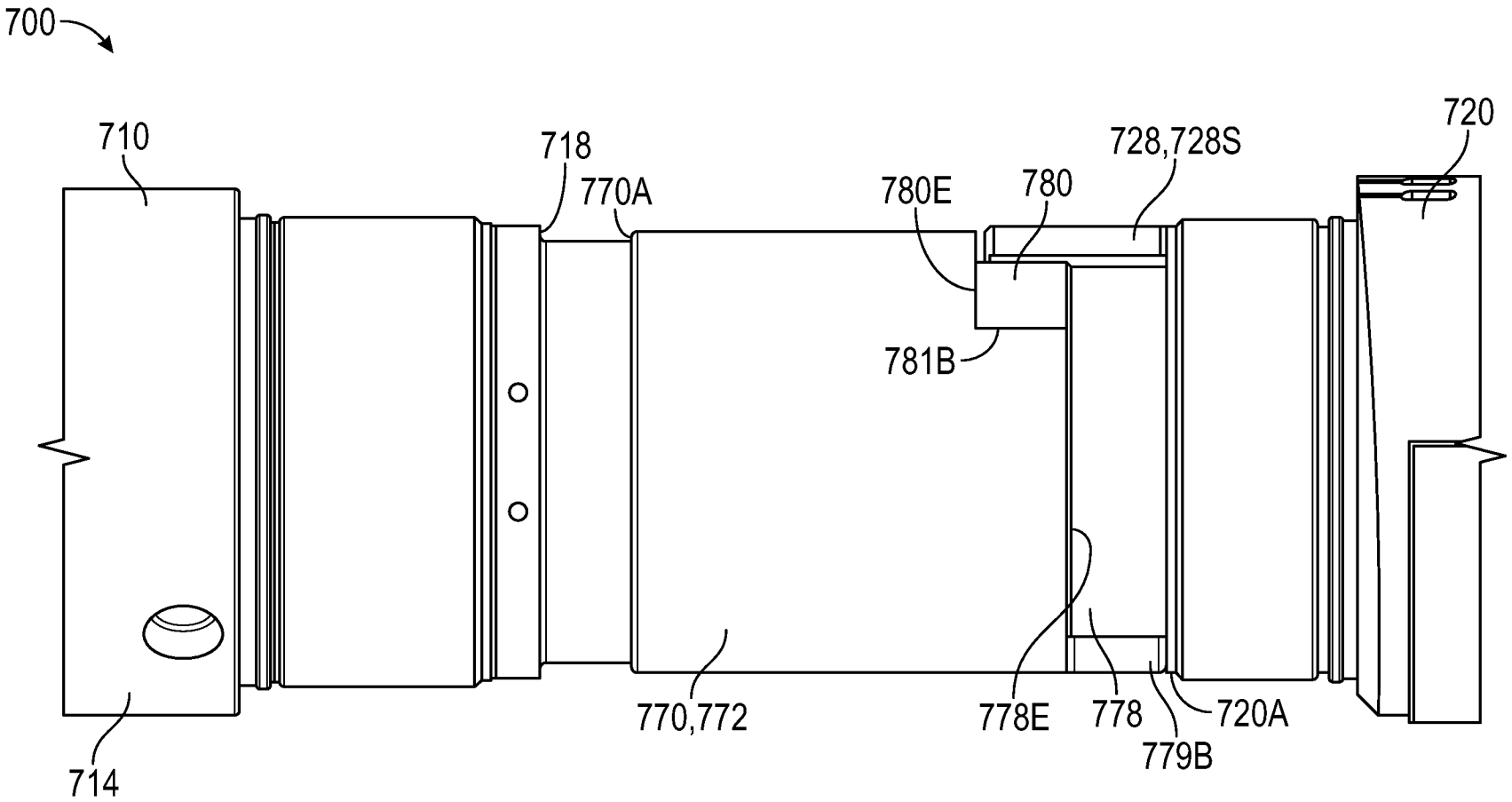
Figure 32:
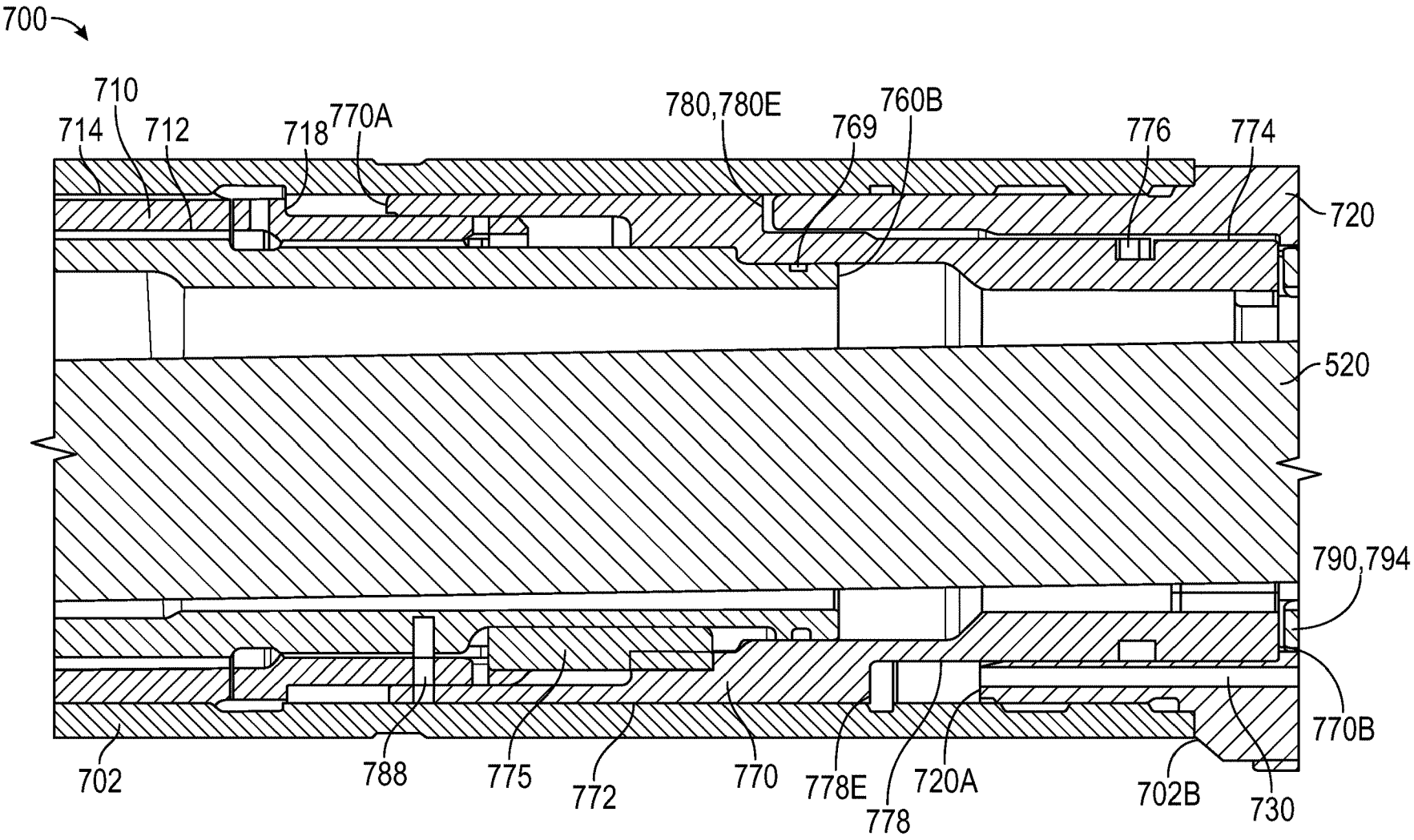
FIGS. 32 and 33 are side cross-sectional views of the bend adjustment assembly of FIG. 18.

As shown particularly in FIGS. 21, 26, and 27, lower adjustment mandrel 770 of bend adjustment assembly 700 is generally tubular and has a first or upper end 770A, a second or lower end 770B, a central bore or passage extending therebetween that is defined by a generally cylindrical inner surface extending between ends 770A, 770B, and a generally cylindrical outer surface 772 extending between ends 770A, 770B. In this embodiment, outer surface 772 of lower adjustment mandrel 770 includes an offset engagement surface 774, an annular seal 776 in sealing engagement with the inner surface of lower offset housing 720, a first or lower arcuately extending recess 778, and a second or upper arcuately extending recess 780 axially spaced from lower arcuate recess 778. Offset engagement surface 774 has a central or longitudinal axis that is offset or disposed at an angle relative to a central or longitudinal axis of the upper end 770A of upper adjustment mandrel 770 and the lower end 720B of lower offset housing 720, where offset engagement surface 774 is disposed directly adjacent or overlaps the offset engagement surface 723 of lower offset housing 720. In this embodiment, a plurality of circumferentially spaced cylindrical splines or keys 775 are positioned radially between lower adjustment mandrel 770 and upper adjustment mandrel 760 to restrict relative rotation between lower adjustment mandrel 770 and upper adjustment mandrel 760 while allowing for relative axial movement therebetween. Additionally, upper adjustment mandrel 760 includes an annular seal 769 that sealingly engages the inner surface of lower adjustment mandrel 770.

Lower arcuate recess 778 of lower adjustment mandrel 770 is defined by an inner terminal end 778E, a first shoulder 779A, and a second shoulder 779B circumferentially spaced from first shoulder 779A. Similarly, upper arcuate recess 780 of lower adjustment mandrel 770 is defined by an inner terminal end 780E, a first shoulder 781A, and a second shoulder 781B circumferentially spaced from first shoulder 781A. The inner end 778E of lower arcuate recess 778 is positioned nearer to the lower end 770B of mandrel 770 than the inner end 780E of upper arcuate recess 780. Additionally, while first shoulder 779A of lower arcuate recess 778 is generally circumferentially aligned with first shoulder 781A of upper arcuate recess 780, second shoulder 779B of lower arcuate recess 778 is circumferentially spaced from second shoulder 781B of upper arcuate recess 780. In this arrangement, the circumferential length extending between shoulders 779A, 779B of lower arcuate recess 778, is greater than the circumferential length extending between shoulders 781A, 781B of upper arcuate recess 780. Particularly, in this embodiment, lower arcuate recess 778 extends approximately 160° about the circumference of lower adjustment mandrel 770 while upper arcuate recess 780 extends approximately 60° about the circumference of lower adjustment mandrel 770; however, in other embodiments, the circumferential length of both lower arcuate recess 778 and upper arcuate recess 780 about lower adjustment mandrel 770 may vary.

Lower adjustment mandrel 770 also includes a pair of circumferentially spaced first or short slots 782, a pair of circumferentially spaced second or long slots 784A, and a second pair of circumferentially spaced long slots 784B, where both short slots 782 and long slots 784A, 784B extend axially into lower adjustment mandrel 770 from lower end 770B. In this embodiment: each short slot 782 is circumferentially spaced approximately 180° apart, each long slot 784A is circumferentially spaced approximately 180° apart, and each long slot 784B is circumferentially spaced approximately 180° apart.

Figure 33:
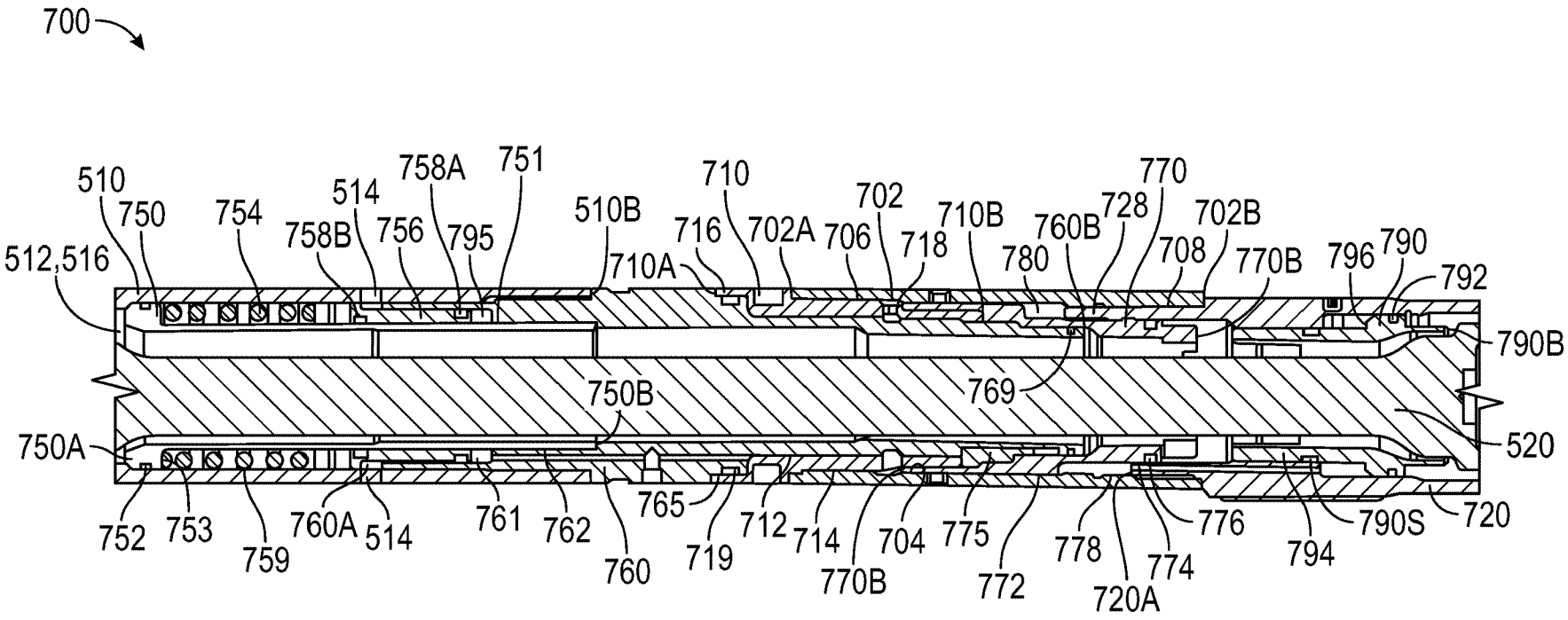
Figure 34:
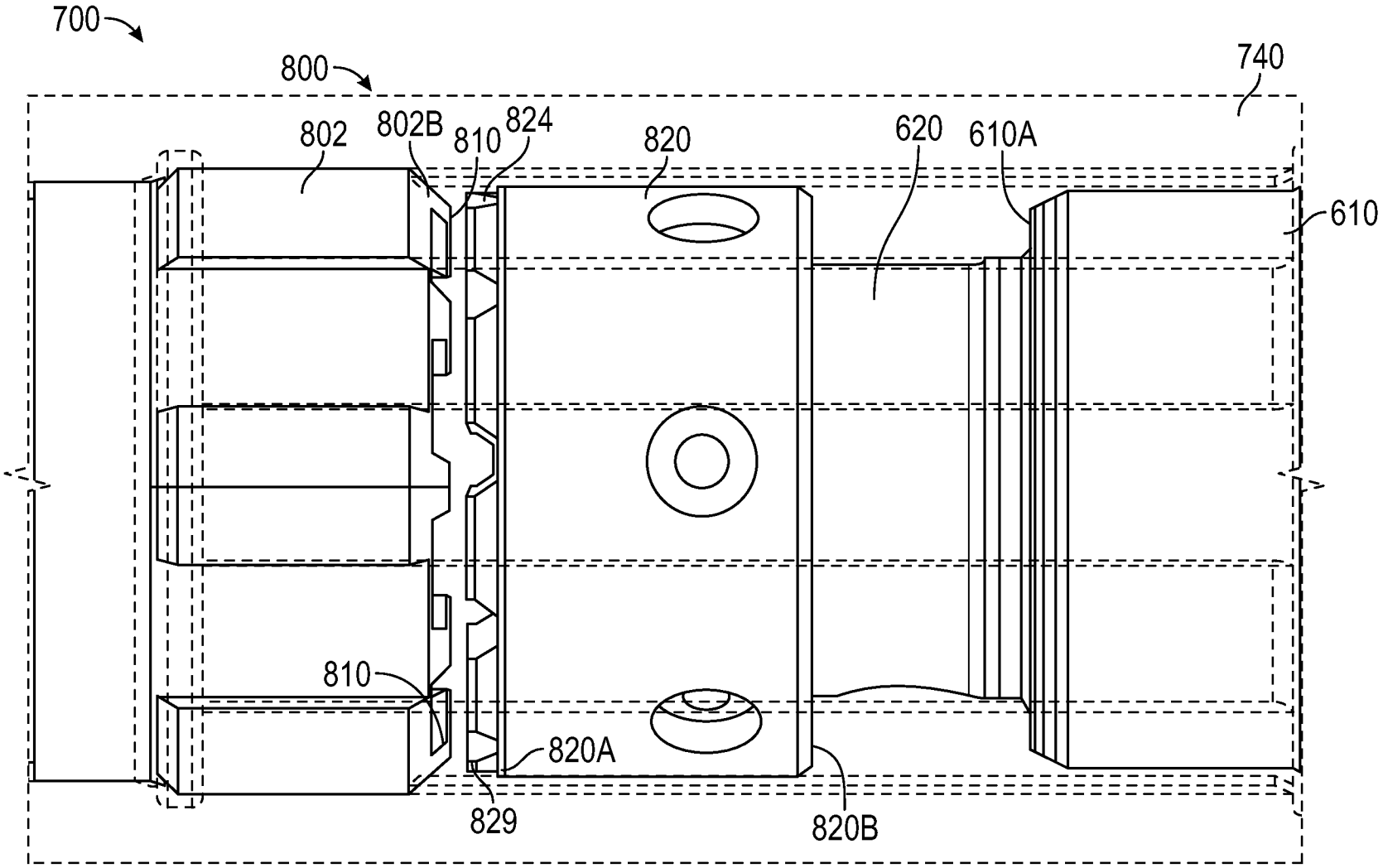
FIG. 34 is another zoomed-in, side cross-sectional view of the actuator assembly of FIG. 22.
Figure 35:
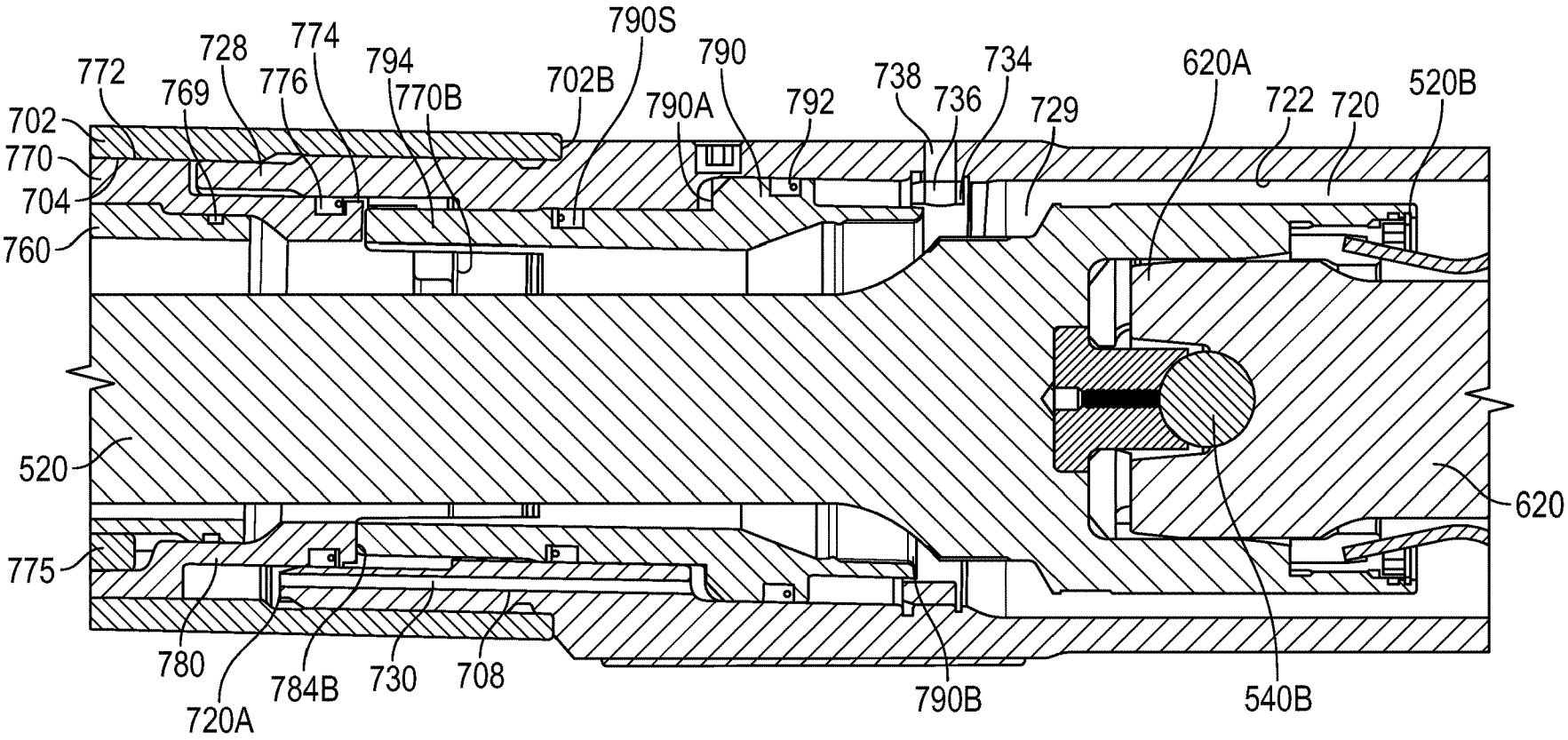
FIGS. 35 and 36 are zoomed-in, side cross-sectional views of the bend adjustment assembly of FIG. 18.
Figure 36:
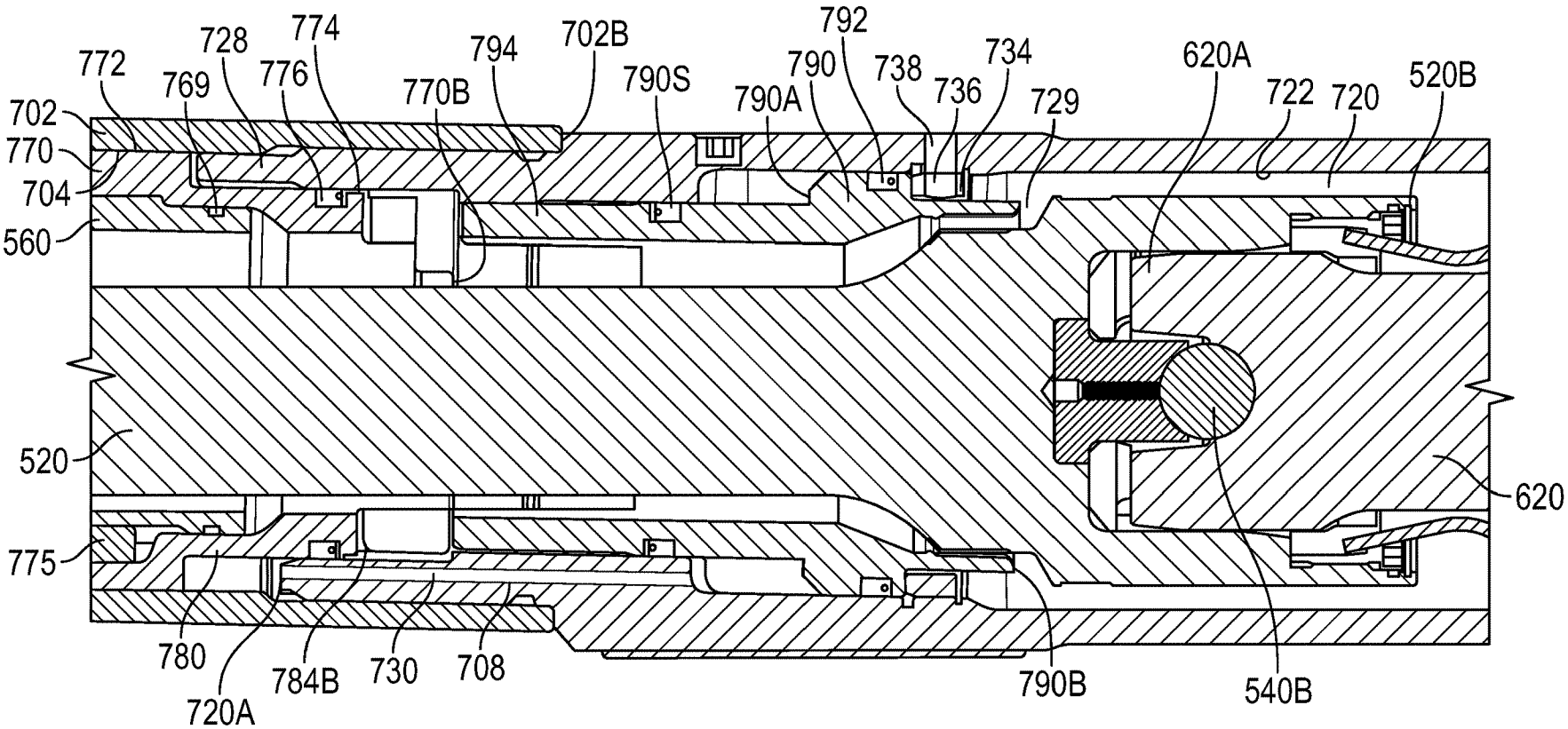

In this embodiment, lower adjustment mandrel 770 of bend adjustment assembly 700 is permitted to move axially relative to lower offset housing 720. Particularly, lower adjustment mandrel 770 is permitted to travel between a first axial position in upper housing 702 (shown in FIGS. 21 and 32) and a second axial position in upper offset housing 702 (shown in FIGS. 33, 35, and 36) that is axially spaced from the first axial position. When lower adjustment mandrel 770 is disposed in the first axial position, the locking shoulder 728 of lower offset housing 720 is received in the upper arcuate recess 780 of lower adjustment mandrel 770 and the upper end 770A of mandrel 770 is axially spaced from shoulder 718 of upper housing extension 710. Conversely, when lower adjustment mandrel 770 is disposed in the second axial position, the locking shoulder 728 of lower offset housing 720 is received in the lower arcuate recess 778 of lower adjustment mandrel 770 and the upper end 770A of mandrel contacts or is disposed directly adjacent shoulder 718 of upper housing extension 710. As shown particularly in FIG. 32, in this embodiment, lower adjustment mandrel 770 is initially held or retained in the first axial position when drilling assembly 50 is run into borehole 16 via a shear pin 788 extending radially between lower adjustment mandrel 770 and upper housing extension 710. Shear pin 788 is designed to shear or break upon the application of a predetermined axially directed force against lower adjustment mandrel 770 to allow lower adjustment mandrel 770 to travel from the first axial position to the second axial position.

Figure 25:
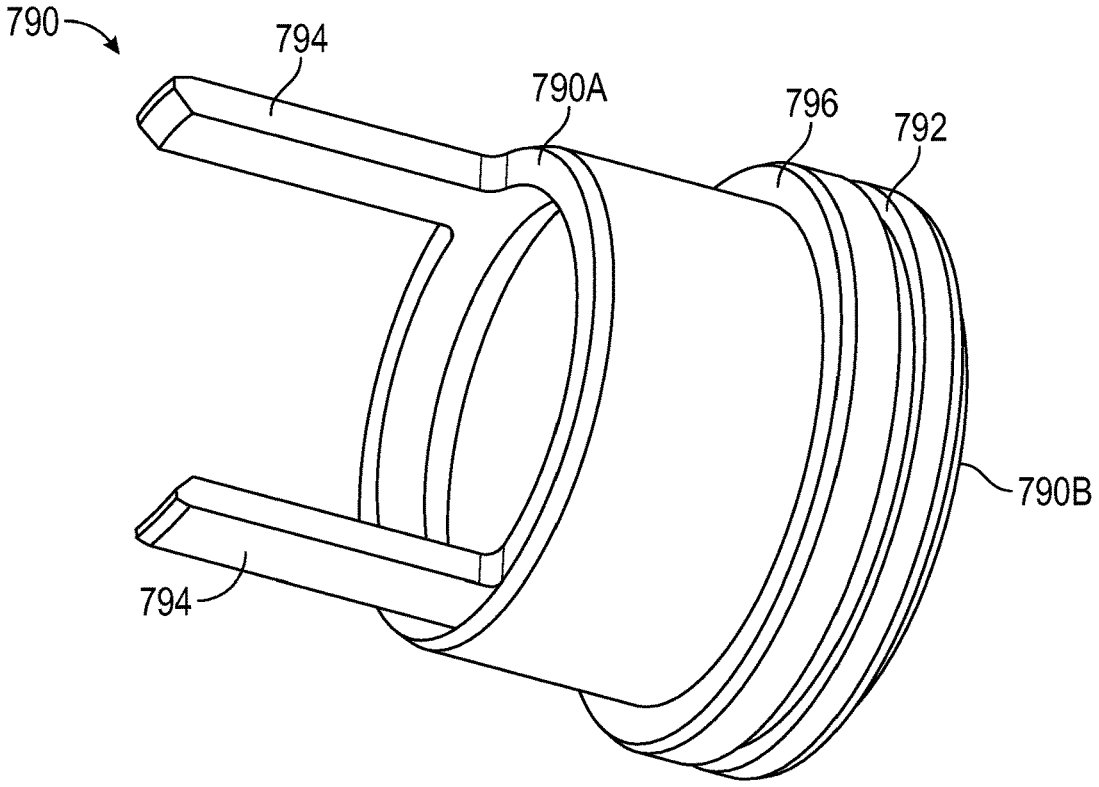
FIG. 25 is a perspective view of an embodiment of a locking piston of the bend adjustment assembly of FIG. 18 in accordance with principles disclosed herein.

As shown particularly in FIGS. 21 and 25, locking piston 790 of bend adjustment assembly 700 is generally tubular and has a first or upper end 790A, a second or lower end 790B, and a central bore or passage extending therebetween. Locking piston 790 includes a generally cylindrical outer surface comprising an annular seal 792 disposed therein. In this embodiment, locking piston 790 includes a pair of circumferentially spaced keys 794 that extend axially from upper end 790A, where each key 794 extends through one of the circumferentially spaced slots 731 of lower offset housing 720. In this arrangement, relative rotation between locking piston 790 and lower offset housing 720 is restricted while relative axial movement is permitted therebetween. Each pair of circumferentially spaced slots 782, 784A, and 784B of lower adjustment mandrel 770 is configured to matingly receive and engage the keys 794 of locking piston 790 to restrict relative rotation between lower adjustment mandrel 770 and lower offset housing 720. In this embodiment, the outer surface of locking piston 790 includes an annular shoulder 796 located between ends 790A and 790B.

The combination of sealing engagement between seal 792 of locking piston 790 and the inner surface 722 of lower offset housing 720, and seal 720S of housing 720 and the outer surface of locking piston 790, defines a lower axial end of locking chamber 795. Locking chamber 795 extends longitudinally from the lower axial end thereof to an upper axial end defined by the combination of sealing engagement between the outer seal 758A of compensating piston 756 and the inner seal 758B of piston 756. Particularly, lower adjustment mandrel 770 and upper adjustment mandrel 760 each include axially extending ports similar in configuration to the ports 730 of lower offset housing 720 such that fluid communication is provided between the annular space directly adjacent shoulder 796 of locking piston 790 and the annular space directly adjacent a lower end of compensating piston 756. Locking chamber 795 is sealed from annulus 516 such that drilling fluid flowing into annulus 516 is not permitted to communicate with fluid disposed in locking chamber 795, where locking chamber 795 is filled with lubricant.

As shown particularly in FIGS. 22, 24, 28 and 29, locker assembly 800 of bend adjustment assembly 700 generally includes a locker piston 802 and a torque transmitter or teeth ring 820. locker piston 802 is slidably disposed about bearing mandrel 620 and has a first or upper end 802A, a second or lower end 802B, and a central bore or passage extending therebetween. In this embodiment, locker piston 802 has a generally cylindrical outer surface including an annular shoulder 804 and an annular seal 806 located axially between shoulder 804 and lower end 802B. The outer surface of locker piston 802 includes a plurality of radially outwards extending and circumferentially spaced keys 808 received in the slots 749 of actuator housing 740. In this arrangement, locker piston 802 is permitted to slide axially relative actuator housing 740 while relative rotation between actuator housing 740 and locker piston 802 is restricted. Additionally, in this embodiment, locker piston 802 includes a plurality of circumferentially spaced locking teeth 810 extending axially from lower end 802B.

In this embodiment, seal 806 of locker piston 802 sealingly engages the inner surface 742 of actuator housing 740 and the seal 748 of actuator housing 740 sealingly engages the outer surface of locker piston 802 to form an annular, sealed compensating chamber 812 extending therebetween. Fluid pressure within compensating chamber 812 is compensated or equalized with the surrounding environment (e.g., borehole 16) via port 747 of actuator housing 740. Additionally, an annular biasing member 812 is disposed within compensating chamber 810 and applies a biasing force against shoulder 804 of locker piston 802 in the axial direction of teeth ring 820. Teeth ring 820 of locker assembly 800 is generally tubular and comprises a first or upper end 820A, a second or lower end 820B, and a central bore or passage extending between ends 820A and 820B. Teeth ring 820 is coupled to bearing mandrel 620 via a plurality of circumferentially spaced splines or pins 822 disposed radially therebetween. In this arrangement, relative axial and rotational movement between bearing mandrel 620 and teeth ring 820 is restricted. In this embodiment, teeth ring 820 comprises a plurality of circumferentially spaced teeth 824 extending from upper end 820A. Teeth 824 of teeth ring 820 are configured to matingly engage or mesh with the teeth 810 of locker piston 802 when biasing member 812 biases locker piston 802 into contact with teeth ring 820, as will be discussed further herein.

Having described the structure of the embodiment of driveshaft assembly 500, bearing assembly 600, and bend adjustment assembly 700, an embodiment for operating assemblies 500, 600, and 700 will now be described. As described above, bend adjustment assembly 700 is adjustable between more than two positions while disposed in borehole 16. Particularly, in this embodiment, bend adjustment assembly 700 is adjustable between a first position that is unbent, a first bent position providing a first deflection angle $\theta_1$ between the longitudinal axis 95 of drill bit 90 and the longitudinal axis 25 of drill string 21, and a second bend position providing a second deflection angle $\theta_2$ between the longitudinal axis 95 of drill bit 90 and the longitudinal axis 25 of drill string 21 that is greater than the first deflection angle $\theta_1$. In other embodiments, bend adjustment assembly 700 may incorporate a fixed bend, thereby allowing bend adjustment assembly 700 to provide three unbent deflection angles between its first, second, and third positions. Although in this embodiment bend adjustment assembly 700 is configured to actuate between three separate positions, in other embodiments, bend adjustment assembly may be configured to actuate between two positions or more than three positions.

In this embodiment, bend adjustment assembly 700 is initially deployed in borehole 16 in unbent position 703 where there is no deflection angle between the longitudinal axis 95 of drill bit 90 and the longitudinal axis 25 of drill string 21. In the unbent position 703 of bend adjustment assembly 700, lower adjustment mandrel 770 is retained in the lower position by shear pin 788. Additionally, in the unbent position 703, locking shoulder 728 of lower offset housing 720 is received in upper arcuate recess 780 of lower adjustment mandrel 770 with a first of the axially extending shoulders 728S of locking shoulder 728 contacting or disposed directly adjacent first shoulder 781A of upper arcuate recess 780 and the second of the axially extending shoulders 728S of locking shoulder 728 circumferentially spaced from second shoulder 781B of upper arcuate recess 780.

As borehole 16 is drilled by the drill bit 90 of drilling assembly 50 with bend adjustment assembly 700 disposed in the unbent position 703, drill string 21 is rotated by rotary system 24 and drilling mud is pumped through drill string 21 from surface pump 23 at a drilling flowrate. In some embodiments, the drilling flowrate comprises approximately 50%-80% of the maximum mud flowrate of drilling system 10. While drill string 21 is rotated by rotary system 24 and mud is pumped through drill string 21 at the drilling flowrate, locking piston 790 is disposed in the locked position with keys 794 of locking piston 790 are received in the first pair of long slots 784B, thereby restricting relative rotation between lower adjustment mandrel 770 and lower offset housing 720 (locking piston 790 being rotationally locked with lower offset housing 720).

When it is desired to actuate bend adjustment assembly 700 from the unbent position 703 to the first bent position 705 and thereby provide the first deflection angle $\theta_1$ between drill bit 90 and drill string 21, rotation of drill string 21 from rotary system 24 is ceased and the pumping of drilling mud from surface pump 23 is ceased for a predetermined first time period. In some embodiments, the first time period over which pumping is ceased from surface pump 23 comprises approximately 15-60 seconds; however, in other embodiments, the first time period may vary. With the flow of drilling fluid to power section 60 ceased, biasing member 754 displaces locking piston 790 from the locked position with keys 794 received in the first pair of long slots 784A of lower adjustment mandrel 770, to the unlocked position with keys 794 free from long slots 784A, thereby unlocking lower offset housing 720 from lower adjustment mandrel 770.

Following the first time period, surface pump 23 resumes pumping drilling mud into drill string 21 at a first flowrate that is reduced by a predetermined percentage from the maximum mud flowrate of drilling system 10. In some embodiments, the first flowrate of drilling mud from surface pump 23 comprises approximately 1%-30% of the maximum mud flowrate of drilling system 10; however, in other embodiments, the first flowrate may vary. In this embodiment, surface pump 23 continues to pump drilling mud into drill string 21 at the first flowrate for a predetermined second time period while rotary system 24 remains inactive. In some embodiments, the second time period comprises approximately 15-120 seconds; however, in other embodiments, the second time period may vary.

During the second time period rotational torque is transmitted to bearing mandrel 620 via rotor 70 of power section 60 and driveshaft 520. Additionally, torque applied to bearing mandrel 620 is transmitted to actuator housing 740 via the meshing engagement between teeth 824 of teeth ring 820 and teeth 810 of locker piston 802. Rotational torque applied to actuator housing 740 via locker assembly 800 is transmitted to housings 310, 720, which rotate in the first rotational direction relative lower adjustment mandrel 770. Particularly, lower offset housing 720 rotates until one of the shoulders 728S of lower offset housing 720 contacts second shoulder 781B of the upper arcuate recess 780 of lower adjustment mandrel 770, restricting further rotation of lower offset housing 720 in the first rotational direction. Following the rotation of lower offset housing 720, bend adjustment assembly 700 is disposed in the first bent position 705, thereby forming the first deflection angle $\theta_1$ of assembly 700 between drill bit 90 and drill string 21.

Following the second time period, with bend adjustment assembly 700 now disposed in the first bent position 705, the flowrate of drilling mud from surface pump 23 is increased from the first flowrate to a second flowrate that is greater than the first flowrate to displace locking piston 790 back into the locked position with keys 794 now received in the second pair of long slots 784B of lower adjustment mandrel 770. In some embodiments, the second flowrate of drilling mud from surface pump 23 comprises the drilling flowrate (e.g., approximately 50%-100% of 50%-80% of the maximum mud flowrate of drilling system 10); however, in other embodiments, the second flowrate may vary. Additionally, with drilling mud flowing through drilling assembly 50 from drill string 21 at the second flowrate, locker piston 802 is disengaged from teeth ring 820, preventing torque from being transmitted from bearing mandrel 620 to actuator housing 740. With locking piston 790 now disposed in the locked position and locker piston 802 being disengaged from teeth ring 820, drilling assembly 50 may resume drilling borehole 16.

When it is desired to actuate bend adjustment assembly 700 from the first bent position 705 to the second bent position and thereby provide the second deflection angle $\theta_2$ of assembly 700 between drill bit 90 and drill string 21, rotation of drill string 21 by rotary system 24 is ceased and the mud flowrate of surface pump 23 is increased to a third flowrate that is greater than the drilling flowrate. In some embodiments, the third flowrate of drilling mud from surface pump 23 comprises approximately 80%-100% of the maximum mud flowrate of drilling system 10; however, in other embodiments, the first flowrate may vary. The increased flowrate provided by the third flowrate increases the hydraulic pressure acting against the lower end 790B of locking piston 790, with locking piston 790 transmitting the hydraulic pressure force applied against lower end 790B to lower adjustment mandrel 770 via contact between keys 794 of locking piston 790 and the lower end 770B of lower adjustment mandrel 770. In this embodiment, the force applied to lower adjustment mandrel 770 from locking piston 790 is sufficient to shear the shear pin 788, thereby allowing both locking piston 790 and lower adjustment mandrel 770 to shift or move axially upwards through lower offset housing 720 and upper offset housing 702 until lower adjustment mandrel 770 is disposed in the second axial position with the upper end 770A of lower adjustment mandrel 770 contacting shoulder 718 of upper housing extension 710. Following the displacement of lower adjustment mandrel 770 into the second axial position, locking shoulder 728 of lower offset housing 720 is received in lower arcuate recess 778 (and is spaced from the inner end 780E of upper arcuate recess 780) of lower adjustment mandrel 770, with axially extending shoulders 728S of locking shoulder 728 circumferentially spaced from both the first and second shoulders 779A, 779B of upper arcuate recess 778.

Once lower adjustment mandrel 770 is disposed in the second axial position, the pumping of drilling mud from surface pump 23 is ceased for a predetermined third time period. In some embodiments, the third time period over which pumping is ceased from surface pump 23 comprises approximately 15-60 seconds; however, in other embodiments, the third time period may vary. With the flow of drilling fluid to power section 60 ceased, biasing member 754 displaces locking piston 790 from the locked position with keys 794 received in the second pair of long slots 784B of lower adjustment mandrel 770, to the unlocked position with keys 794 free from long slots 784B, thereby unlocking lower offset housing 720 from lower adjustment mandrel 770.

Following the third time period, surface pump 23 resumes pumping drilling mud into drill string 21 at the first flowrate for a predetermined fourth time period while rotary system 24 remains inactive. In some embodiments, the fourth time period comprises approximately 15-120 seconds; however, in other embodiments, the fourth time period may vary. During the fourth time period rotational torque is transmitted to actuator housing 740 via the meshing engagement between teeth 824 of teeth ring 820 and teeth 810 of locker piston 802. Rotational torque applied to actuator housing 740 via locker assembly 800 is transmitted to housings 310, 720, which rotate in the first rotational direction relative lower adjustment mandrel 770. Particularly, lower offset housing 720 rotates until one of the shoulders 728S of lower offset housing 720 contacts second shoulder 779B of the lower arcuate recess 778 of lower adjustment mandrel 770, restricting further rotation of lower offset housing 720 in the first rotational direction. Following the rotation of lower offset housing 720, bend adjustment assembly 700 is disposed in the second bent position, thereby forming the second deflection angle $\theta_2$ of assembly 700 between drill bit 90 and drill string 21. With bend adjustment assembly 700 now disposed in the second bent position, the flowrate of drilling mud from surface pump 23 is increased from the first flowrate to the second flowrate to displace locking piston 790 back into the locked position with keys 794 now received in short slots 782 of lower adjustment mandrel 770. Additionally, with drilling mud flowing through drilling assembly 50 from drill string 21 at the second flowrate, locker piston 802 is disengaged from teeth ring 820, preventing torque from being transmitted from bearing mandrel 620 to actuator housing 740. With locking piston 790 now disposed in the locked position and locker piston 802 being disengaged from teeth ring 820, drilling assembly 50 may resume drilling borehole 16.

In this embodiment, the transition of locking piston 790 into the locked position with keys 794 received in short slots 782 of lower adjustment mandrel 770 is indicated or registered at the surface by an increase in pressure at the outlet of surface pump 23 in response to the formation of a flow restriction in bend adjustment assembly 700. Particularly, as shown particularly in FIGS. 35 and 36, in this embodiment, lower offset housing 720 comprises a ring 734 coupled to the inner surface 722 thereof, ring 734 including a radial port 736 extending therethrough that is circumferentially and axially aligned with a radial port 738 formed in lower offset housing 720. When keys 794 are received in one of the pairs of long slots 784A, 784B of lower adjustment mandrel 770 (shown in FIG. 33), radial ports 736, 738 of ring 734 and lower offset housing 720, respectively, are not covered by locking piston 790, with the lower end 790B of locking piston 790 being disposed adjacent or axially spaced from radial ports 736, 738. In the position of locking piston 790 shown in FIG. 35, when drilling mud is pumped from surface pump 23 through bend adjustment assembly 700, a portion of the pumped drilling mud may be bled into borehole 16 via ports 736, 738, thereby reducing the pressure at the outlet of surface pump 23 at a given flowrate of surface pump 23.

Conversely, when keys 794 are received in short slots 782 of lower adjustment mandrel 770 (shown in FIG. 36), radial ports 736, 738 of ring 734 and lower offset housing 720, respectively, are obstructed or covered by locking piston 790, with the lower rend 790B of locking piston 790 being disposed axially below radial ports 736, 738. In the position of locking piston 790 shown in FIG. 36, when drilling mud is pumped from surface pump 23 through bend adjustment assembly 700, the pumped drilling mud is obstructed from flowing through radial ports 736, 738, thereby providing a pressure signal at the surface by increasing the pressure at the outlet of surface pump 23 at the given flowrate of surface pump 23. In other words, at a fixed flowrate of drilling mud pumped from surface pump 23, the pressure at the outlet of surface pump 23 will be less when keys 794 of locking piston 790 are received in one of the pairs of long slots 784A, 784B of lower adjustment mandrel 770 (corresponding with the unbent position 704 and the first bent position 705 of bend adjustment assembly 700) than when keys 794 are received in short slots 782 (corresponding with the second bent position of bend adjustment assembly 700). In other embodiments, locking piston 790 and/or lower adjustment mandrel 770 may be configured such that the pressure signal is provided at the surface when bend adjustment assembly 700 is in the unbent position 703 and/or the first bent position 705 rather than the second bent position. In other words, locking piston 790 and/or lower adjustment mandrel 770 may be configured such that the pressure signal is provided when bend adjustment assembly 700 is not at a maximum bend setting (e.g., the second deflection angle $\theta_2$ of assembly 700), whereas, in this embodiment, the pressure signal is provided when bend adjustment assembly 700 is at the maximum bend setting.

On occasion, it may be desirable to shift bend adjustment assembly 700 from the second bent position (corresponding with the second deflection angle $\theta_2$ of assembly 700) to the unbent position 703. In this embodiment, bend adjustment assembly 700 is actuated from the second bent position to the unbent position 703 by ceasing the pumping of drilling fluid from surface pump 23 for a predetermined fifth period of time. Either concurrent with the fifth time period or following the start of the fifth time period, rotary system 24 is activated to rotate drill string 21 at the actuation rotational speed for a predetermined sixth period of time. In some embodiments, both the fifth time period and the sixth time period each comprise approximately 15-120 seconds; however, in other embodiments, the fifth and sixth time periods may vary. During the sixth time period, with drill string 21 rotating at the actuation rotational speed, reactive torque is applied to bearing housing 610 via physical engagement between stabilizers 611 and the wall 19 of borehole 16, thereby rotating lower offset housing 720 relative to lower adjustment mandrel 770 in the second rotational direction. Rotation of lower offset housing 720 causes locking shoulder 728 to rotate through lower arcuate recess 778 of lower adjustment mandrel 770 until a shoulder 728S of locking shoulder 728 contacts the first shoulder 779A of lower arcuate recess 778, restricting further rotation of lower offset housing 720 in the second rotational direction. Following the fifth and sixth time periods (the sixth time period ending either at the same time as the fifth time period or after the fifth time period has ended), drilling mud is pumped through drill string 21 from surface pump 23 at the drilling flowrate to permit drilling assembly 50 to continue drilling borehole 16 with bend adjustment assembly 700 disposed in the unbent position 703 such that no deflection angle is provided between the longitudinal axis 95 of drill bit 90 and the longitudinal axis 25 of drill string 21. Although in this embodiment the bend 701 of drilling assembly 50 may be adjusted by altering a flowrate of drilling fluid through bend adjustment assembly 700, in other embodiments, bend 701 provided by drilling system 50 may be adjusted through other mechanisms, such as an electrically actuated mechanism responsive to control signals transmitted from the surface via telemetry system 30. In still other embodiments, bend adjustment assembly 700 may be actuated in response to changes in RPM of drilling assembly 50 or other drilling parameters. In some embodiments, the actuation of bend adjustment assembly 700 may occur automatically in response to drilling conditions.

Drilling assembly 50 of drilling system 10 may be used as part of a directional drilling operation to form a deviated borehole (e.g., borehole 16) without the need of a RSS. Particularly, given that the angular orientation of drilling assembly 50 may be controlled via torque control assembly 100, and the bend 701 provided by drilling assembly 50 may be controlled by bend adjustment assembly 700, drill bit 90 may be steered by torque control assembly 100 and bend adjustment assembly 700 to control the three-dimensional trajectory of deviated borehole 16. For example, borehole 16 may be drilled for a first period of time by drilling assembly 50 where drilling assembly is operated in the third mode and with bend adjustment assembly 700 in the second bent position providing the second deflection angle $\theta_2$. In some embodiments, the operation of drilling assembly 50 in the third mode and the second bent position may comprise a primary drilling mode of drilling assembly 50. After the first period of time of drilling borehole 16 with drilling assembly 50 in the primary drilling configuration has elapsed, the drill string 21 may be halted to actuate drilling assembly 50 from the primary drilling mode to a secondary drilling mode unlocking the stator assembly 142 from rotor 50 whereby the amount of torque transmitted to stator assembly 142 of torque control assembly 100 may be adjusted. Surveys may then be taken with known MWD tools of drilling assembly 50, such as accelerometers and magnetometers to measure inclination and azimuth and are generally capable of taking directional surveys in real time. The MWD data provided by the MWD tools of drilling assembly 50 may then be transmitted to the surface via telemetry system 30 and indicated to an operator of drilling system 10.

At the surface, the survey results may be reviewed and calculations can be made to determine whether borehole 16 is on-course or off-course. If it is determined following a survey that borehole 16 is off course and course deviation is necessary, the angular orientation of drilling assembly 50 (e.g., the angular orientation of drilling assembly 50 respective central axis 105 of torque control assembly 100) is reset. In some embodiments, the angular orientation of drilling assembly 50 is reset by rotating drill string 21 from the surface via rotary system 24 at the first rotational rate corresponding to the first mode of torque control assembly 100 to thereby obtain the desired angular orientation or "tool face" of drilling assembly 50 in order to correct the direction of borehole 16. In this embodiment, the downhole speed of drill string 21 is maintained within a low range (e.g., 2-3 RPM) while the angular orientation of drilling assembly is adjusted or oriented into the desired or predetermined angular orientation, corresponding to the first mode of operation described above. Additionally, bend adjustment assembly 700 may be actuated to adjust the deflection angle $\theta$ provided along drilling assembly 50 as described above to assist with returning borehole 16 to the correct course. For example, in some embodiments, bend adjustment assembly 700 is actuated into the first bent position 705 to provide first deflection angle $\theta_1$.

Once the tool face has been set, drilling assembly 50 is halted for a predefined wait period. In this embodiment, the predefined wait period is approximately between 30 seconds and 60 seconds; however, in other embodiments, the length of the predefined wait period may vary. Electronics package 420, via sensor packages 424, is configured to recognize that drilling assembly 50 has halted for the wait period, and records the "tool face setting" or angular orientation of drilling assembly 50 as an angular orientation datum in the memory of electronics package 420. Electronics package 420 stores and retains the angular orientation datum in the memory thereof until drilling assembly 50 is again halted for the predetermined wait period. Thus, angular orientation datum is retained by electronics package 420 as long as the halt time of drilling assembly 50 does not exceed the wait period.

Drill string 21 may then be rotated be rotated by rotary system 24 such that the downhole speed of drill string 21 is approximately 10-30 RPM, corresponding to the second mode of operation of torque control assembly 100. With torque control assembly 100 operating the second mode, the angular orientation or tool face setting of drilling assembly 50 is maintained or held automatically by the operation of torque control assembly 100. Particularly, while operating in the second mode, electronics package 420 varies the rotational position of rotary pilot valve 280 (via actuator 350) to maintain the angular orientation of drilling assembly 50 in borehole 16. In this mode, the drill string 21 can be rotationally driven by rotary system 24 while the angular orientation of drilling system 50 is steered to the correct course via torque control assembly 100 and bend adjustment assembly 700.

After a defined drilling period operating in the second mode of torque control assembly 100, another survey may be carried out using the MWD tools of drilling system 50, and the results of the survey may be transmitted to the surface. The drilling assembly 50 may be halted for a time less than the wait period, and the previously defined angular orientation datum being retained by the electronics package 420 of electronics sub 400. If the survey indicates that borehole 16 is still off course, and further is correction is required in the same direction, no change to the angular orientation of drilling system 50 is required and the angular orientation datum of drilling assembly 50 as well as the deflection angle θ provided by bend adjustment assembly 700 may be maintained for the subsequent drilling period. Drilling of borehole 16 may then be continued with torque control assembly operating in the second mode. However, if after the survey it is determined that no further deviation is required, torque control assembly 100 may be operated in the third mode with, in this embodiment, the downhole speed of drill string 21 being maintained at greater than 30 RPM. Additionally, bend adjustment assembly 700 may be actuated to return drilling assembly 50 to the previous deflection angle θ. Alternatively, an operator of drilling system 10 may choose to proceed in the third mode of torque control assembly 100 for a short period, and then conduct further surveys to determine whether the correct course has been achieved.

During the survey, drilling assembly 50 may again be halted for a period less that the pre-determined wait period, thereby maintaining the angular orientation datum in the memory of electronics package 420. If borehole 16 remains off-course, torque control assembly 100 may again be operated in the second mode for a further period, at the previously set angular orientation datum, to make additional course correction. Additionally, bend adjustment assembly 700 may again be actuated to adjust the deflection angle θ provided by drilling system 50 to assist with returning borehole 16 to the correct course. Therefore, drilling assembly 50 is intended to provide a significant advantage over known methods since there is no need for the operator to recalculate and reset the tool face after subsequent sections of drilling ahead (straight through drilling) and path correction drilling, allowing borehole 16 to be drilled more quickly and efficiently. Moreover, drilling system 50 allows for the drilling of deviated borehole 16 without the need of a RSS, where RSS tools are often complex and expensive, and have limited run times due to battery and electronic limitations.

While disclosed embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A rotary steerable drilling assembly for directional drilling, comprising:

a driveshaft rotatably disposed in a driveshaft housing;

a bend adjustment assembly coupled to the driveshaft housing;

a bearing mandrel coupled to the bend adjustment assembly; and a torque control assembly comprising:

a rotor configured to couple with a drill string;

a stator assembly coupled to a downhole motor; and a torque control actuator assembly configured to control the amount of torque transmitted between the rotor and the stator assembly, wherein the torque control actuator assembly comprises a spool valve comprising a cylinder including a port and a hydraulically actuatable piston slidably disposed in the cylinder;

wherein the bend adjustment assembly includes a first position configured to provide a first deflection angle between a longitudinal axis of the driveshaft housing and a longitudinal axis of the bearing mandrel; and wherein the bend adjustment assembly includes a second position configured to provide a second deflection angle between the longitudinal axis of the driveshaft housing and the longitudinal axis of the bearing mandrel, the second deflection angle being different from the first deflection angle.

2. The drilling assembly of claim 1, wherein the torque control actuator assembly is configured to selectably adjust a restriction to a fluid flow along a circulation flowpath extending between the rotor and the stator assembly.

3. The drilling assembly of claim 2, wherein the circulation flowpath extends through the port of the cylinder.

4. The drilling assembly of claim 3, wherein the torque control actuator assembly comprises:

a rotary pilot valve rotatably disposed in a valve body; and an actuator coupled with the rotary pilot valve;

wherein the actuator is configured to selectably rotate the rotary pilot valve relative to the valve body; and wherein the rotary pilot valve is configured to adjust an axial position of the piston of the spool valve in response to relative rotation between the rotary pilot valve and the valve body.

5. The drilling assembly of claim 2, wherein the stator assembly comprises an outer housing and an inner stator, and wherein the circulation flowpath extends between the outer housing and the inner stator.

6. The drilling assembly of claim 1, further comprising a bend adjustment actuator assembly configured to move the bend adjustment assembly between the first position and the second position in response to a change in flowrate of a drilling fluid received by the downhole motor.

7. The drilling assembly of claim 6, wherein the bend adjustment actuator assembly comprises:

a locker piston coupled to an actuator housing of the bend adjustment assembly, the locker piston comprising a first set of teeth; and a teeth ring coupled to the bearing mandrel, the teeth ring comprising a second set of teeth configured to matingly engage the first set of teeth and to transmit torque between the bearing mandrel and the actuator housing.

8. The drilling assembly of claim 7, wherein the locker piston has a first end configured to receive fluid pressure equal to fluid pressure in the surrounding environment and a second end configured to receive fluid pressure equal to fluid pressure of the drilling fluid flowing through the bend adjustment assembly.

9. The drilling assembly of claim 1, wherein the bend adjustment assembly further comprises a locking piston that includes a locked position preventing actuation of the bend adjustment assembly between the first and second positions, and an unlocked position permitting actuation of the bend adjustment assembly between the first and second positions.

10. The drilling assembly of claim 1, wherein the bend adjustment assembly includes a third position that provides a third deflection angle between the longitudinal axis of the driveshaft housing and the longitudinal axis of the bearing mandrel, the third deflection angle being different from both the first deflection angle and the second deflection angle.

11. The drilling assembly of claim 1, wherein the torque control assembly comprises:

a first mode configured to adjust an angular orientation of the drilling assembly within a wellbore; and a second mode configured to hold the angular orientation of the drilling assembly within the wellbore;

wherein the torque control assembly is actuated between the first mode and the second mode in response to altering a rotational rate of the drill string.

12. The drilling assembly of claim 11, wherein the torque control assembly comprises a third mode configured to restrict relative rotation between the rotor and the stator assembly, and wherein the torque control assembly is actuated into the third mode in response to altering the rotational rate of the drill string.

13. The drilling assembly of claim 12, wherein the torque control assembly is configured to:

actuate from the first mode to the second mode in response to the rotational rate of the drill string being increased from a first rotational rate to a second rotational rate that is greater than the first rotational rate; and actuate into the third mode in response to the rotational rate of the drill string being increased from to a third rotational rate that is greater than both the first rotational rate and the second rotational rate.

14. The drilling assembly of claim 1, wherein the torque control actuator assembly is radially offset from a central axis of the torque control assembly.

15. The drilling assembly of claim 1, wherein:

the torque control actuator assembly is configured to selectably adjust a restriction to a fluid flow along a circulation flowpath extending between the rotor and the stator assembly; and the rotor of the torque control assembly comprises a central passage and wherein the circulation flowpath the circulation flowpath extends through an annulus formed between the rotor and the stator of the torque control assembly that is radially offset from the central passage.

16. A drilling system for drilling a borehole that extends through a subterranean earthen formation, the system comprising:

a drilling rig;

a drill string extending from the drilling rig into the borehole;

a drilling assembly coupled to an end of the drill string and comprising:

a driveshaft rotatably disposed in a driveshaft housing;

a bend adjustment assembly coupled to the driveshaft housing;

a bearing mandrel coupled to the bend adjustment assembly;

a torque control assembly comprising:

a rotor configured to couple with the drill string;

a stator assembly coupled to a downhole motor; and a torque control actuator assembly configured to control the amount of torque transmitted between rotor and the stator assembly, wherein the torque control actuator assembly comprises a spool valve comprising a cylinder including a port and a piston slidably disposed in the cylinder;

wherein the bend adjustment assembly includes a first position configured to provide a first deflection angle between a longitudinal axis of the driveshaft housing and a longitudinal axis of the bearing mandrel; and wherein the bend adjustment assembly includes a second position configured to provide a second deflection angle between the longitudinal axis of the driveshaft housing and the longitudinal axis of the bearing mandrel, the second deflection angle being different from the first deflection angle.

17. The drilling system of claim 16, wherein the torque control actuator assembly is configured to selectably adjust a restriction to a fluid flow along a circulation flowpath extending between the rotor and the stator assembly and through the port of the cylinder.

18. The drilling system of claim 17, wherein the torque control actuator assembly comprises:

a rotary pilot valve rotatably disposed in a valve body; and an actuator coupled with the rotary pilot valve;

wherein the actuator is configured to selectably rotate the rotary pilot valve relative to the valve body;

wherein the rotary pilot valve is configured to adjust an axial position of the piston of the spool valve in response to relative rotation between the rotary pilot valve and the valve body.

19. The drilling system of claim 18, wherein:

the torque control assembly comprises an electronics package that is in signal communication with the drilling rig via a telemetry system; and wherein the electronics package is configured to transmit a control signal to the actuator to control the rotation of the rotary pilot valve relative to the valve body.

20. The drilling system of claim 16, wherein the stator assembly comprises an outer housing and an inner stator, and wherein a circulation flowpath extends between the outer housing and the inner stator.

21. The drilling system of claim 16, wherein the drilling assembly further comprises a bend adjustment actuator assembly configured to move the bend adjustment assembly between the first position and the second position in response to a change in flowrate of a drilling fluid received by the downhole motor.

22. The drilling system of claim 21, wherein the bend adjustment actuator assembly comprises:

a locker piston coupled to an actuator housing of the bend adjustment assembly, the locker piston comprising a first set of teeth; and a teeth ring coupled to the bearing mandrel, the teeth ring comprising a second set of teeth configured to matingly engage the first set of teeth and to transmit torque between the bearing mandrel and the actuator housing.

23. The drilling system of claim 16, wherein the bend adjustment assembly further comprises a locking piston that includes a locked position preventing actuation of the bend adjustment assembly between the first and second positions, and an unlocked position permitting actuation of the bend adjustment assembly between the first and second positions.

24. The drilling system of claim 16, wherein the torque control assembly comprises:

a first mode configured to adjust an angular orientation of the drilling assembly within the borehole;

a second mode configured to hold the angular orientation of the drilling assembly; and a third mode configured to restrict relative rotation between the rotor and the stator assembly;

wherein the torque control assembly is actuated between the first mode, the second mode, and the third mode in response to altering a rotational rate of the drill string.

25. The drilling system of claim 24, wherein the torque control assembly is configured to:

actuate from the first mode to the second mode in response to the rotational rate of the drill string being increased from a first rotational rate to a second rotational rate that is greater than the first rotational rate; and actuate into the third mode in response to the rotational rate of the drill string being increased from to a third rotational rate that is greater than both the first rotational rate and the second rotational rate.

* * * * *